US010045620B2

(12) United States Patent
Oehler

(10) Patent No.: US 10,045,620 B2
(45) Date of Patent: Aug. 14, 2018

(54) RECONFIGURABLE FURNITURE SYSTEM

(71) Applicant: Erich Oehler, San Francisco, CA (US)

(72) Inventor: Erich Oehler, San Francisco, CA (US)

( * ) Notice: Subject to any disclaimer, the term of this patent is extended or adjusted under 35 U.S.C. 154(b) by 86 days.

(21) Appl. No.: 14/931,598

(22) Filed: Nov. 3, 2015

(65) Prior Publication Data

US 2016/0051051 A1 Feb. 25, 2016

Related U.S. Application Data

(63) Continuation-in-part of application No. 29/473,687, filed on Nov. 25, 2013, now Pat. No. Des. 744,264.

(51) Int. Cl.

| | |
|---|---|
| ***A47B 87/00*** | (2006.01) |
| ***A47B 47/00*** | (2006.01) |
| ***A47B 13/00*** | (2006.01) |
| ***A47B 96/02*** | (2006.01) |
| ***A47B 87/02*** | (2006.01) |

(52) U.S. Cl.

CPC ..... *A47B 96/024* (2013.01); *A47B 13/003* (2013.01); *A47B 47/0083* (2013.01); *A47B 87/0246* (2013.01)

(58) Field of Classification Search

CPC . A47B 96/024; A47B 13/003; A47B 47/0083; A47B 87/0246; A47B 87/0223; A47B 87/02; A47B 87/0215

See application file for complete search history.

(56) References Cited

U.S. PATENT DOCUMENTS

| | | | | |
|---|---|---|---|---|
| 472,347 A * | 4/1892 | Gibbs | ..... | A47B 57/265 211/187 |
| 1,252,816 A | 1/1918 | Kuehl | | |
| 1,764,413 A * | 6/1930 | Nielsen | ..... | A47B 57/26 108/186 |

(Continued)

FOREIGN PATENT DOCUMENTS

| | | |
|---|---|---|
| DE | 2627260 A1 | 1/1977 |
| DE | 2627260 C2 | 9/1987 |

(Continued)

OTHER PUBLICATIONS

"Composable Furnishing Elements in Steel and Glass"; MOD26; www.mod26.com; Advertising Material of Jun. 2014; (1 page).

*Primary Examiner* — Daniel J Troy
*Assistant Examiner* — Kimberley S Wright
(74) *Attorney, Agent, or Firm* — Nixon Peabody LLP

(57) ABSTRACT

A freestanding shelf assembly includes a pair of base frames, a bottom shelf panel, a first pair of support frames, and a plurality of screws. Each base frame has an elongate rail portion extending horizontally between vertical leg portions terminating at a horizontal top portion with a hole therein. The bottom shelf panel has a plurality of holes through its surface and positioned over the pair of base frames such that each hole aligns with a corresponding hole of the base frames. Each support frame has an elongate support portion extending horizontally between vertical leg portions terminating at a horizontal bottom portion having a hole. Each screw passes through respective holes of the first pair of support frames and through respective holes of the bottom shelf panel, and threadably engages respective holes of the base frames, to form the freestanding shelf assembly.

16 Claims, 53 Drawing Sheets

(56) References Cited

U.S. PATENT DOCUMENTS 1,989,849 A * 2/1935 Davies ..... A47B 47/042 108/101
3,096,731 A * 7/1963 Lehman ..... A47K 10/04 108/29
3,106,901 A * 10/1963 Locek ..... A47B 3/12 108/1
3,307,505 A * 3/1967 Windross ..... A47B 47/042 108/180
3,730,601 A * 5/1973 Misenheimer, III ..... A47B 87/0215 108/159
4,056,295 A 11/1977 Downing
4,192,562 A 3/1980 Bishoff
4,202,586 A 5/1980 Oplinger
4,592,601 A 6/1986 Hlinsky
4,635,563 A * 1/1987 Hand ..... A47B 57/265 108/107
4,681,378 A 7/1987 Hellman, III
4,869,380 A 9/1989 Metcalfe
4,884,420 A * 12/1989 Finkel ..... E05B 73/0082 211/4
4,997,240 A 3/1991 Schmalzl
5,059,056 A 10/1991 Banthia
5,142,445 A 8/1992 Sorensen
5,216,211 A * 6/1993 Renk, Jr. ..... A47B 81/06 181/153
5,423,604 A 6/1995 Chem
5,655,662 A 8/1997 Garcia
5,695,263 A 12/1997 Simon
5,706,741 A * 1/1998 Thorp ..... A47B 47/05 108/153.1
5,749,476 A 5/1998 Besserer
5,806,946 A 9/1998 Benner
5,899,545 A 5/1999 Besserer
5,932,843 A 8/1999 Besserer
5,964,360 A * 10/1999 Hwang ..... A47B 87/0215 211/186
5,997,117 A 12/1999 Krietzman
6,039,420 A 3/2000 Besserer
6,062,664 A 5/2000 Benner
6,179,398 B1 1/2001 Martin
6,315,132 B1 11/2001 Hartel
6,347,592 B1 * 2/2002 Gessert ..... B25H 1/02 108/157.16
6,450,107 B1 * 9/2002 Sanz Novales ..... A47B 13/003 108/153.1
6,516,731 B1 * 2/2003 Park ..... A47B 41/00 108/13
6,561,603 B2 5/2003 Knab
6,575,657 B1 6/2003 Reuter
6,634,512 B2 10/2003 Knab
D482,955 S 12/2003 Segall
6,678,161 B1 1/2004 Claprood
6,695,418 B2 2/2004 Skov
D490,996 S 6/2004 Weiss
D491,750 S * 6/2004 Bertoncini ..... D6/675.3
6,877,824 B2 4/2005 Winkless
6,902,068 B1 6/2005 Fontana
6,912,960 B2 * 7/2005 Tsai ..... A47B 21/03 108/102
6,955,410 B1 10/2005 Nelson
6,968,962 B2 11/2005 Toma
D517,352 S 3/2006 Wicha
7,014,267 B1 3/2006 Nagar
D551,468 S 9/2007 Hoglan
7,467,721 B2 * 12/2008 Choi ..... A47B 47/00 211/189
D587,497 S 3/2009 Zambelli
D589,280 S 3/2009 Zambelli
D599,577 S 9/2009 Lara
D619,826 S 7/2010 Calco
7,765,942 B2 * 8/2010 Choi ..... A47B 47/04 108/147.16
7,784,885 B2 8/2010 Steiger
7,839,635 B2 11/2010 Donowho
7,866,768 B2 1/2011 Mallouk
7,866,769 B2 1/2011 Ahlgrim
7,980,626 B1 * 7/2011 Chen ..... A47B 37/04 108/157.16
D663,138 S 7/2012 Andersen
D663,139 S 7/2012 Zambelli
8,302,542 B2 * 11/2012 Ma ..... A47B 13/06 108/180
8,381,922 B2 * 2/2013 Chung ..... A47B 43/00 108/193
D696,539 S 12/2013 Zambelli
D744,264 S * 12/2015 Oehler ..... D6/705
2003/0075083 A1 * 4/2003 Devey ..... A47B 87/0246 108/92
2004/0217677 A1 11/2004 Durand
2005/0200250 A1 9/2005 Zillmann
2006/0250052 A1 11/2006 Davis
2007/0080614 A1 4/2007 Stein
2007/0102315 A1 5/2007 Garcia De Alba
2008/0061019 A1 * 3/2008 Lin ..... A47B 47/0083 211/187
2011/0068668 A1 3/2011 Wilson
2011/0239366 A1 10/2011 Boyle
2011/0304249 A1 12/2011 Lai
2013/0208420 A1 8/2013 Franklin
2016/0051051 A1 * 2/2016 Oehler ..... A47B 96/024 211/186
2016/0157605 A1 * 6/2016 Grad ..... A47B 47/0083 108/189

FOREIGN PATENT DOCUMENTS

DE 4119435 A1 12/1992
DE 4135893 C1 4/1993
DE 19860408 C1 7/2000
DE 4119435 C2 2/2003
DE 10152240 C1 5/2003
DE 202012006376 U1 * 8/2012 ..... A47B 87/0215
EP 0045926 A2 2/1982
EP 0729696 A1 9/1996
EP 0773615 B1 5/1997
EP 0834974 A2 4/1998
EP 0729696 B1 2/2000
FR 1191382 A * 10/1959 ..... A47B 47/00
GB 1119161 7/1968
GB 2212879 A 8/1989
WO WO 2008/067837 6/2008
WO WO 2011/095380 8/2011
WO WO 2012/031696 3/2012
WO WO 2012/031697 3/2012

* cited by examiner

RECONFIGURABLE FURNITURE SYSTEM

CROSS-REFERENCE TO RELATED APPLICATION

This application is a continuation-in-part of U.S. Design patent application Ser. No. 29/473,687, filed on Nov. 25, 2013, for a "Modular Cabinet System," which is incorporated herein in its entirety.

FIELD OF THE INVENTION

The present disclosure relates generally to furniture, and, more particularly, to a modular furniture system for producing a shelf, drawer, table, desk, and other furniture assemblies.

BACKGROUND OF THE INVENTION

This invention defines a composable furniture system: namely, a system for assembling simple components into unique product assemblies that can be customized at purchase and modified in the future. The system defined in this invention creates new paths for the furniture lifecycle: the reuse of components in new compositions and the ability to modify what you have today to create what you need tomorrow The typical furnishing product deteriorates with use and proceeds along a standard furniture lifecycle from initial purchase to disposal or aftermarket sale. Most furniture products are not designed to be extended or modified by adding components over time. The monolithic nature of most furniture products makes them difficult to customize to individual preferences and prevents them from being adapted to another purpose. The consumer can neither choose the optimal form for the furnishing at initial purchase, nor modify the furnishing as his or her needs change over time. This invention addresses these shortcomings via a composable and adaptive system for constructing personalized furnishings from simple, reusable components.

Further, this invention defines a system to combine components with high structural strength and rigidity. Use of machine screws as specified enables very high strength and rigid assemblies of reusable components. Machine screws also enable the secure joining of reusable components built of different materials; plastics, woods, metals, glass, and composites can be structurally integrated via standardized machine screws and threaded insert hardware.

Of additional importance, this invention describes a system that can be scaled and extended via the recursive addition of component frames and horizontal panels, or other elements, such as drawers and other storage components. Most other component shelf and furniture systems provide for the adjustment of shelves within a fixed, monolithic frame. This system provides for the addition, removal, or rearrangement of components in a dynamic assembly to define spaces between shelves, the number of shelves, and the overall height and structure of the product. Multiple columns of shelves and frames can be combined horizontally by larger panels to form larger furnishing items such as tables, desks, and credenzas.

SUMMARY OF THE INVENTION

According to an aspect of the present disclosure, a freestanding shelf assembly includes a pair of base frames, a bottom shelf panel, a first pair of support frames, and a plurality of screws. Each base frame has an elongate rail portion extending horizontally between vertical leg portions terminating at a horizontal top portion with a hole therein. The bottom shelf panel has a plurality of holes through its surface and positioned over the pair of base frames such that each hole aligns with a corresponding hole of the base frames. Each support frame has an elongate support portion extending horizontally between vertical leg portions terminating at a horizontal bottom portion having optionally a countersunk hole. Alternately, instead of a countersunk hole, the horizontal bottom portions can have normal clearance holes to accommodate a screw, such as a socket head cap screw or a cap screw. Each screw can optionally have a countersunk head, passes through respective countersunk holes of the first pair of support frames and through respective holes of the bottom shelf panel, and threadably engages respective holes of the base frames, to form the freestanding shelf assembly. Alternately, when the screw does not have a countersunk head, such as a socket head cap screw, each screw passes through the clearance holes of the support frames, through the respective holes of the bottom shelf panel, and threadably engages respective holes of the base frames.

According to another aspect of the present disclosure, a freestanding shelf assembly includes a pair of base frames, a bottom shelf panel, a first pair of support frames, and a plurality of screws. Each of the base frames has an elongate rail portion extending horizontally between vertical base leg portions and has two tapped or threaded base holes near each of the vertical base leg portions, each of the vertical base leg portions terminating at a horizontal bottom base portion. The bottom shelf panel has a plurality of bottom holes through its surface and positioned over the pair of base frames such that each of the plurality of bottom holes aligns with a corresponding one of the tapped or threaded base holes of the base frames. Each of the first pair of support frames has an elongate support portion extending horizontally between vertical support leg portions, each of the vertical support leg portions terminating at a horizontal bottom support portion having optionally a countersunk hole therein. Alternately, instead of a countersunk hole, the horizontal bottom support portions can have normal clearance holes to accommodate a screw, such as a socket head cap screw or a cap screw. The plurality of screws, each of which can optionally have a countersunk head, passes through respective ones of the countersunk holes of the first pair of support frames and through respective ones of the plurality of bottom holes of the bottom shelf panel, and threadably engages respective ones of the tapped or threaded base holes of the pair of base frames, to form thereby the freestanding shelf assembly. Alternately, when the screw does not have a countersunk head, such as a socket head cap screw, each screw passes through the clearance holes of the first pair of support frames, through the respective holes of the bottom shelf panel, and threadably engages respective tapped or threaded base holes of the base frames.

According to yet another aspect of the present disclosure, a method is directed to assembling a freestanding shelf assembly having a pair of base frames, a bottom shelf panel, a first pair of support frames, and a plurality of screws. Each of the pair of base frames has an elongate rail portion extending horizontally between vertical base leg portions, and each of the vertical base leg portions terminates at a horizontal top portion having a tapped or threaded base hole therein. The bottom shelf panel has a plurality of bottom clearance holes through its surface, and the first pair of support frames has an elongate support portion extending horizontally between vertical support leg portions. Each of the vertical support leg portions terminates at a horizontal bottom portion having a countersunk hole therein, and each of the plurality of screws optionally having a countersunk head. Alternately, instead of a countersunk hole, the horizontal bottom portions can have normal clearance holes to accommodate a screw, such as a socket head cap screw or a cap screw. The method includes positioning the bottom shelf panel over the pair of base frames such that each of the plurality of bottom clearance holes aligns with a corresponding one of the tapped or threaded base holes of the base frames. The method further includes passing each of the plurality of screws through a respective one of the countersunk holes of the first pair of support frames and through respective ones of the plurality of bottom clearance holes of the bottom shelf panel. The method further, yet, includes threadably engaging respective ones of the tapped or threaded base holes of the pair of base frames to form thereby the freestanding shelf assembly.

Additional aspects of the present disclosure will be apparent to those of ordinary skill in the art in view of the detailed description of various embodiments, which is made with reference to the drawings, a brief description of which is provided below.

Figure 1:
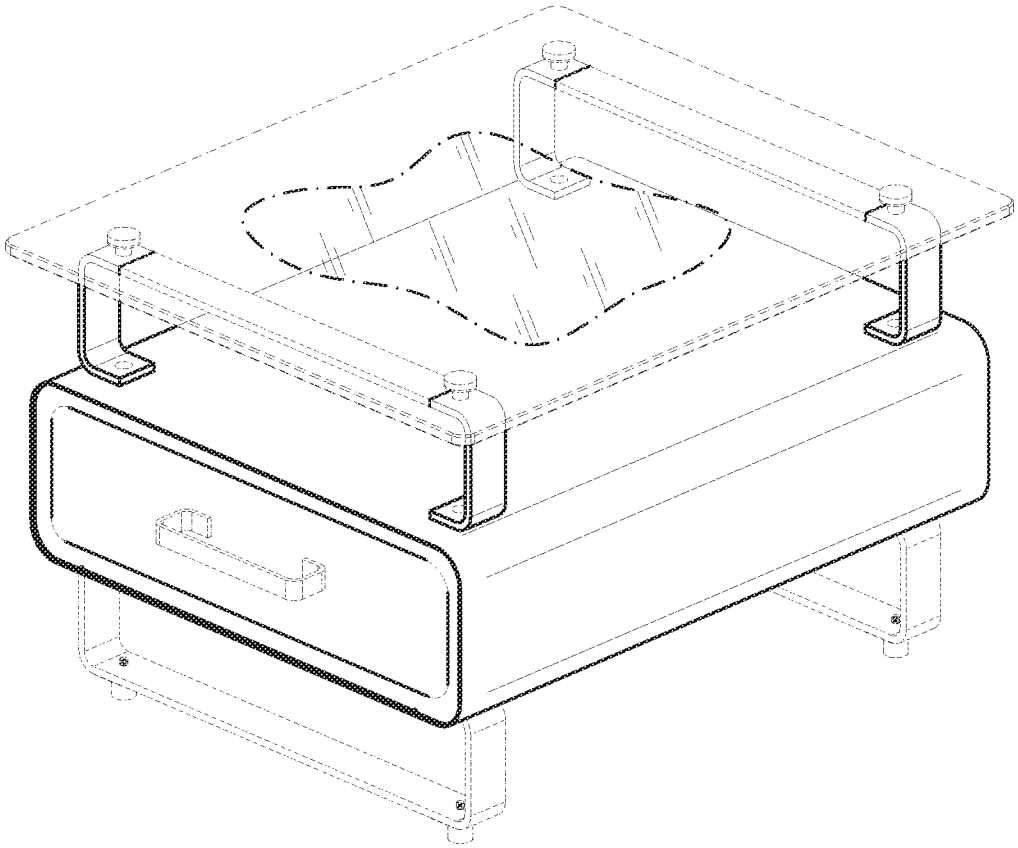
FIG. 1 is a right perspective view of an embodiment of a modular cabinet system.
Figure 2:
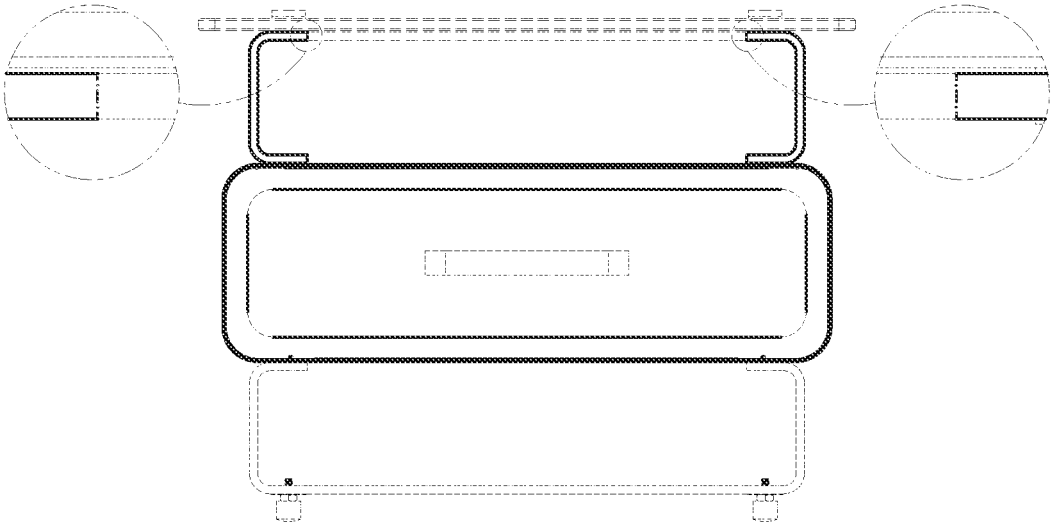
FIG. 2 is a front plan view of the modular cabinet system shown in FIG. 1.
Figure 3:
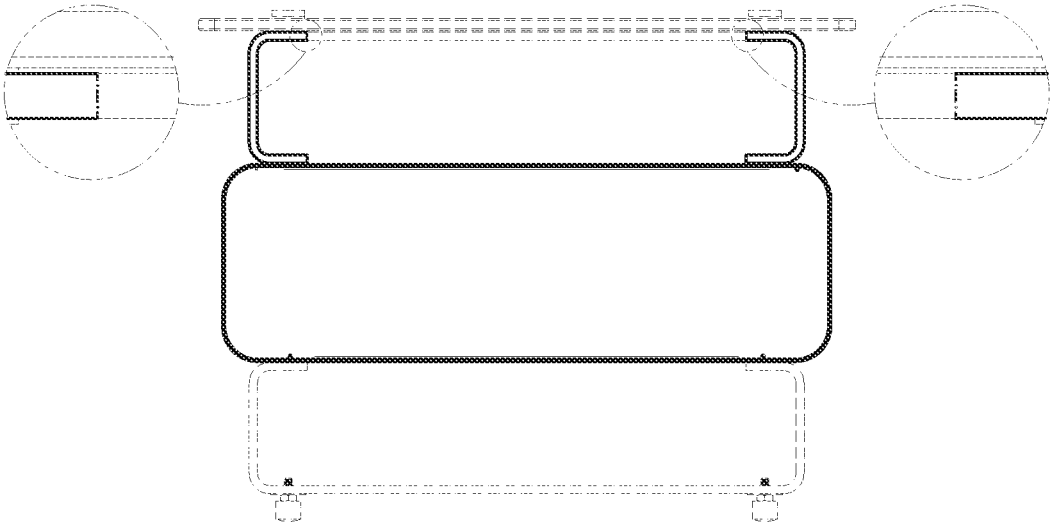
FIG. 3 is a rear plan view of the modular cabinet system shown in FIG. 1.
Figure 4:
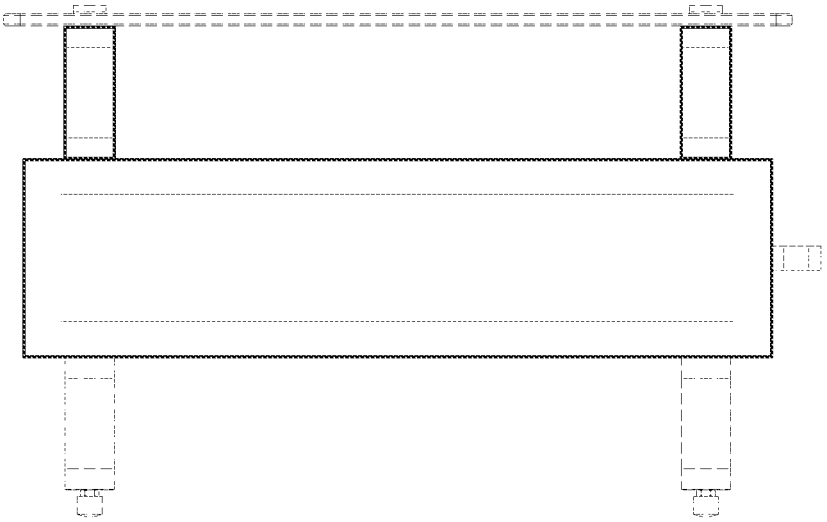
FIG. 4 is a plan view of the left side of the modular cabinet system shown in FIG. 1.
Figure 5:
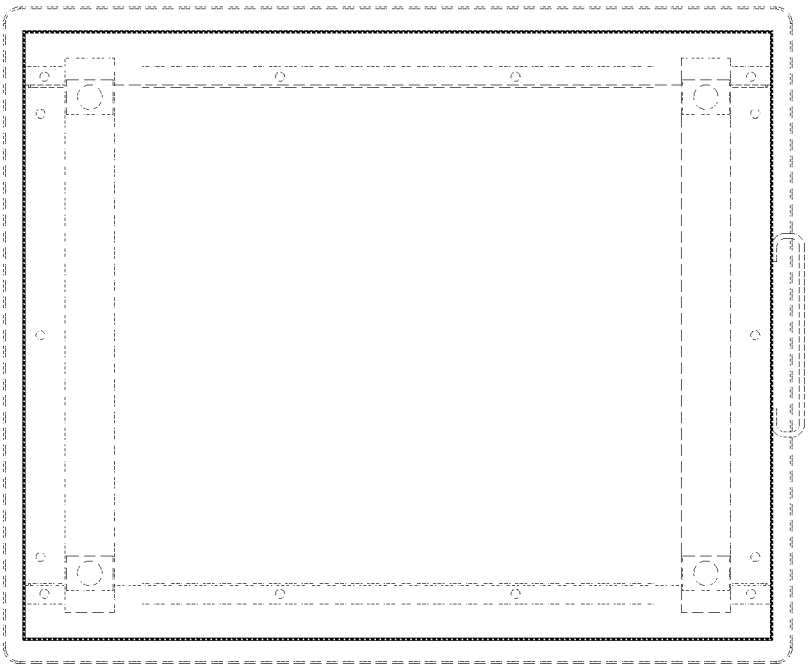
FIG. 5 is a bottom plan view of the modular cabinet system shown in FIG. 1.
Figure 6:
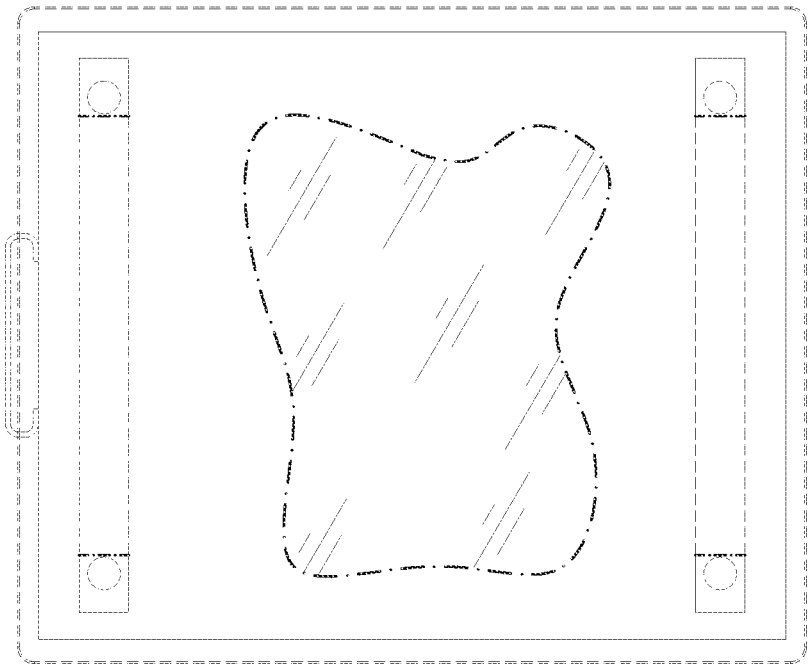
FIG. 6 is a top plan view of the modular cabinet system shown in FIG. 1.
Figure 7:
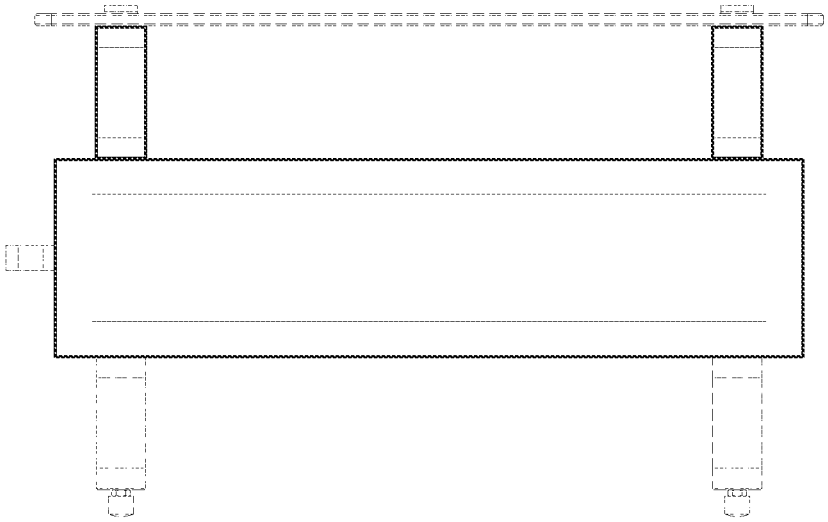
FIG. 7 is a plan view of the right side of the modular cabinet system shown in FIG. 1.
Figure 8:
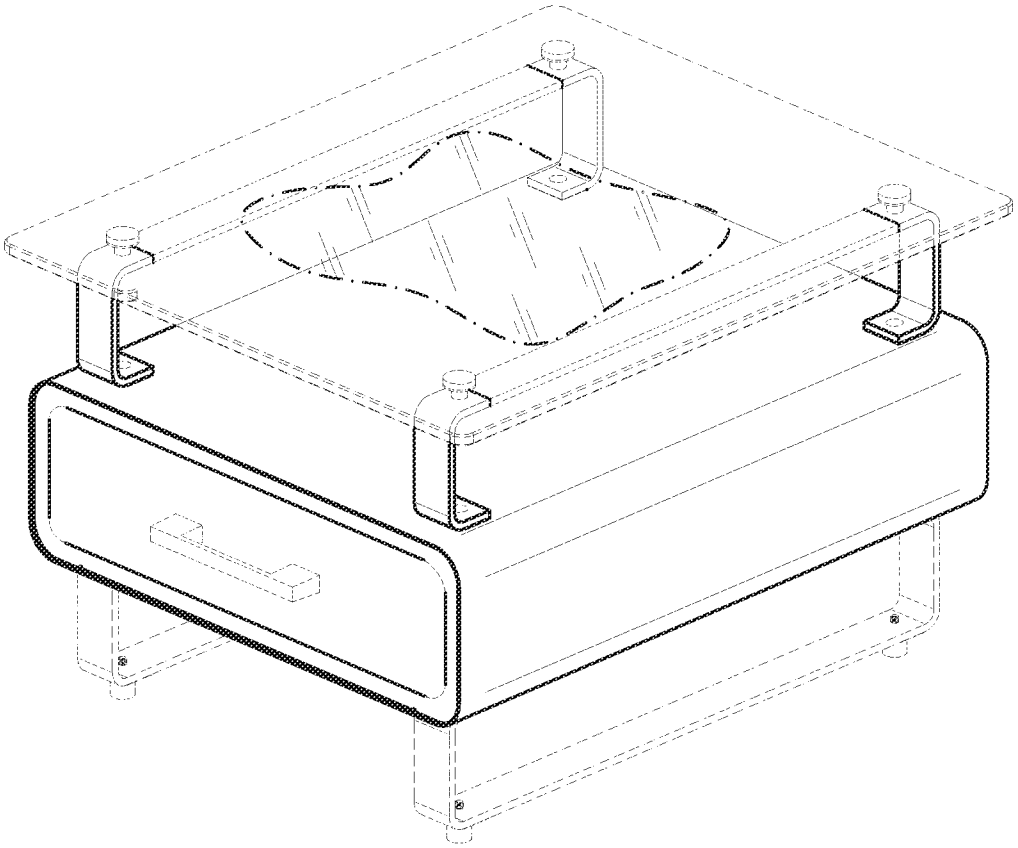
FIG. 8 is a right perspective view of another embodiment of a modular cabinet system.
Figure 9:
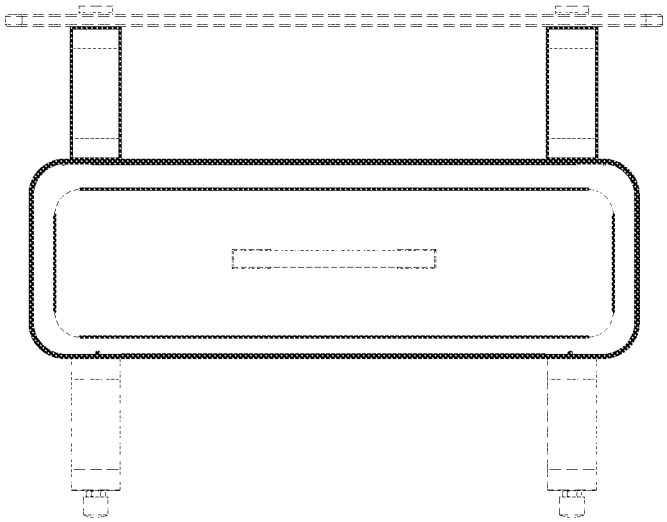
FIG. 9 is a front plan view of the modular cabinet system shown in FIG. 8.
Figure 10:
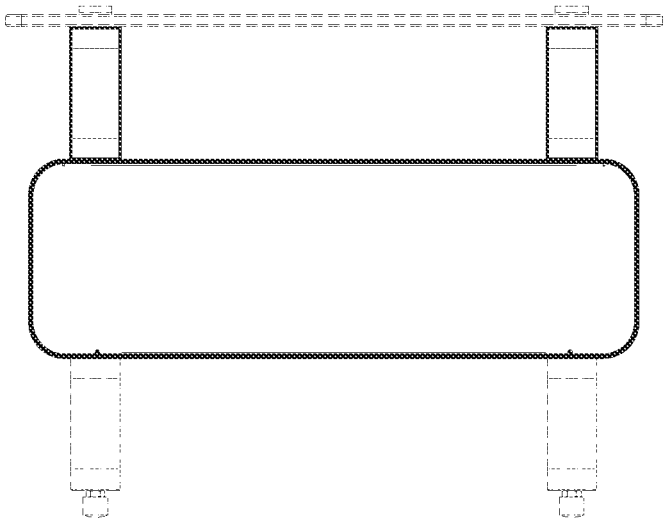
FIG. 10 is a rear plan view of the modular cabinet system shown in FIG. 8.
Figure 11:
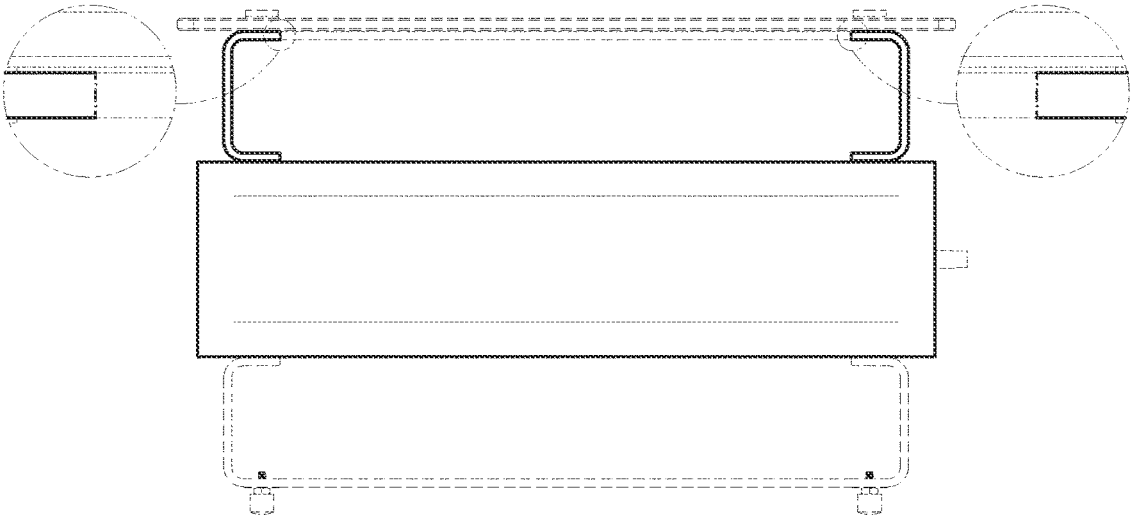
FIG. 11 is a plan view of the left side of the modular cabinet system shown in FIG. 8.
Figure 12:
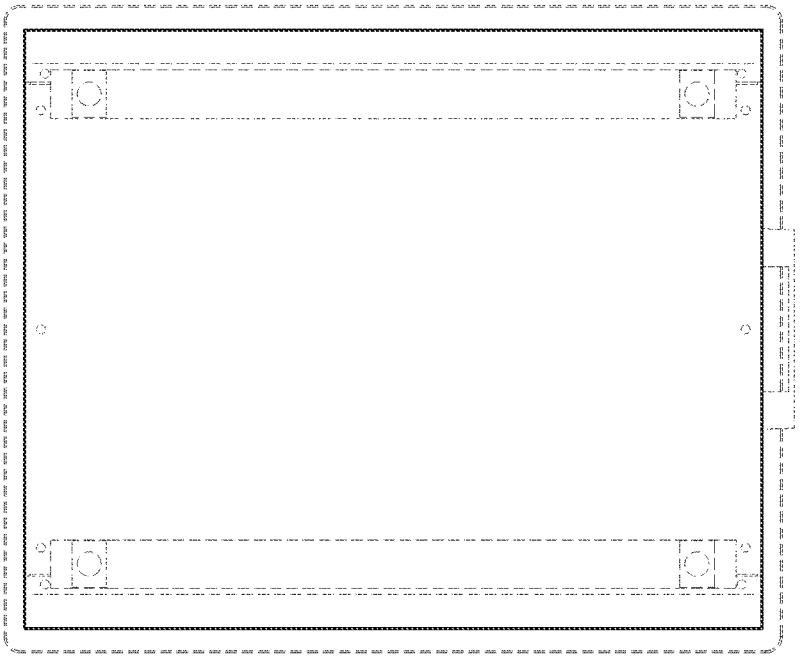
FIG. 12 is a bottom plan view of the modular cabinet system shown in FIG. 8.
Figure 13:
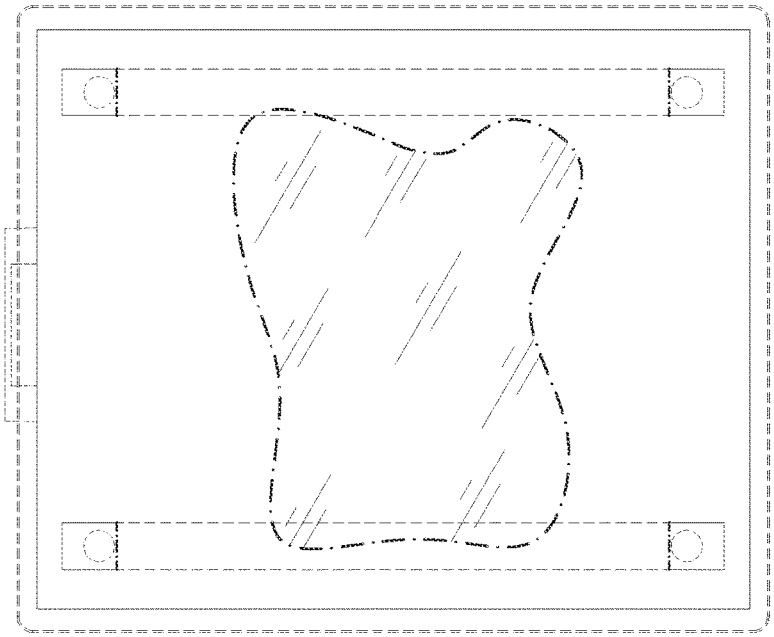
FIG. 13 is a top plan view of the modular cabinet system shown in FIG. 8.
Figure 14:
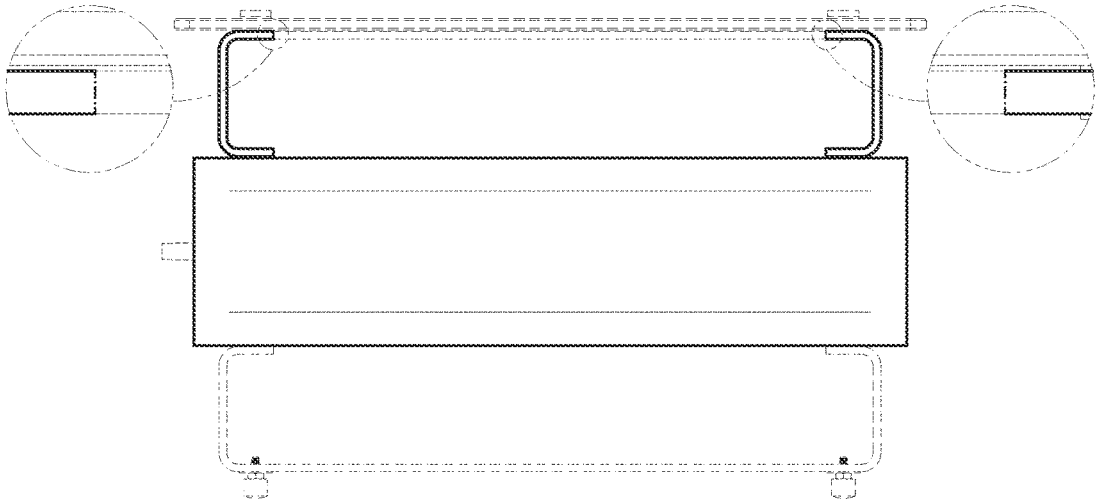
FIG. 14 is a plan view of the right side of the modular cabinet system shown in FIG. 8.
Figure 15:
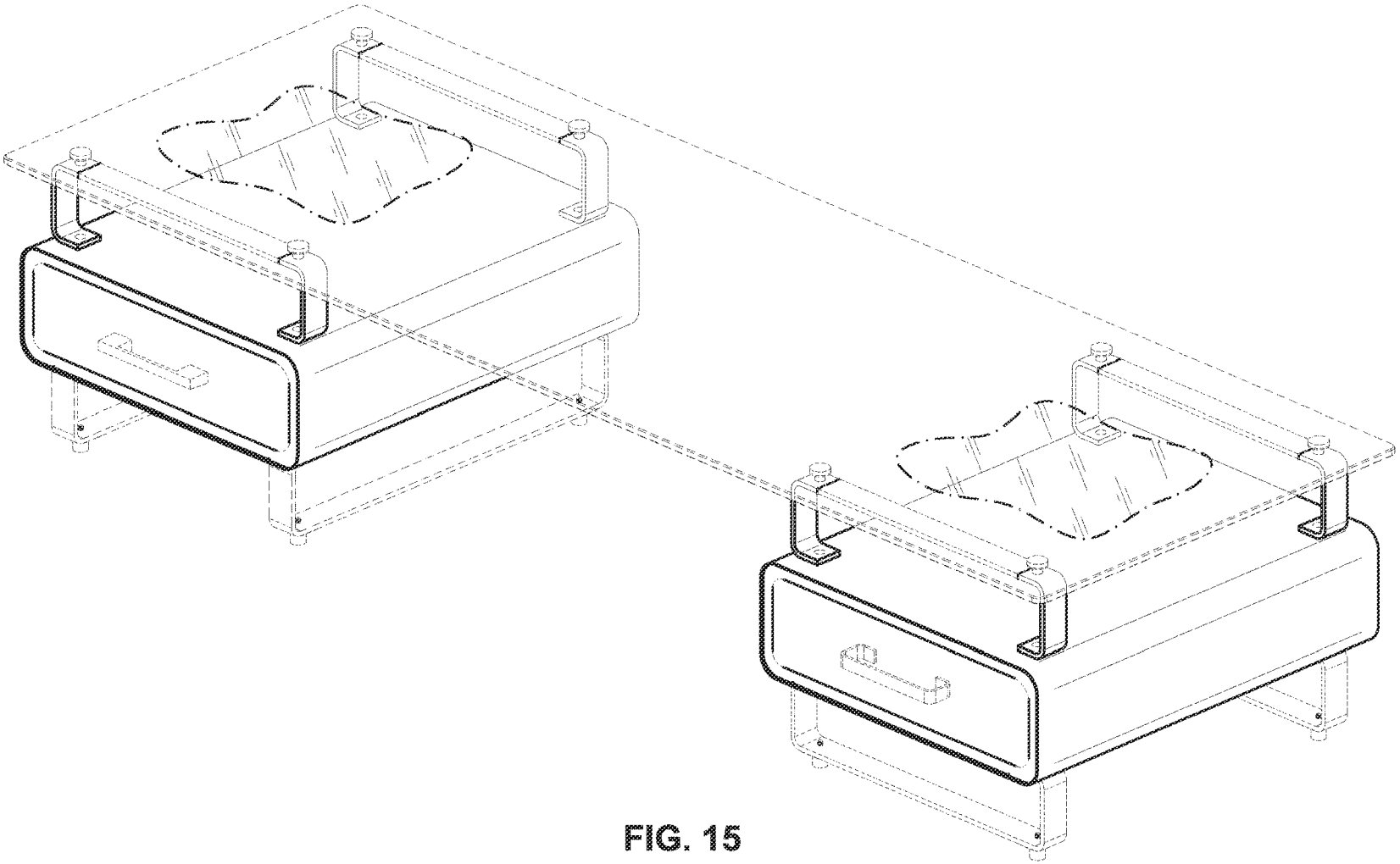
FIG. 15 is a right perspective view of a further embodiment of a modular cabinet system.
Figure 16:
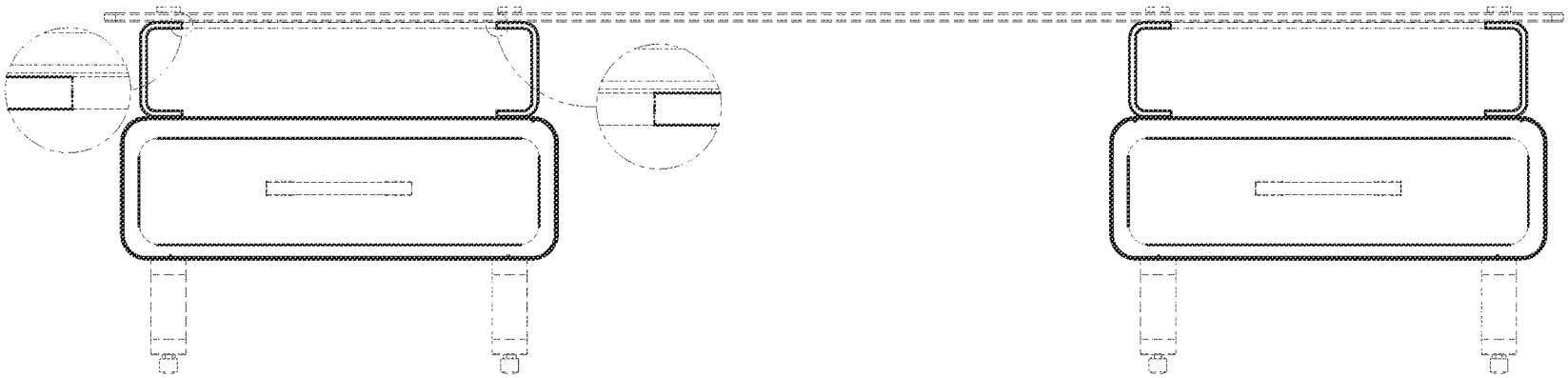
FIG. 16 is a front plan view of the modular cabinet system shown in FIG. 15.
Figure 17:
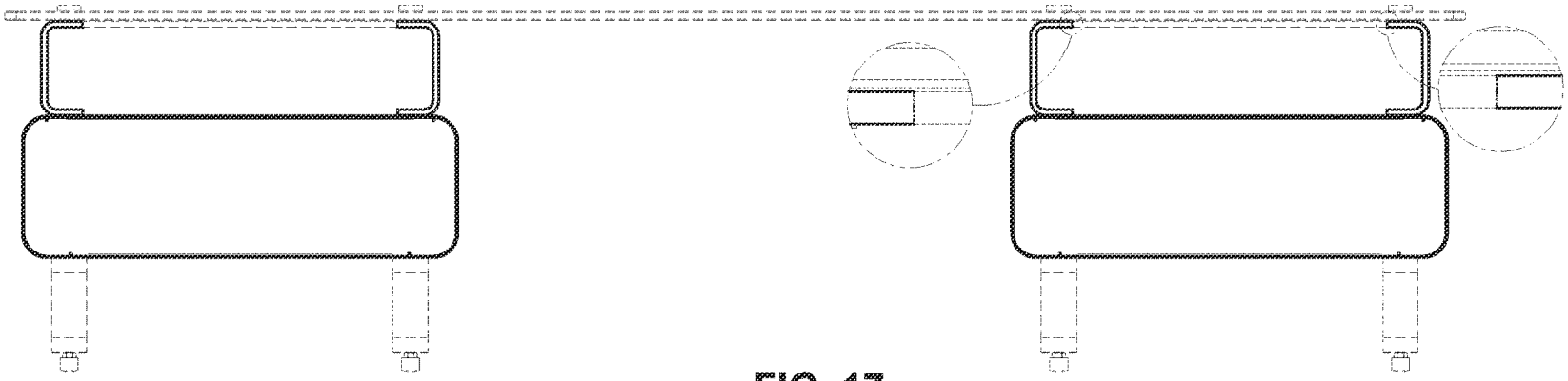
FIG. 17 is a rear plan view of the modular cabinet system shown in FIG. 15.
Figure 18:
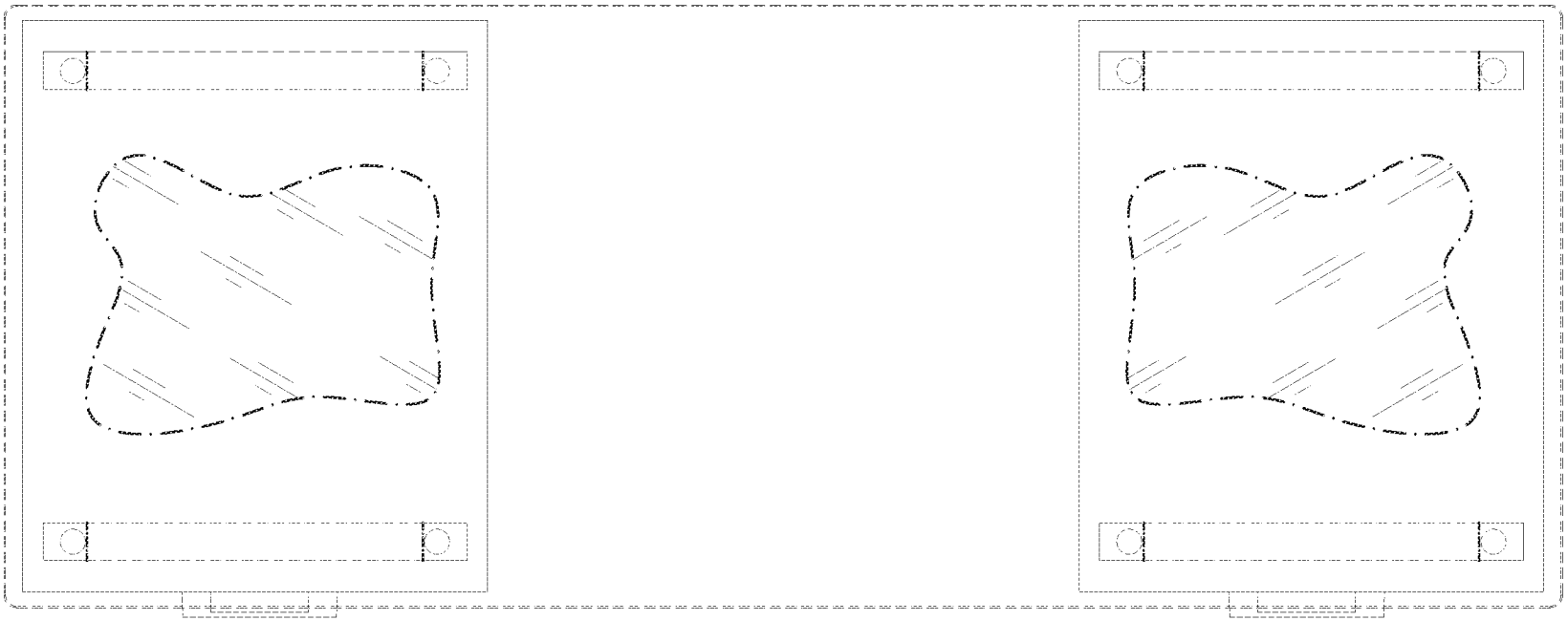
FIG. 18 is a top plan view of the modular cabinet system shown in FIG. 15.
Figure 19:
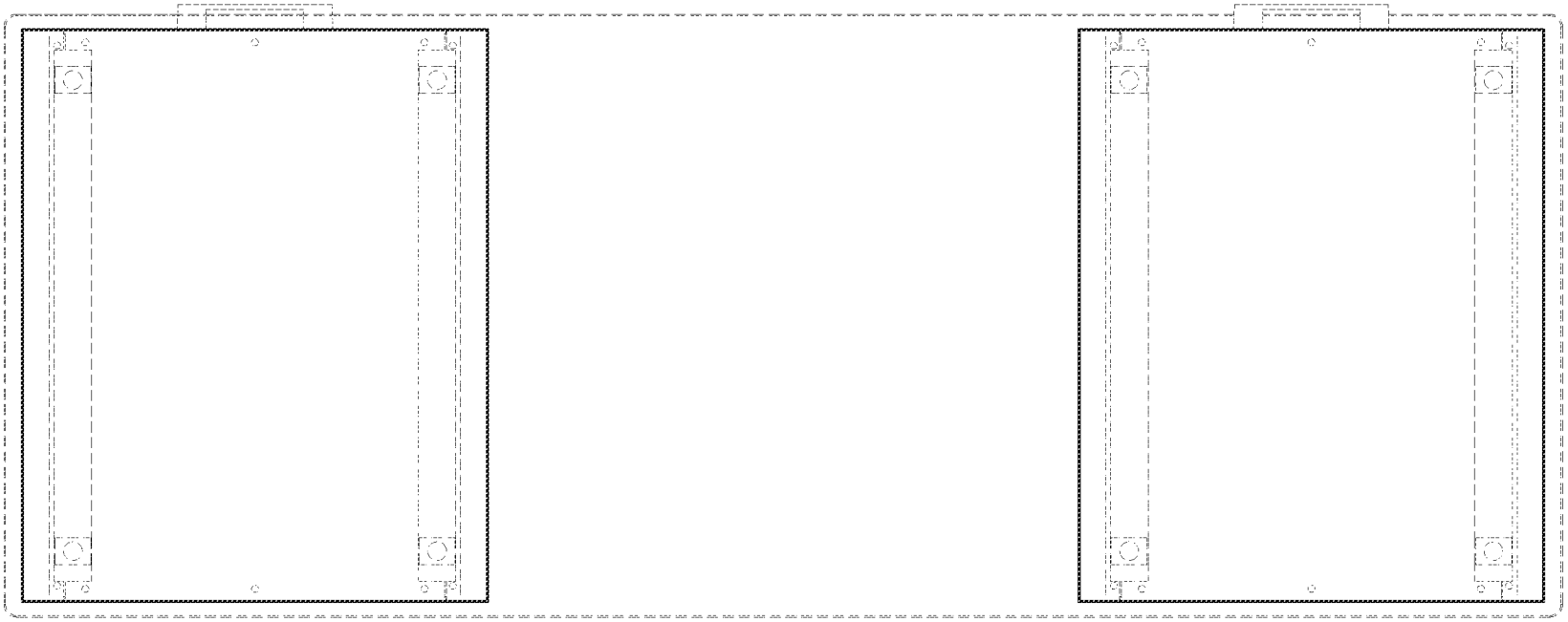
FIG. 19 is a bottom plan view of the modular cabinet system shown in FIG. 15.
Figure 20:
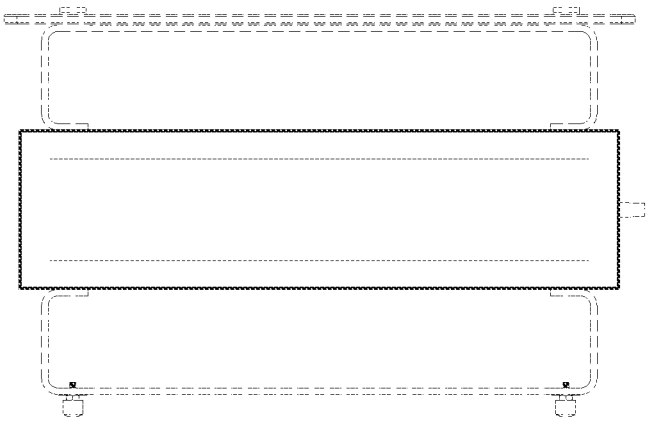
FIG. 20 is a plan view of the left side of the modular cabinet system shown in FIG. 15.
Figure 21:
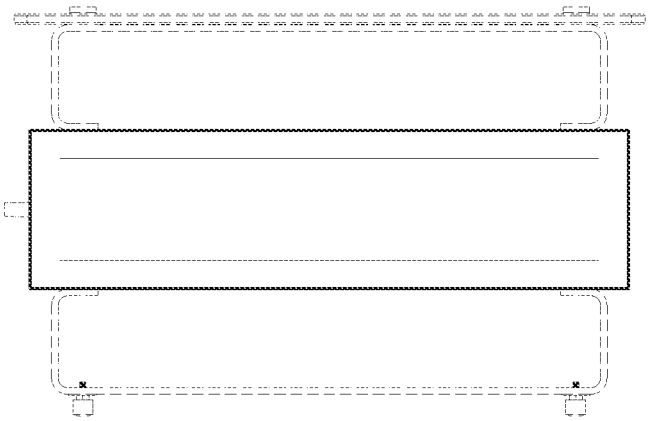
FIG. 21 is a plan view of the right side of the modular cabinet shown in FIG. 15.
Figure 22:
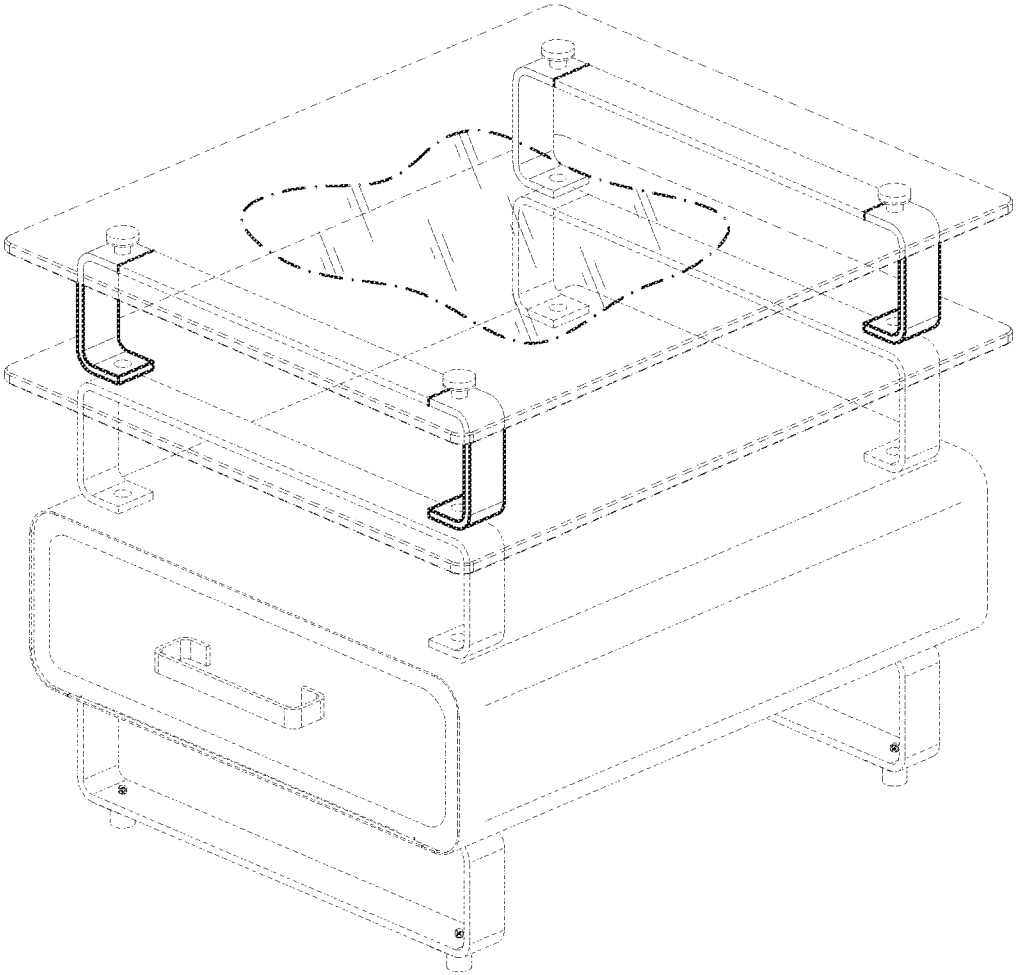
FIG. 22 is a right perspective view of a still further embodiment of a modular cabinet system.
Figure 23:
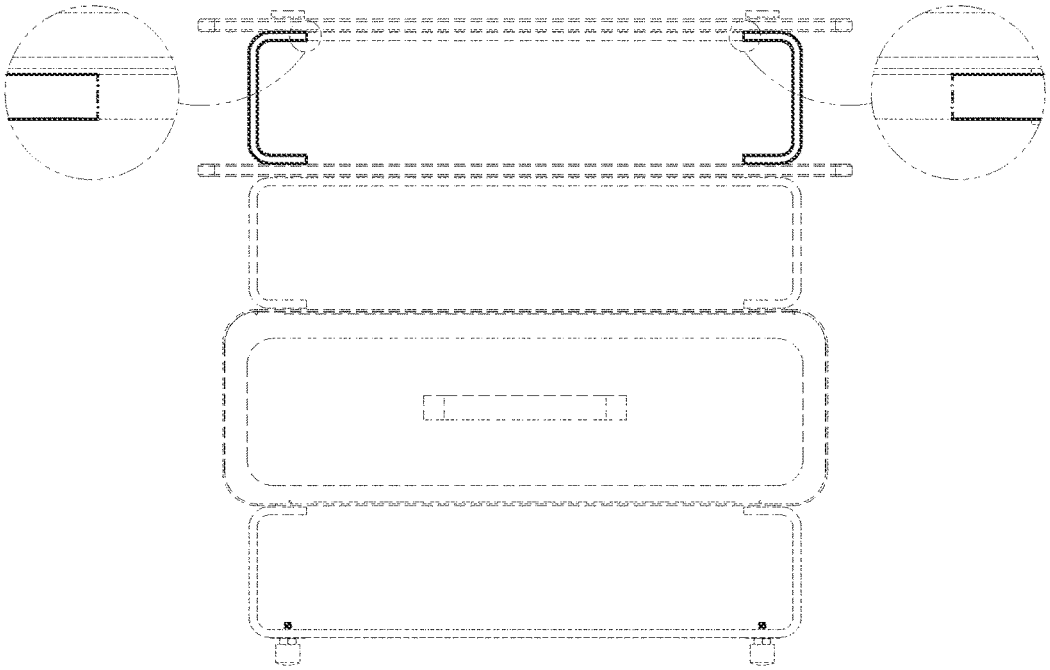
FIG. 23 is a front plan view of the modular cabinet system shown in FIG. 22.
Figure 24:
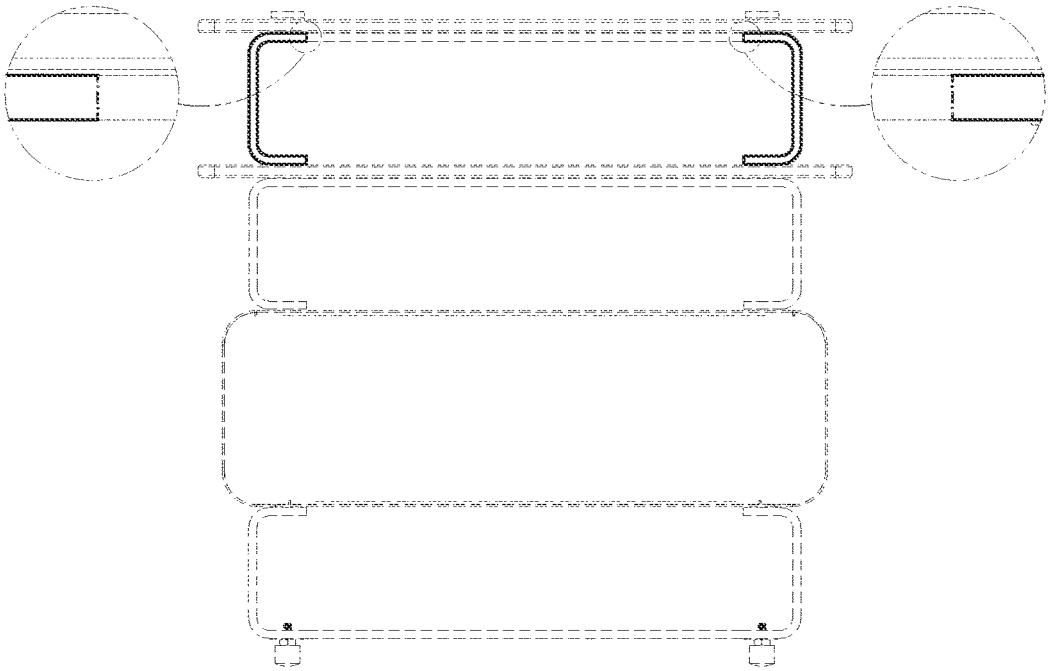
FIG. 24 is a rear plan view of the modular cabinet system shown in FIG. 22.
Figure 25:
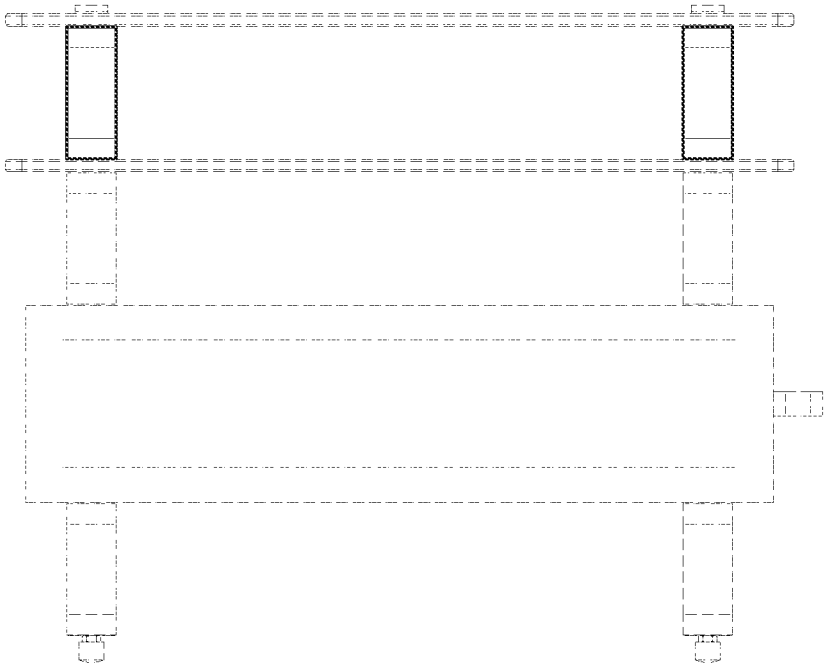
FIG. 25 is a plan view of the left side of the modular cabinet system shown in FIG. 22.
Figure 26:
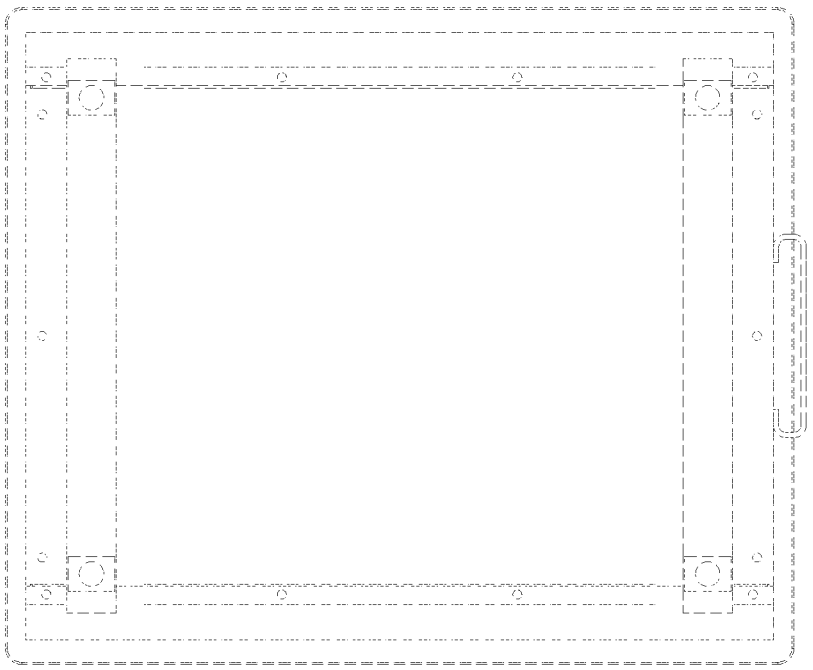
FIG. 26 is a bottom plan view of the modular cabinet system shown in FIG. 22.
Figure 27:
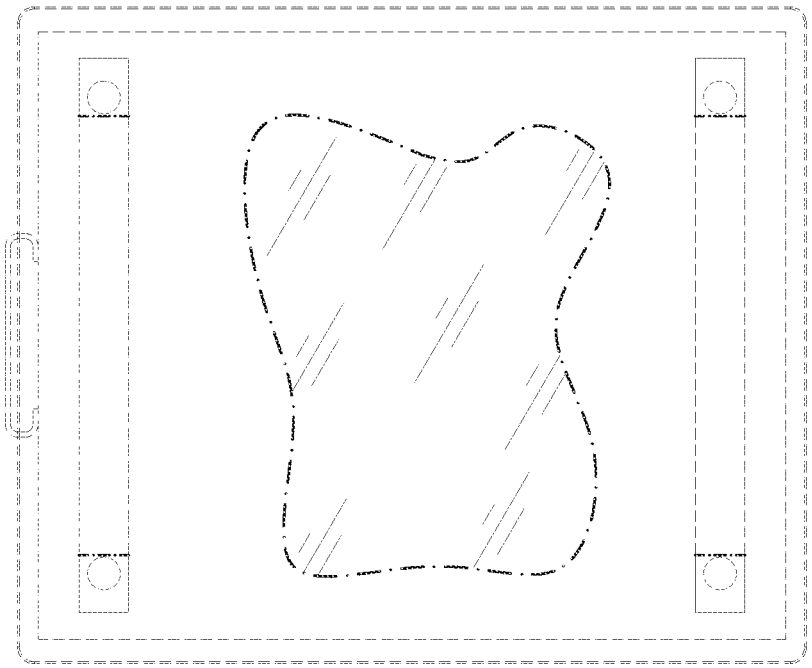
FIG. 27 is a top plan view of the modular cabinet system shown in FIG. 22.
Figure 28:
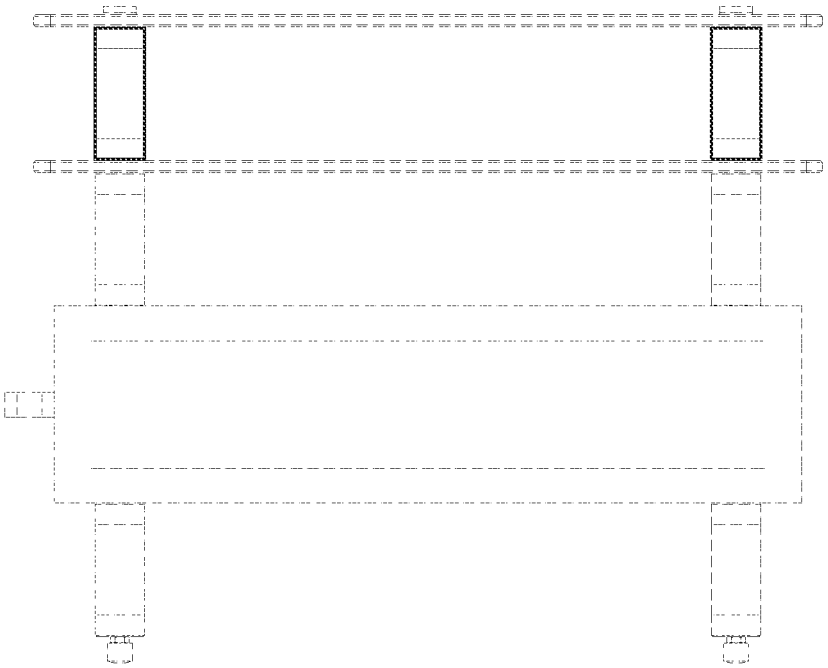
FIG. 28 is a plan view of the right side of the modular cabinet system shown in FIG. 22.
Figure 29:
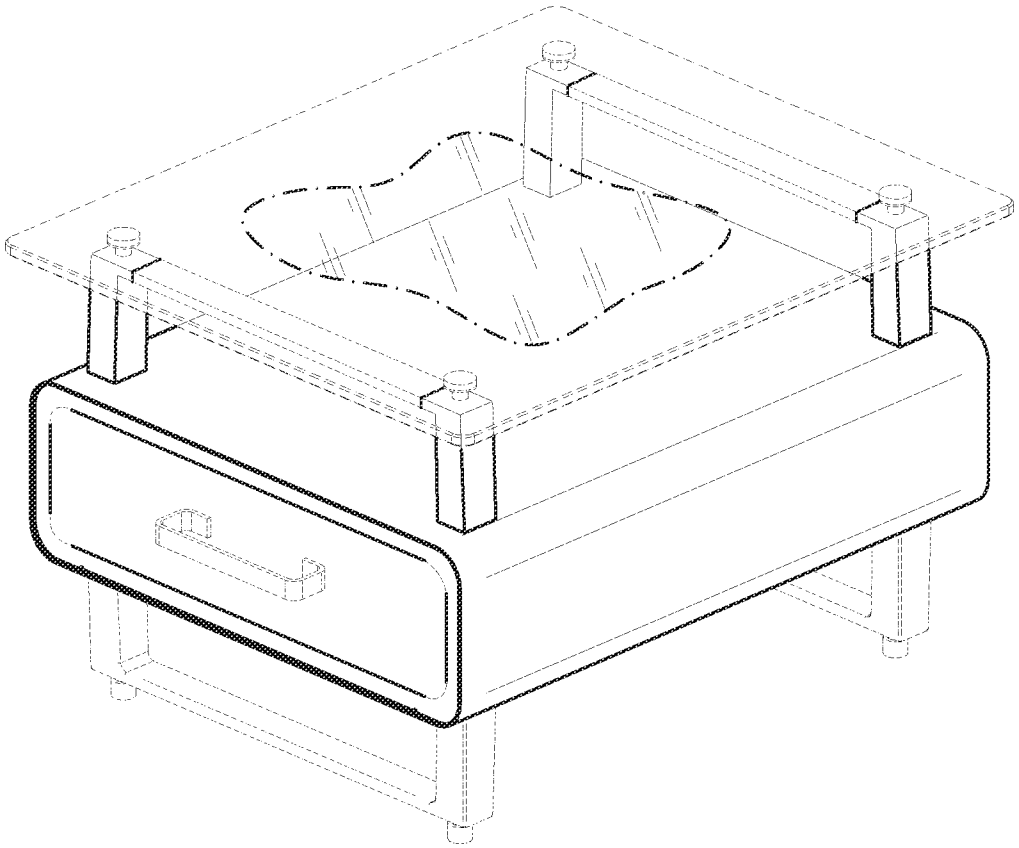
FIG. 29 is a right perspective view of a yet another embodiment of a modular cabinet system.
Figure 30:
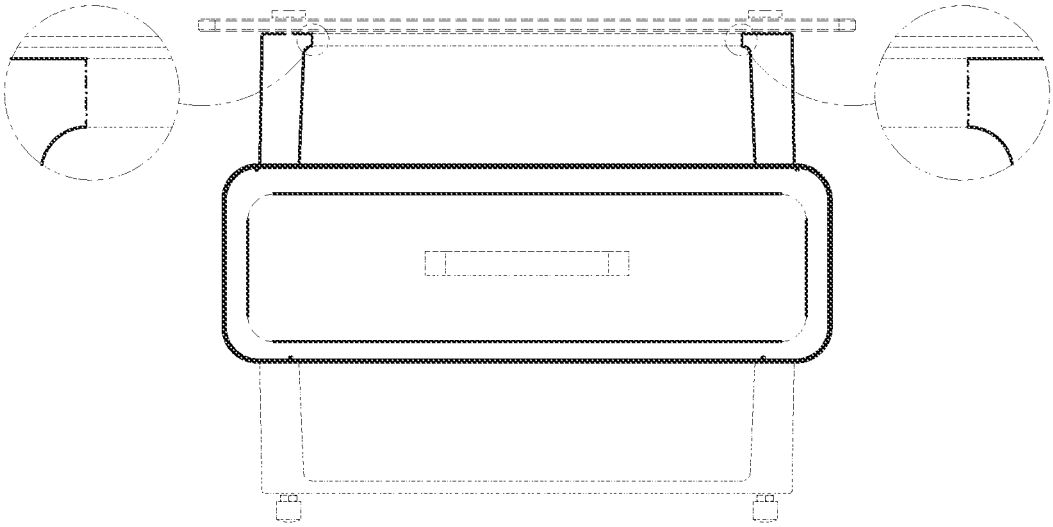
FIG. 30 is a front plan view of the modular cabinet system shown in FIG. 29.
Figure 31:
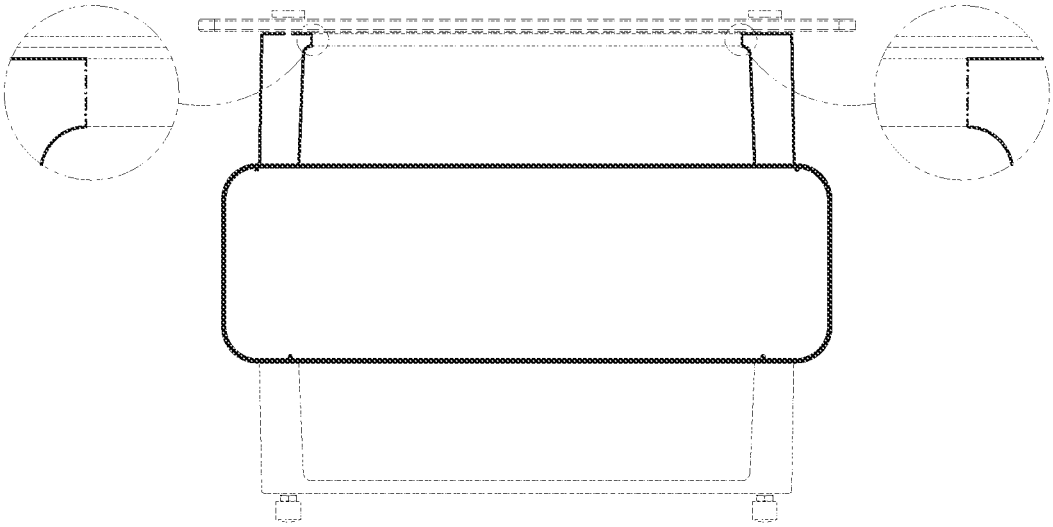
FIG. 31 is a rear plan view of the modular cabinet system shown in FIG. 29.
Figure 32:
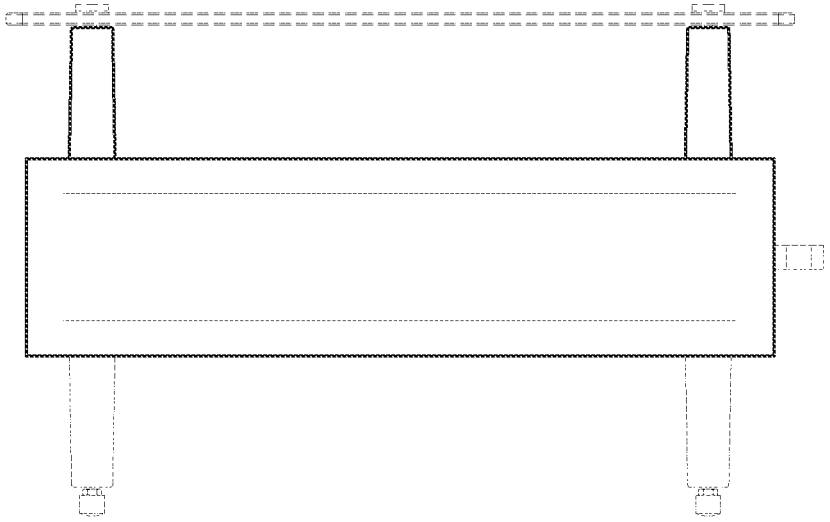
FIG. 32 is a plan view of the left side of the modular cabinet system shown in FIG. 29.
Figure 33:
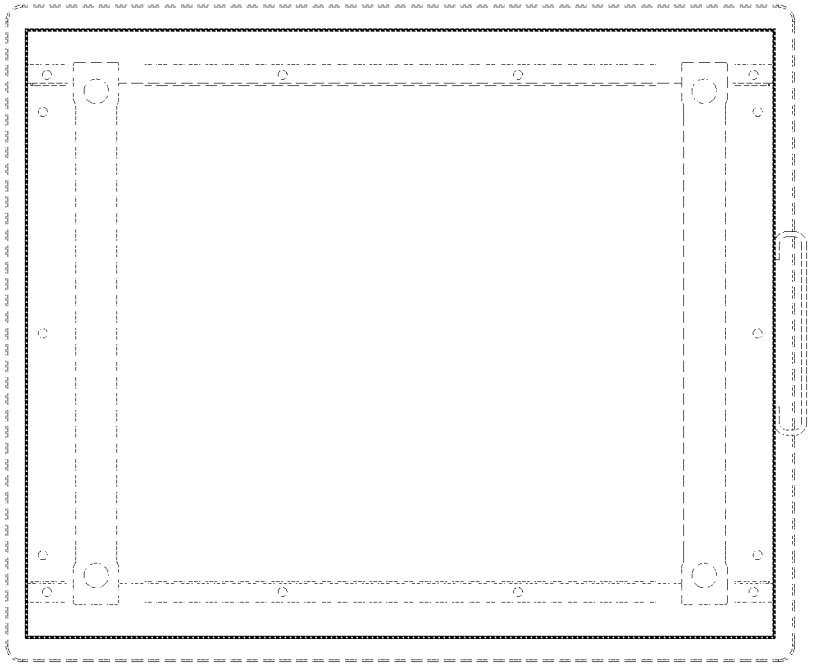
FIG. 33 is a bottom plan view of the modular cabinet system shown in FIG. 29.
Figure 34:
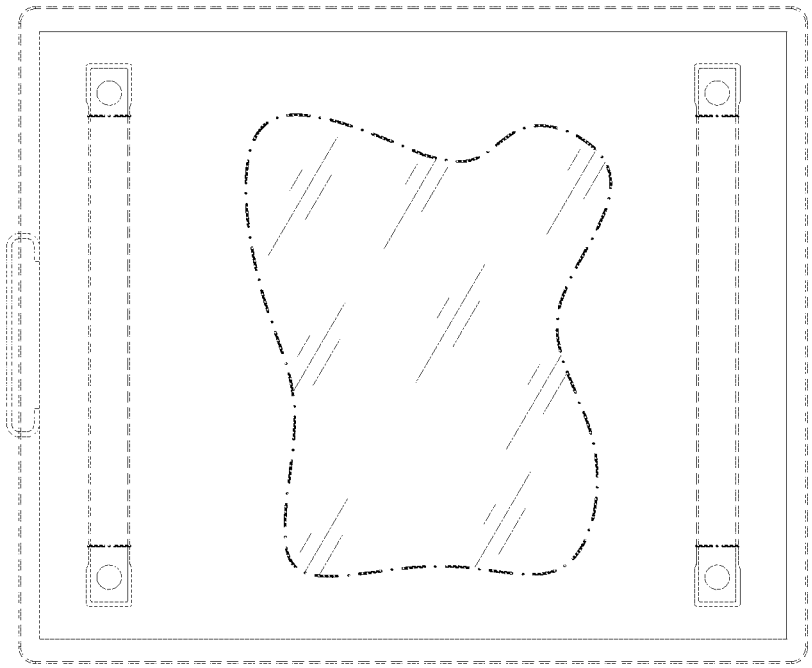
FIG. 34 is a top plan view of the modular cabinet system shown in FIG. 29.
Figure 35:
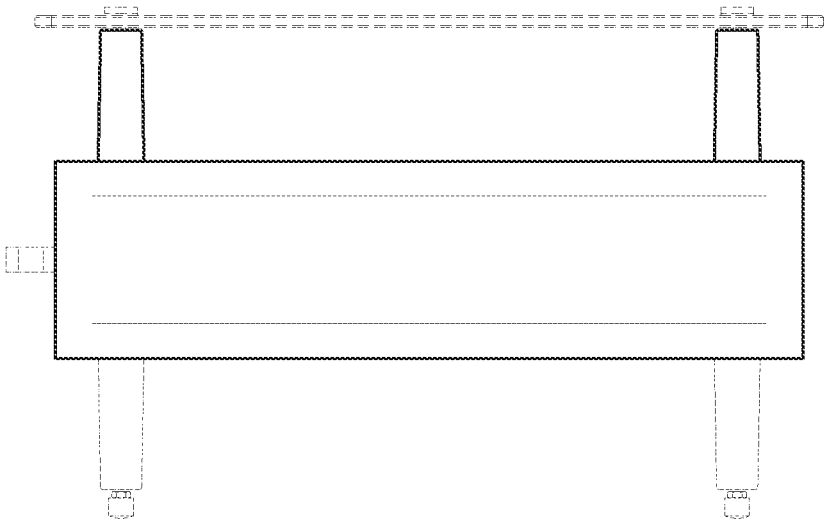
FIG. 35 is a plan view of the right side of the modular cabinet system shown in FIG. 29.
Figure 36:
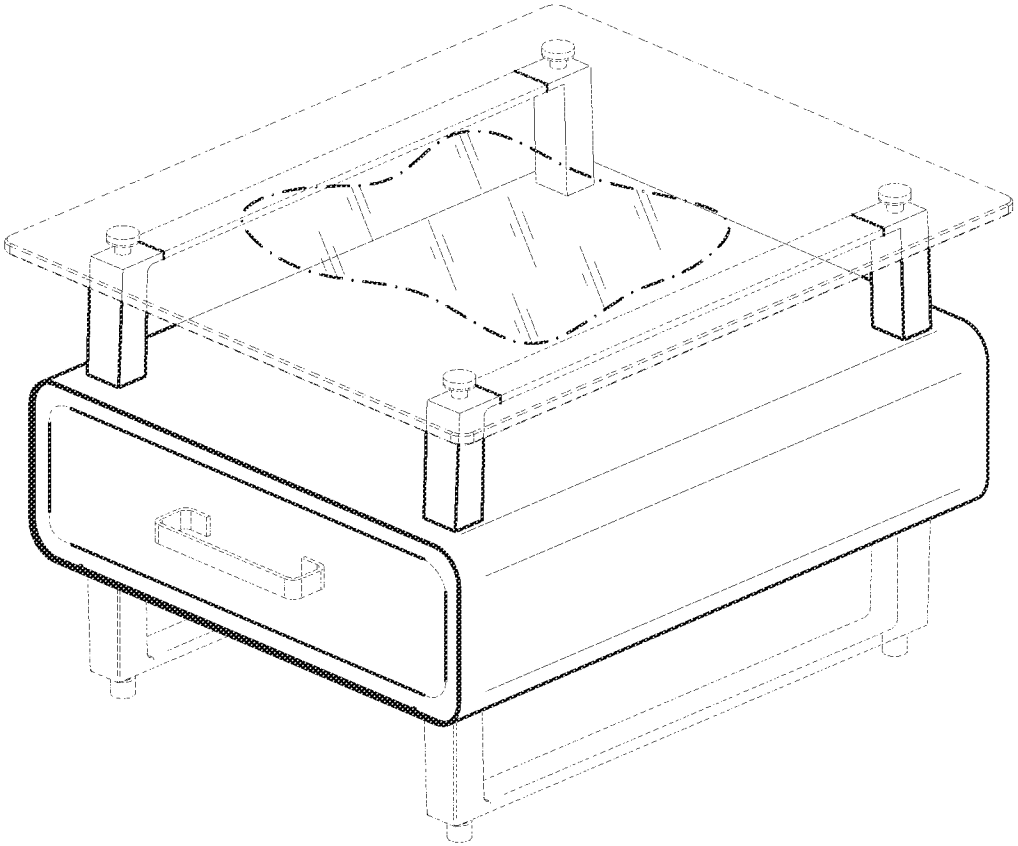
FIG. 36 is a right perspective view of a still another embodiment of a modular cabinet system.
Figure 37:
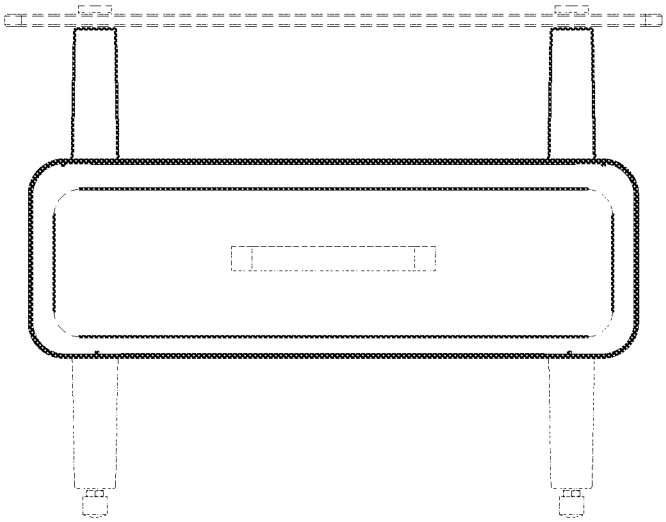
FIG. 37 is a front plan view of the modular cabinet system shown in FIG. 36.
Figure 38:
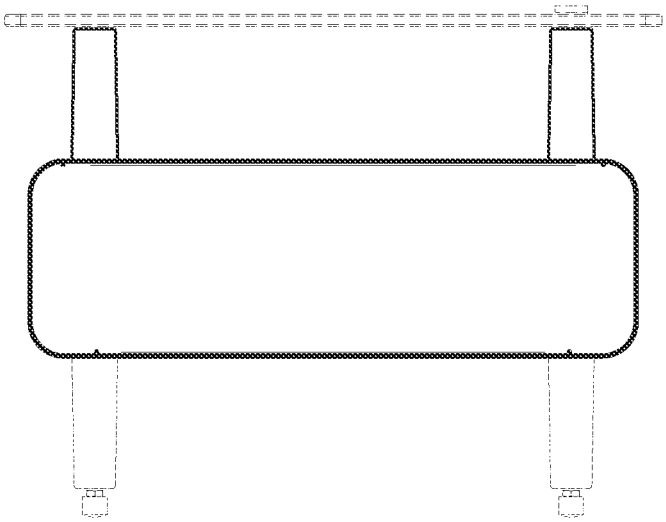
FIG. 38 is a rear plan view of the modular cabinet system shown in FIG. 36.
Figure 39:
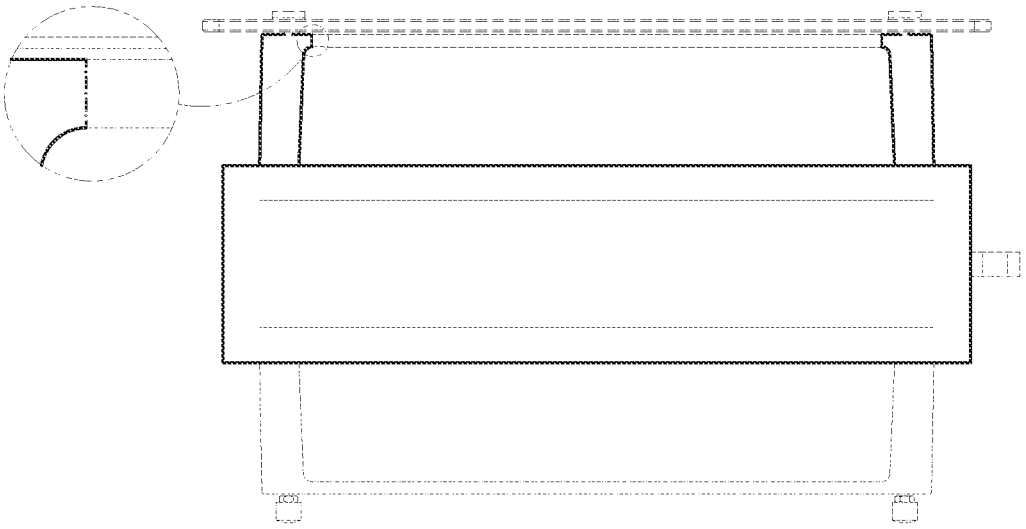
FIG. 39 is a plan view of the left side of the modular cabinet system shown in FIG. 36.
Figure 40:
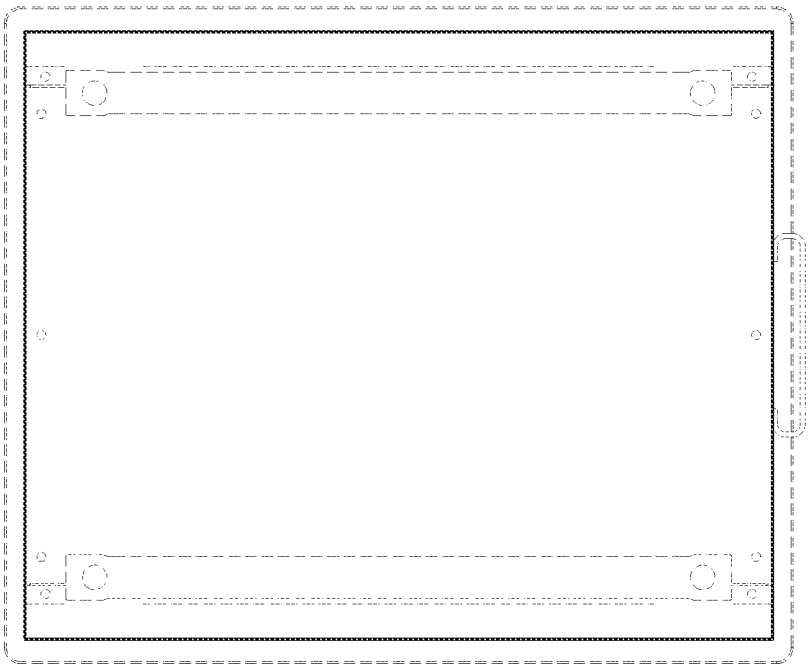
FIG. 40 is a bottom plan view of the modular cabinet system shown in FIG. 36.
Figure 41:
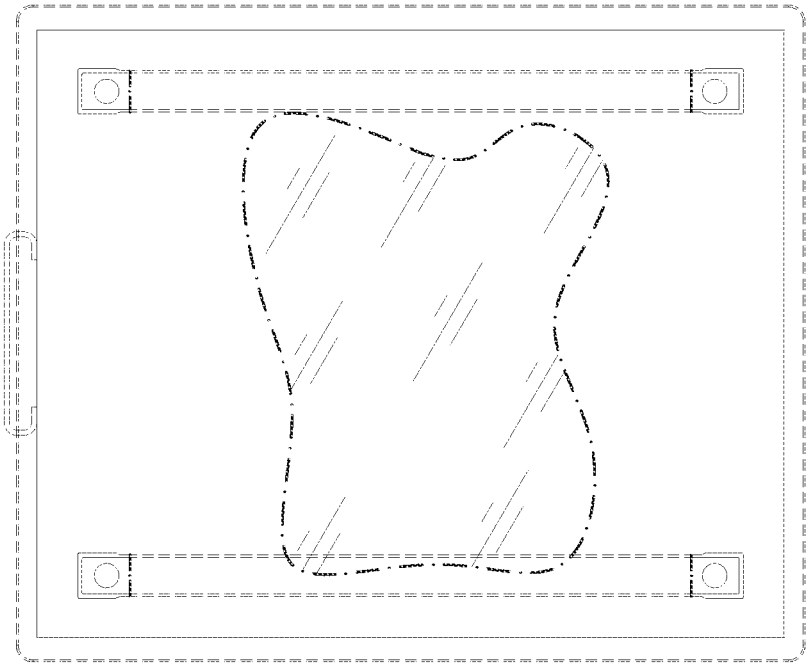
FIG. 41 is a top plan view of the modular cabinet system shown in FIG. 36.
Figure 42:
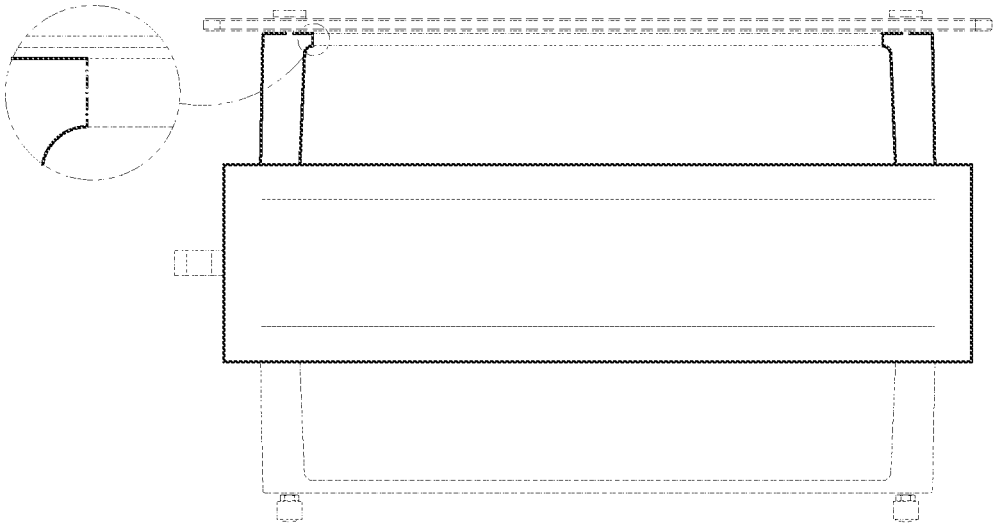
FIG. 42 is a plan view of the right side of the modular cabinet system shown in FIG. 36.
Figure 43:
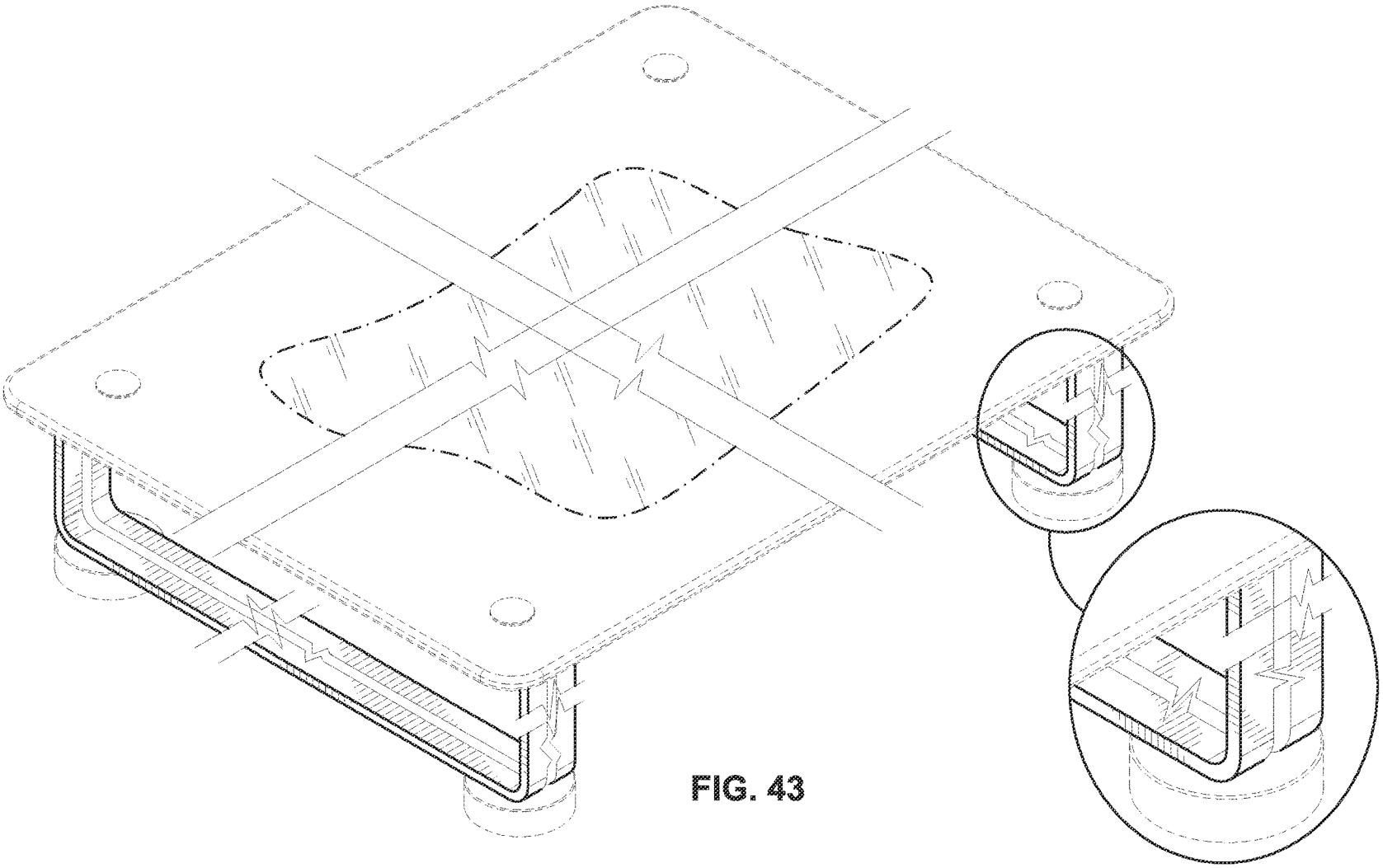
FIG. 43 is a top front-right perspective view of an embodiment of a reconfigurable shelf assembly.
Figure 44:
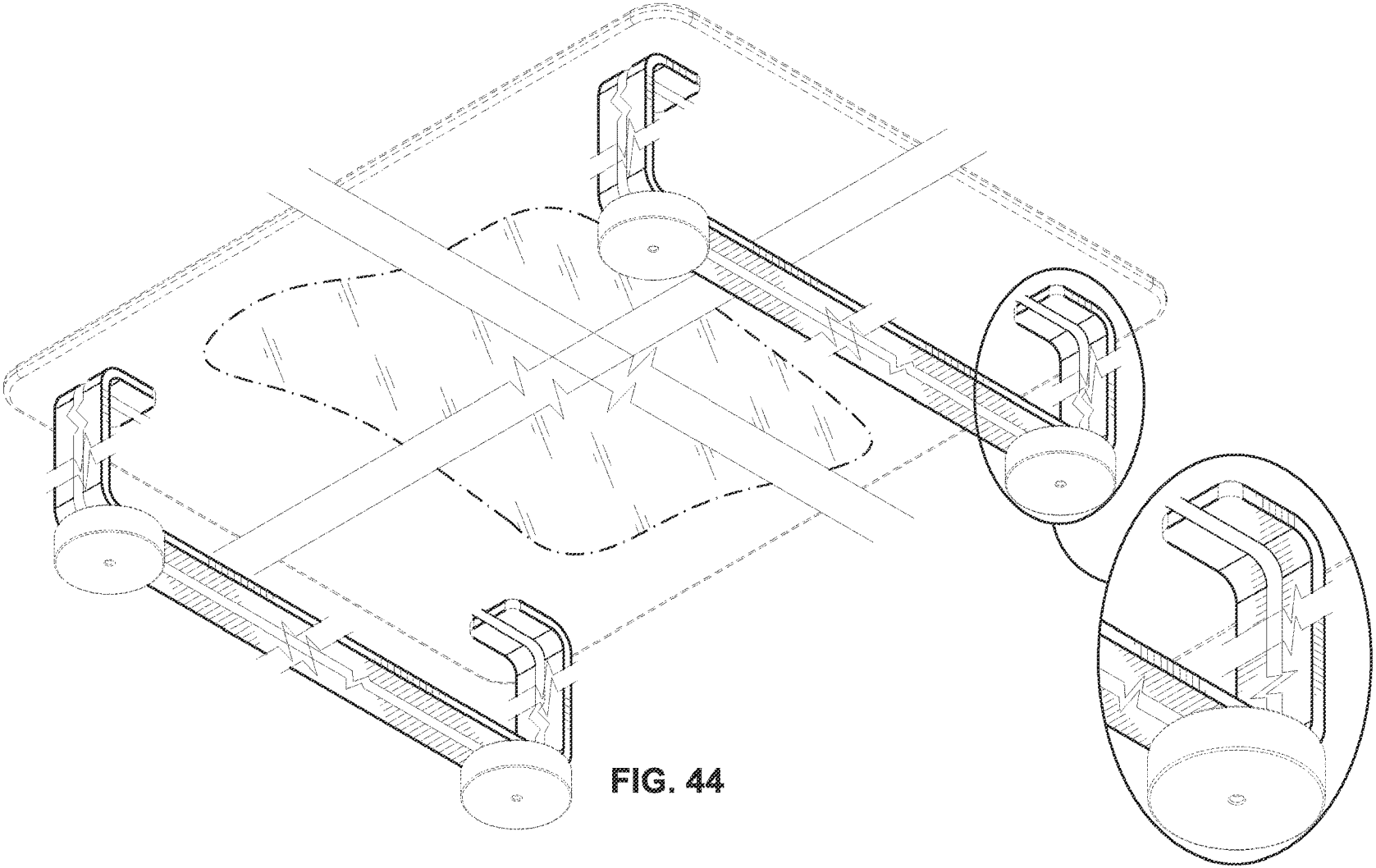
FIG. 44 is a bottom left-front perspective view of the reconfigurable shelf assembly shown in FIG. 43.
Figure 45:
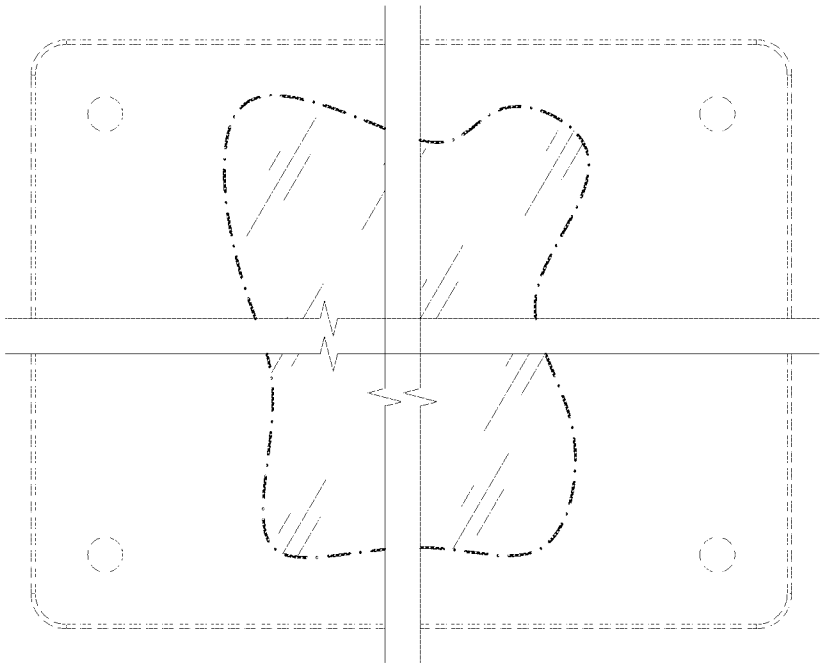
FIG. 45 is a top view of the reconfigurable shelf assembly shown in FIG. 43.
Figure 46:
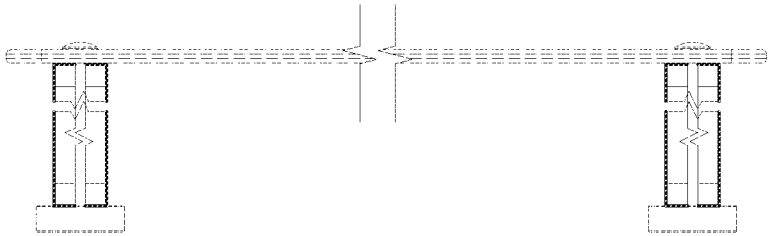
FIG. 46 is a left view of the reconfigurable shelf assembly shown in FIG. 43.
Figure 47:
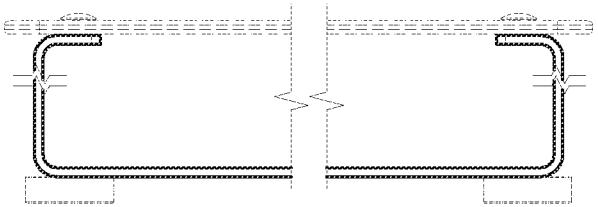
FIG. 47 is a front view of the reconfigurable shelf assembly shown in FIG. 43.
Figure 49:
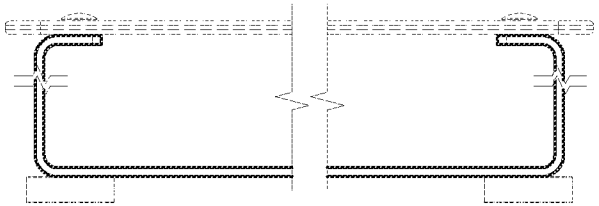
FIG. 49 is a back view of the reconfigurable shelf assembly shown in FIG. 43.
Figure 48:
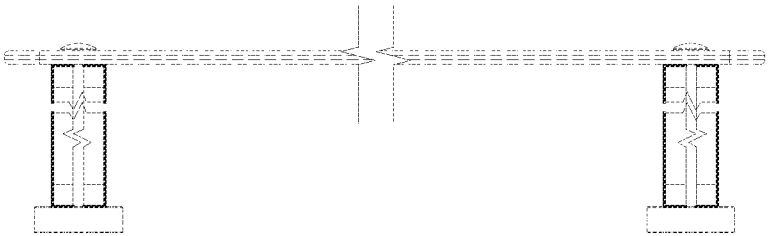
FIG. 48 is a right view of the reconfigurable shelf assembly shown in FIG. 43.
Figure 50:
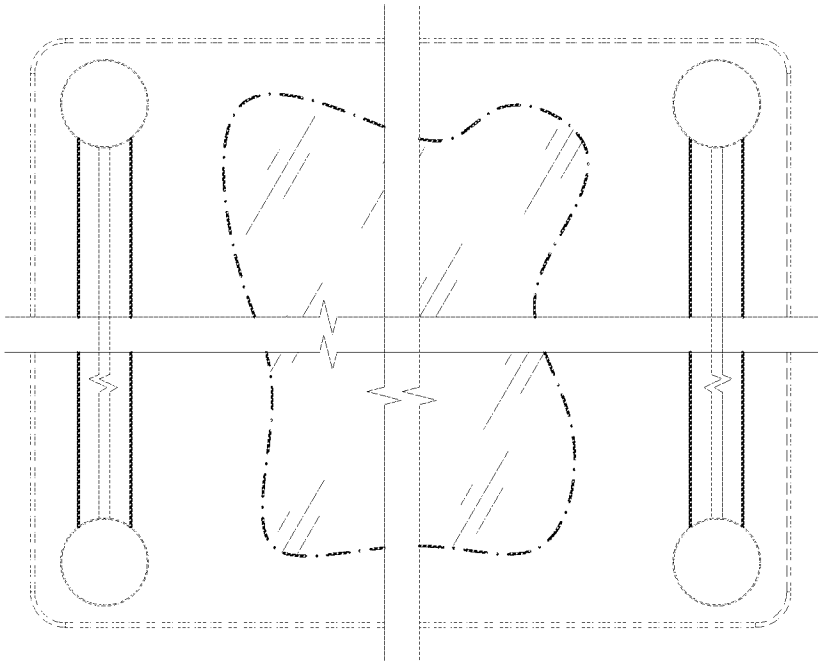
FIG. 50 is a bottom view of the reconfigurable shelf assembly shown in FIG. 43.
Figure 51:
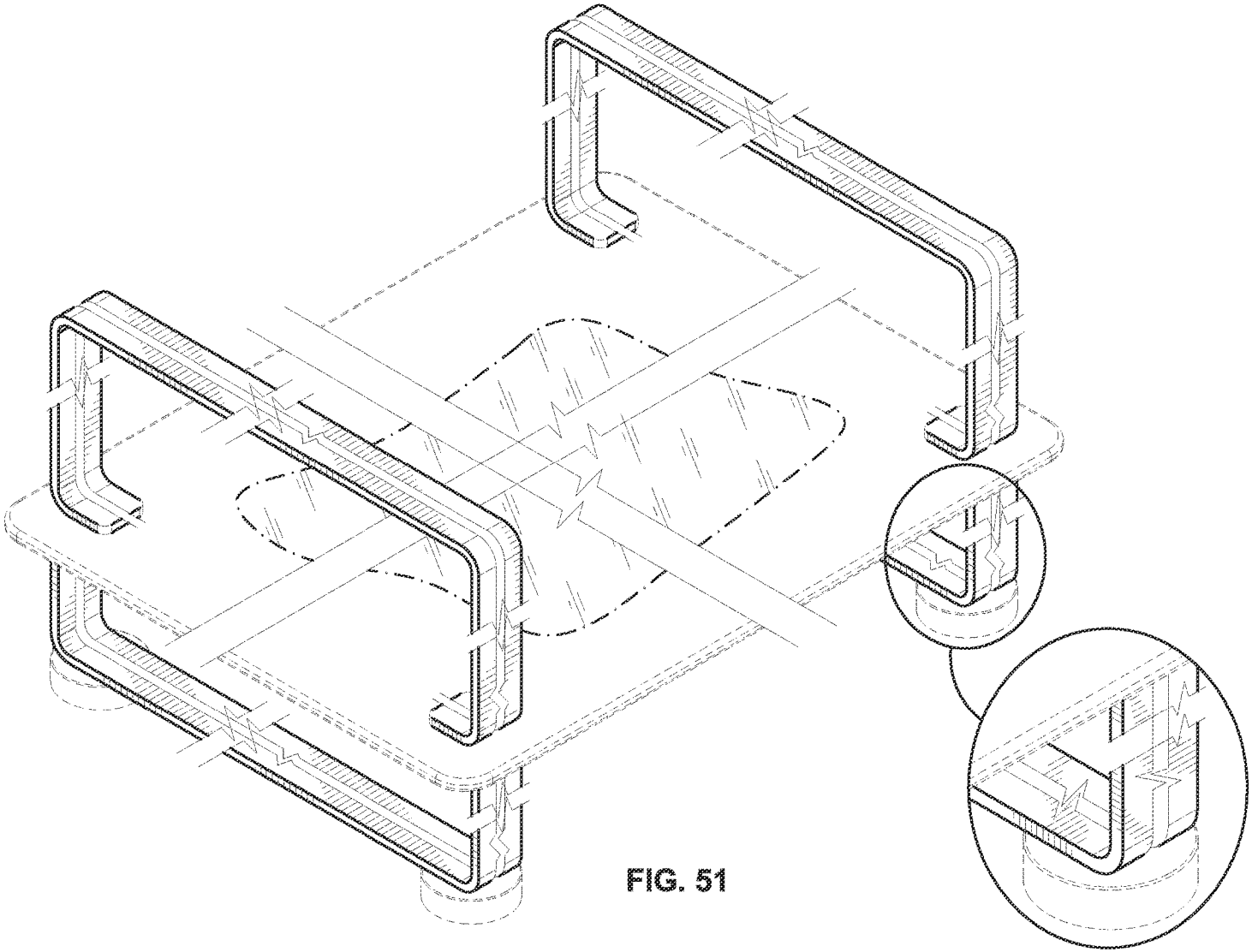
FIG. 51 is a top front-right perspective view of another embodiment of a reconfigurable shelf assembly.
Figure 52:
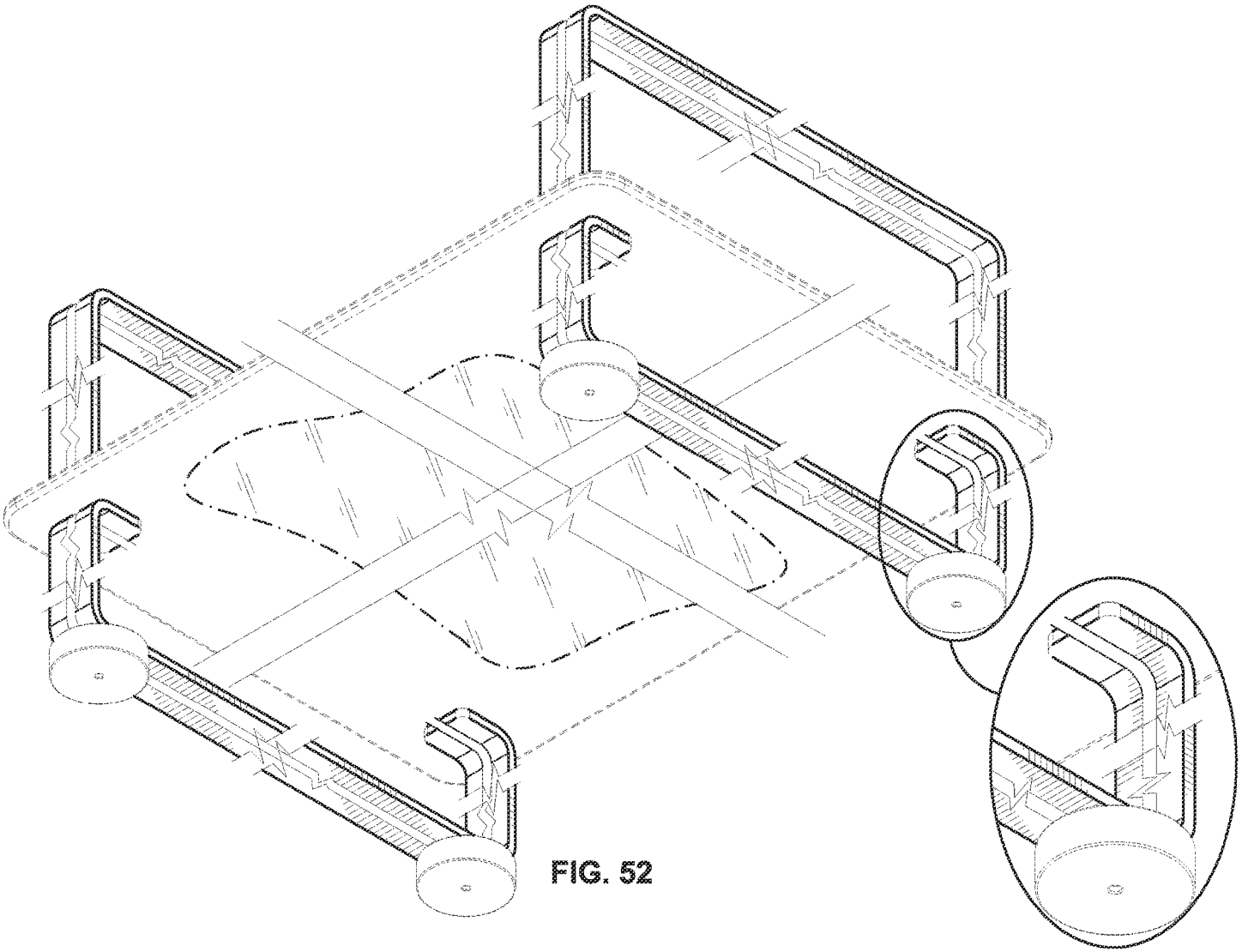
FIG. 52 is a bottom left-front perspective view of the reconfigurable shelf assembly shown in FIG. 51.
Figure 55:
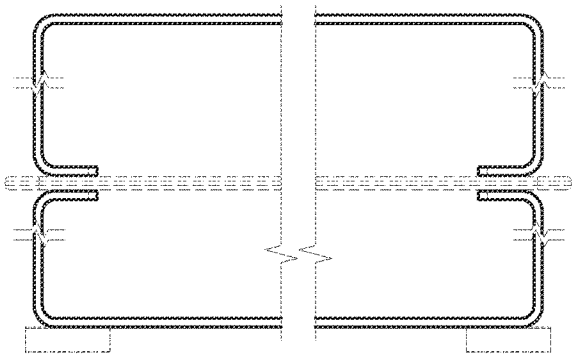
FIG. 55 is a front view of the reconfigurable shelf assembly shown in FIG. 51.
Figure 53:
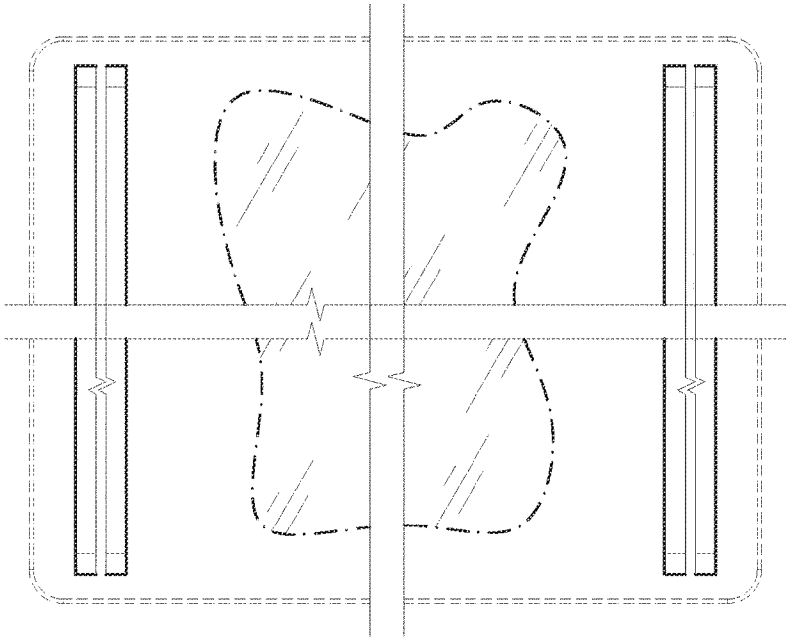
FIG. 53 is a top view of the reconfigurable shelf assembly shown in FIG. 51.
Figure 54:
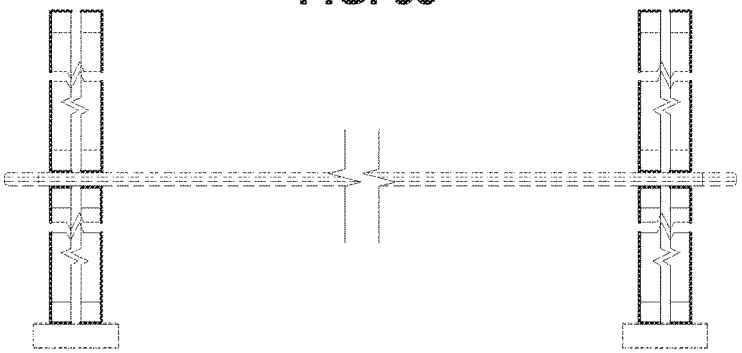
FIG. 54 is a left view of the reconfigurable shelf assembly shown in FIG. 51.
Figure 57:
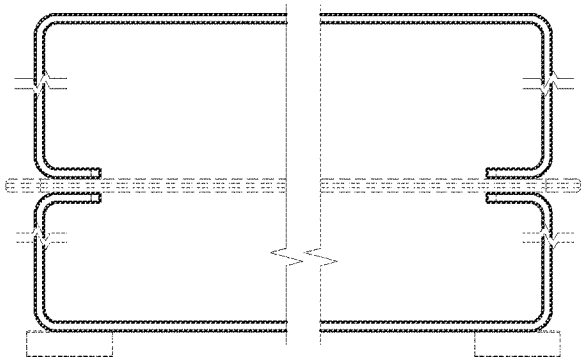
FIG. 57 is a back view of the reconfigurable shelf assembly shown in FIG. 51.
Figure 56:
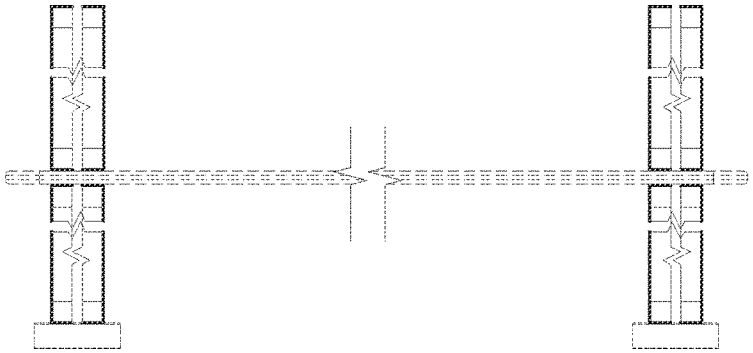
FIG. 56 is a right view of the reconfigurable shelf assembly shown in FIG. 51.
Figure 58:
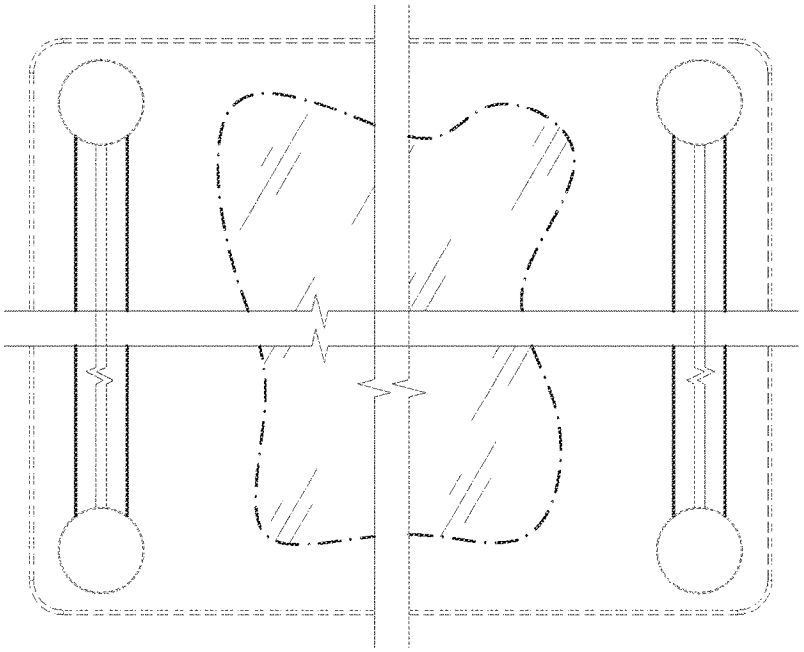
FIG. 58 is a bottom view of the reconfigurable shelf assembly shown in FIG. 51.
Figure 59:
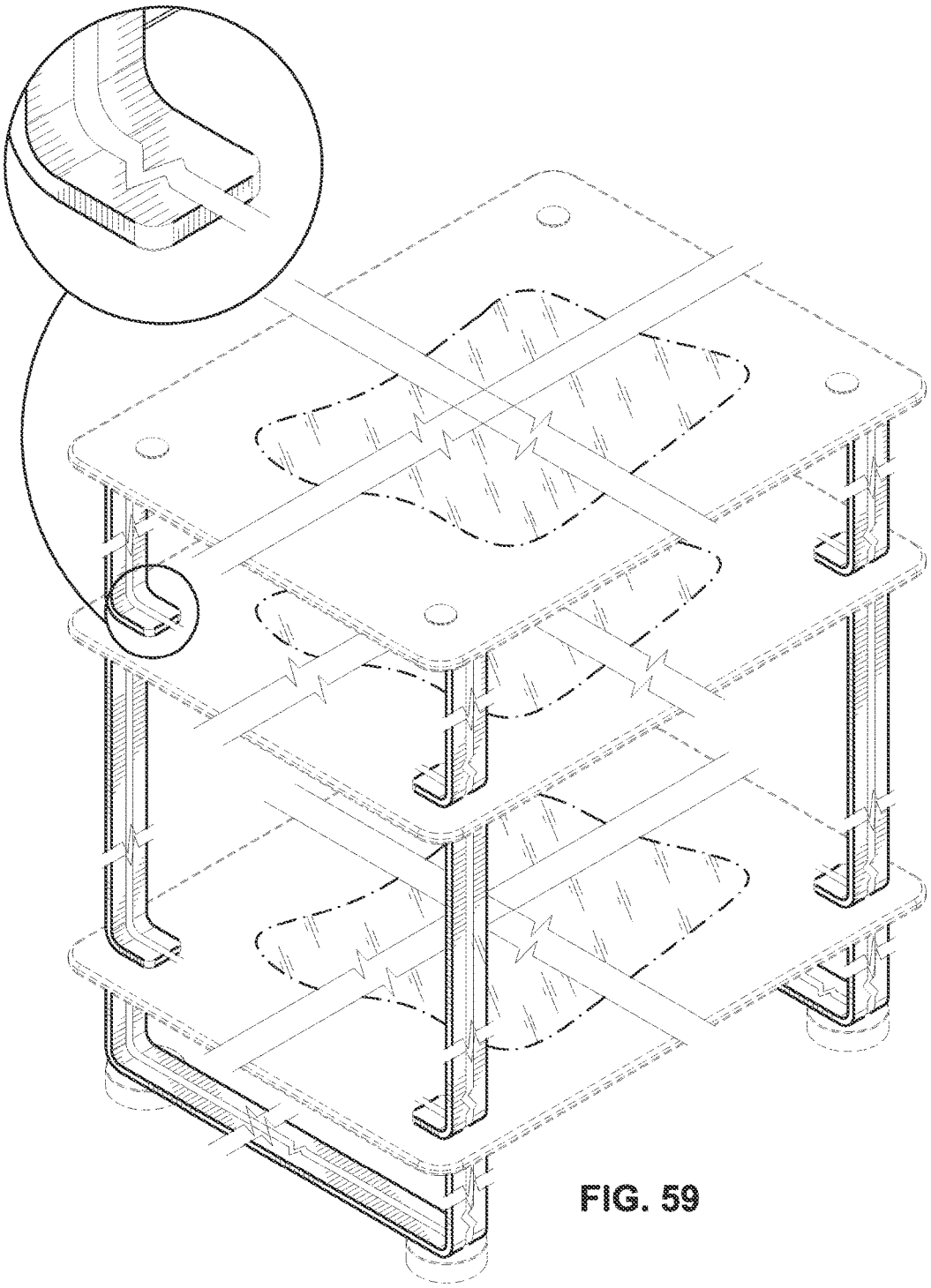
FIG. 59 is a top front-right perspective view of a further embodiment of a reconfigurable shelf assembly.
Figure 60:
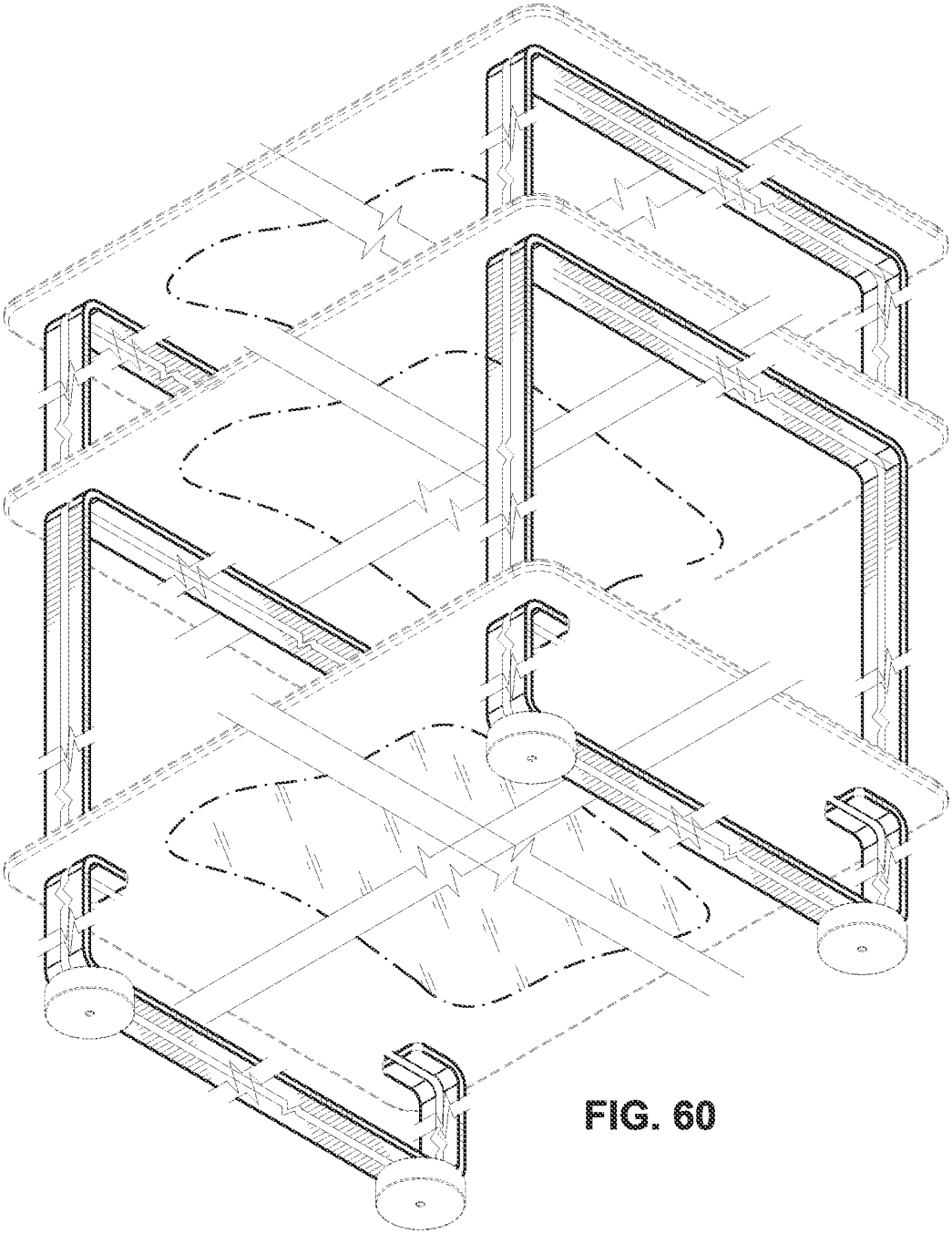
FIG. 60 is a bottom left-front perspective view of the modular freestanding shelf assembly shown in FIG. 59.
Figure 61:
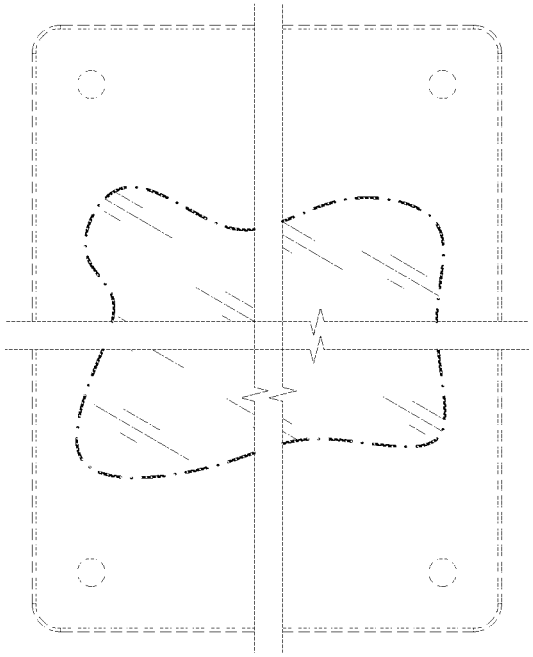
FIG. 61 is a top view of the reconfigurable shelf assembly shown in FIG. 59.
Figure 62:
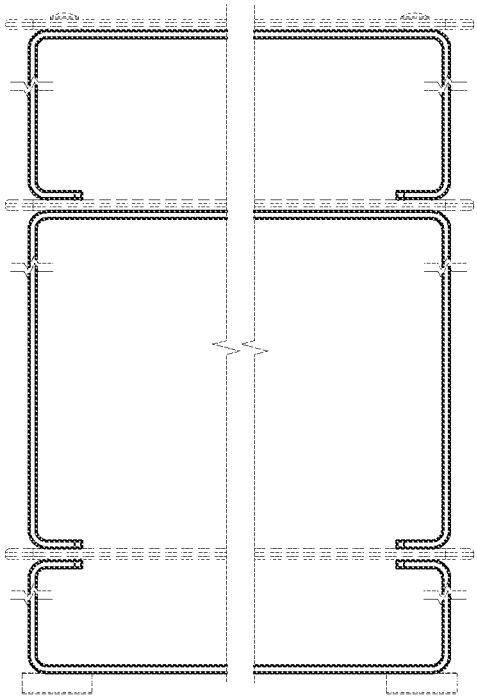
FIG. 62 is a front view of the reconfigurable shelf assembly shown in FIG. 59.
Figure 63:
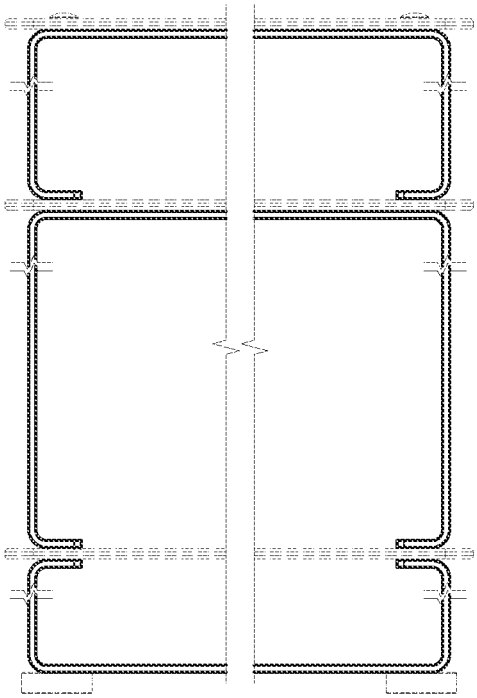
FIG. 63 is a back view of the reconfigurable shelf assembly shown in FIG. 59.
Figure 64:
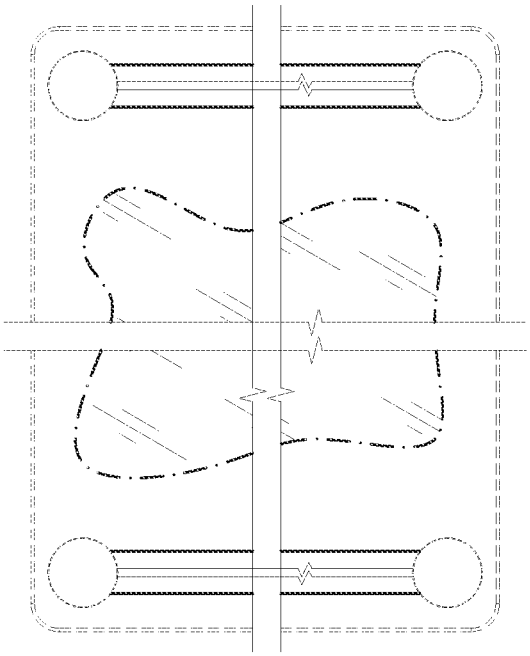
FIG. 64 is a bottom view of the reconfigurable shelf assembly shown in FIG. 59.
Figure 65:
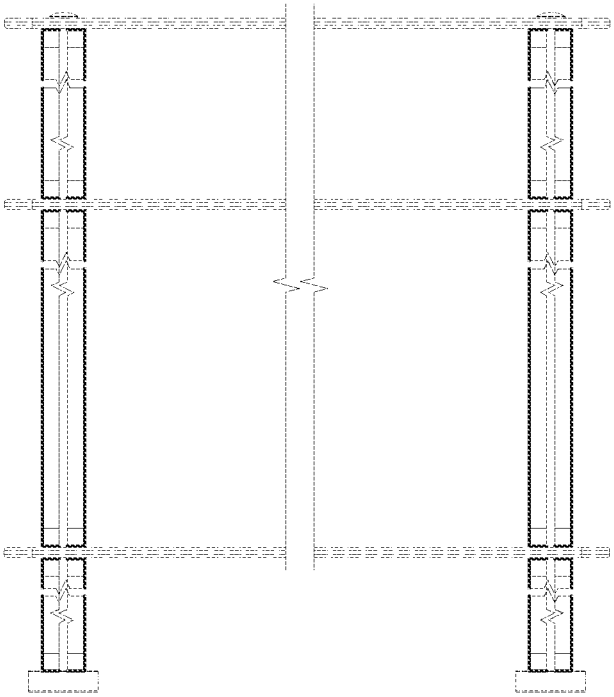
FIG. 65 is a left view of the reconfigurable shelf assembly shown in FIG. 59.
Figure 66:
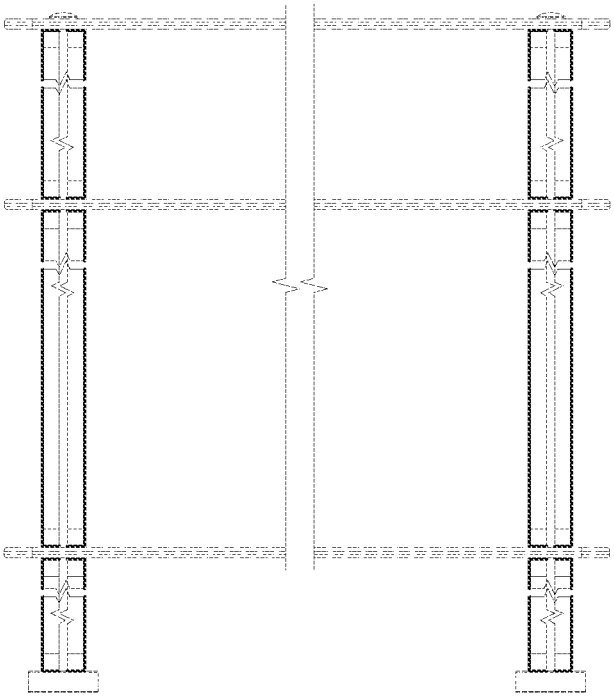
FIG. 66 is a right view of the reconfigurable shelf assembly shown in FIG. 59.
Figure 67:
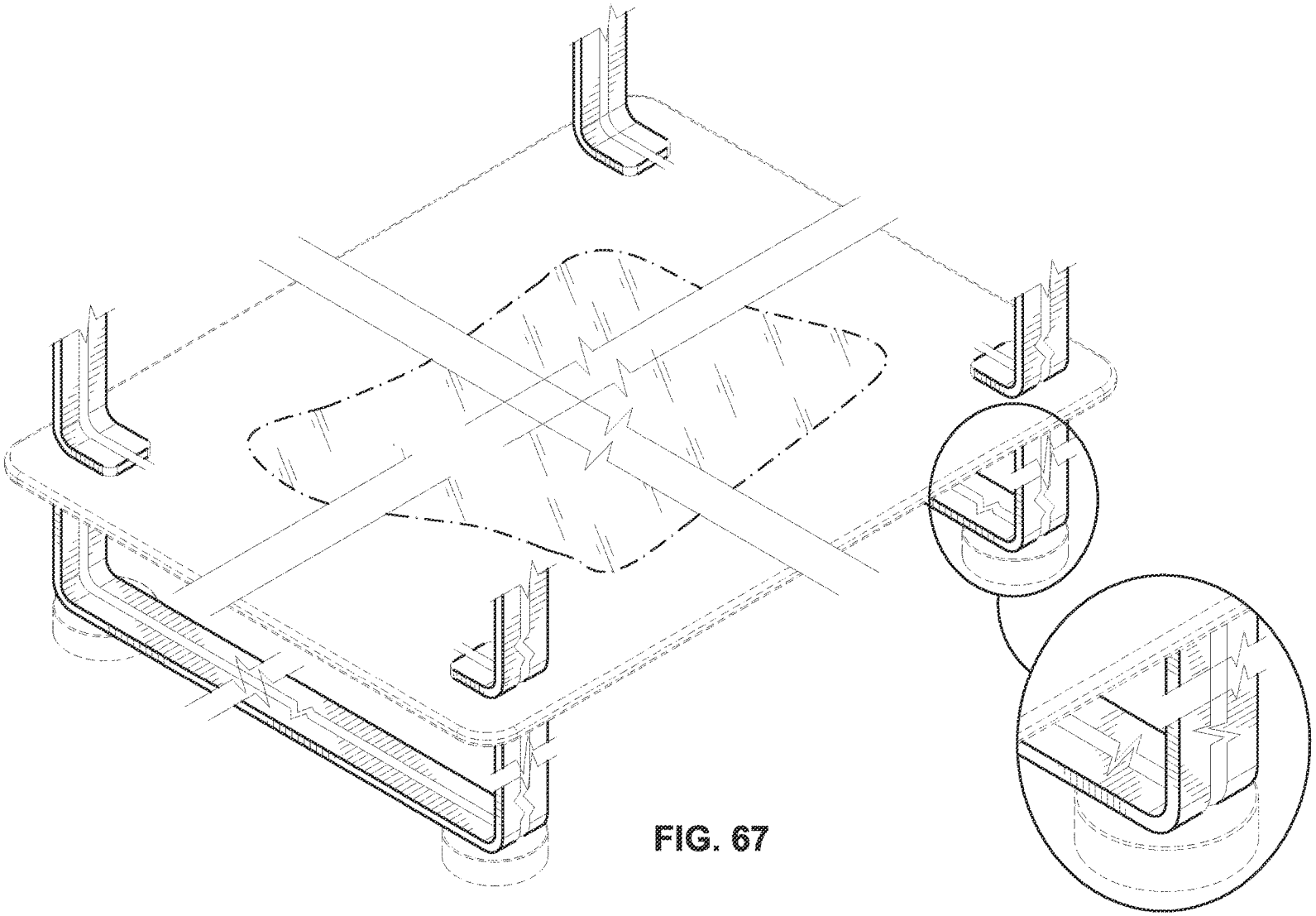
FIG. 67 is a top front-right perspective view of another embodiment of a reconfigurable shelf assembly.
Figure 68:
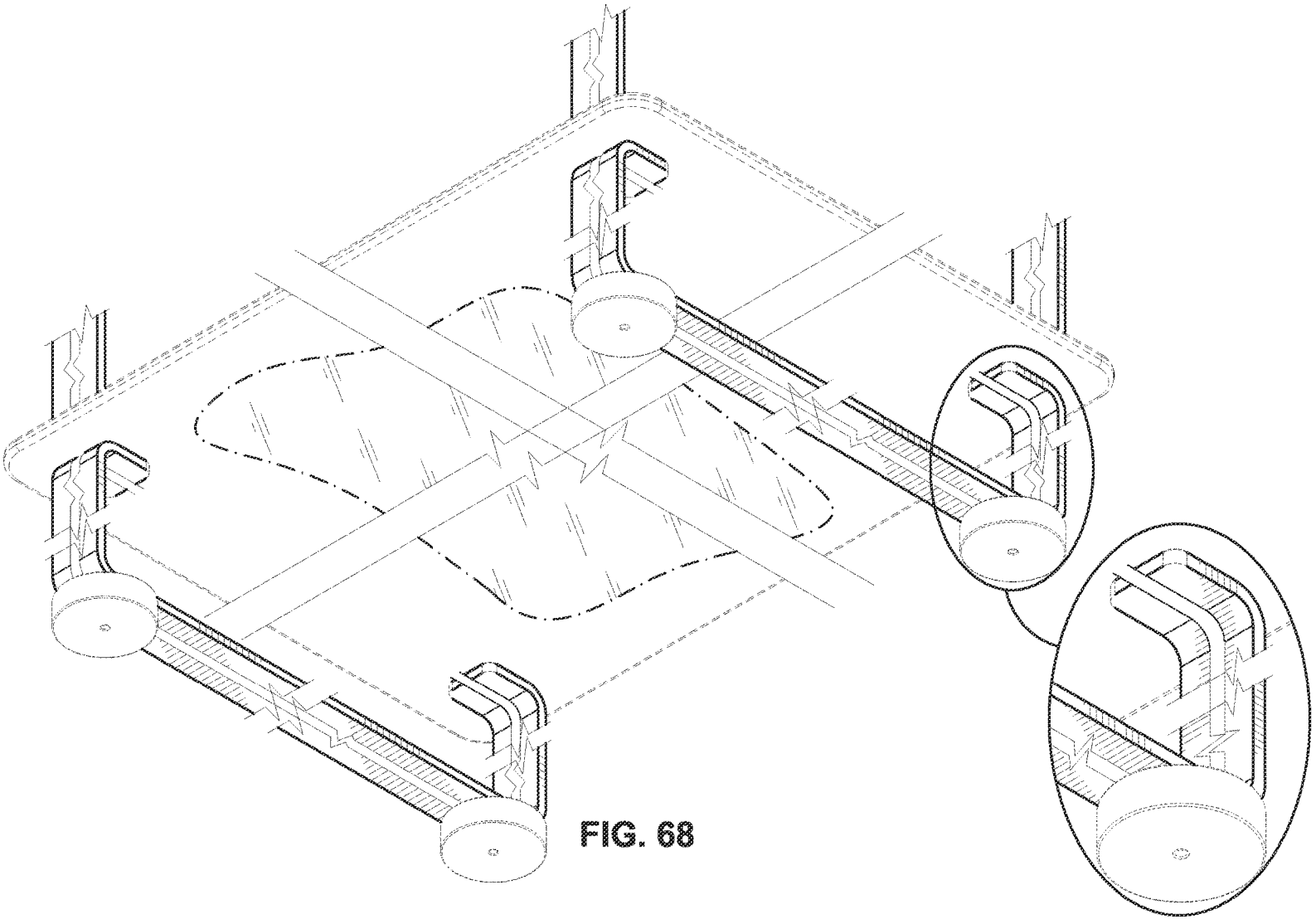
FIG. 68 is a bottom left-front perspective view of the reconfigurable shelf assembly shown in FIG. 67.
Figure 69:
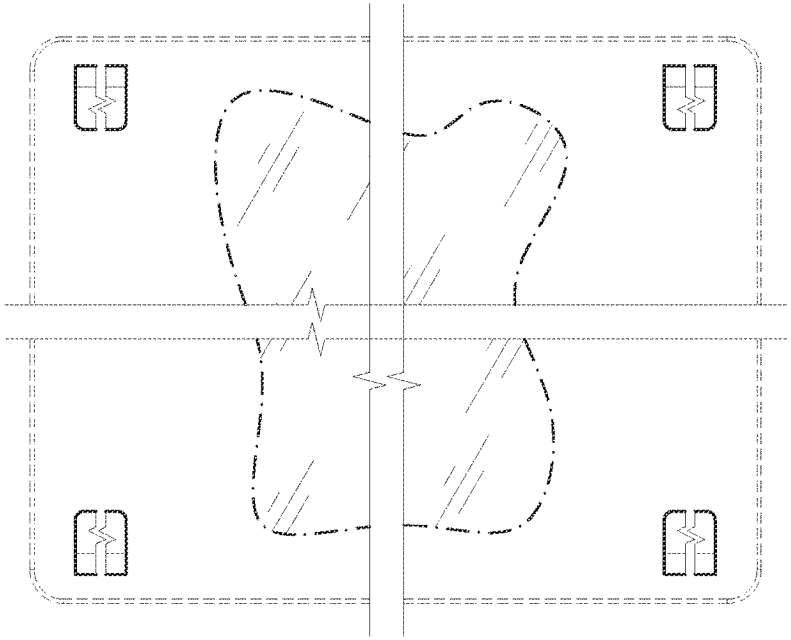
FIG. 69 is a top view of the reconfigurable shelf assembly shown in FIG. 67.
Figure 70:
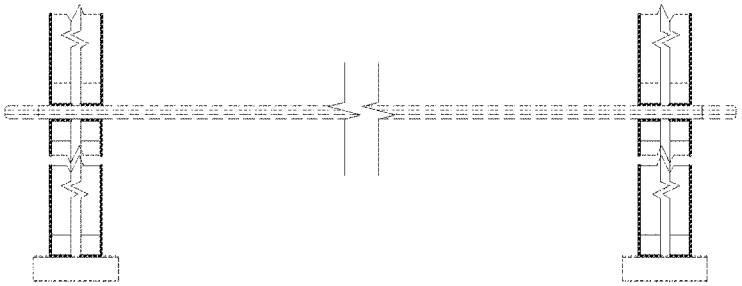
FIG. 70 is a left view of the reconfigurable shelf assembly shown in FIG. 67.
Figure 71:
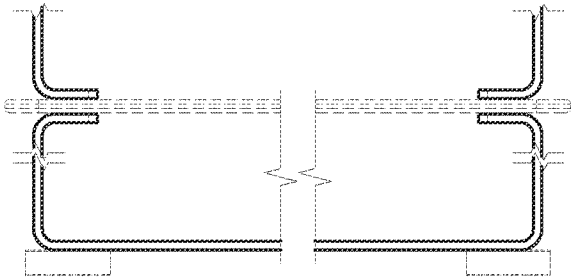
FIG. 71 is a front view of the reconfigurable shelf assembly shown in FIG. 67.
Figure 73:
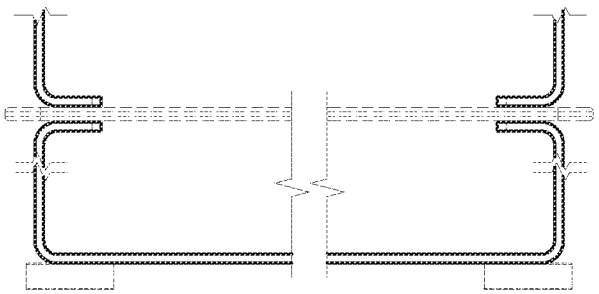
FIG. 73 is a back view of the reconfigurable shelf assembly shown in FIG. 67.
Figure 72:
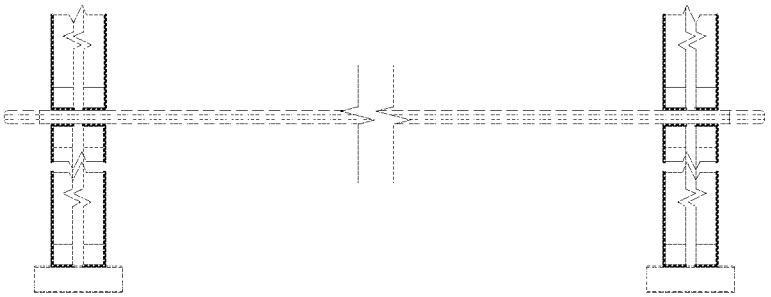
FIG. 72 is a right view of the reconfigurable shelf assembly shown in FIG. 67.
Figure 74:
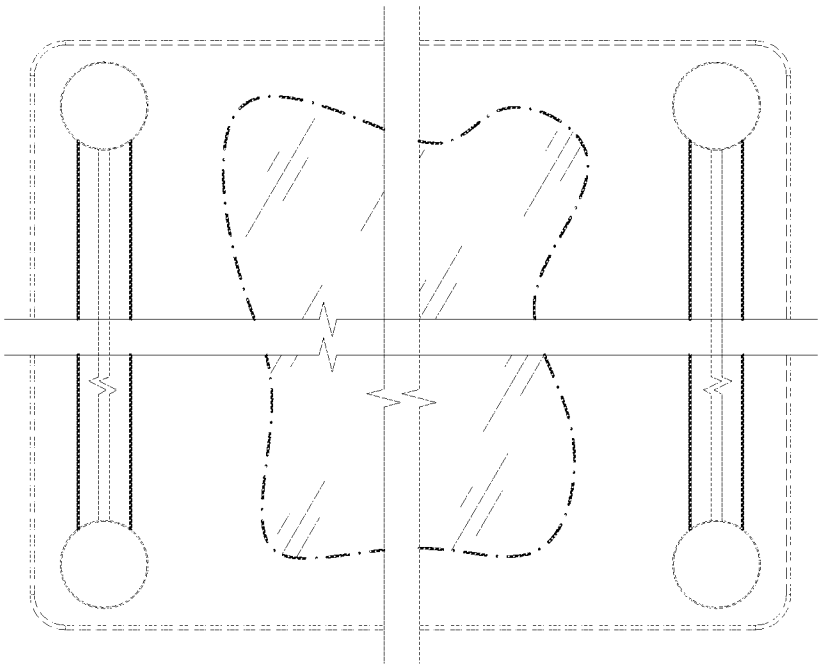
FIG. 74 is a bottom view of the reconfigurable shelf assembly shown in FIG. 67.

The broken lines shown in FIGS. 1-74 are only for illustrative purposes to show visible environmental structure and form no part of a claimed invention. It is contemplated that any one or more of the broken lines shown in any one or more of FIGS. 1-74 can be converted into solid lines to form part of a claimed invention herein. Likewise, it is contemplated that any one or more of the solid lines shown in any one or more of FIGS. 1-74 can be converted into broken lines to form no part of a claimed invention.

The boundary lines shown in FIGS. 1-74 in dot-dash form do not exist in reality in the respective system or assembly embodying the design and are only for illustrative purposes to show bounds of the claimed design. It is understood that the claimed design extends to the boundary but does not include the boundary.

While the invention is susceptible to various modifications and alternative forms, specific embodiments have been shown by way of example in the drawings and will be described in detail herein. It should be understood, however, that the inventions are not intended to be limited to the particular forms disclosed. Rather, the aspects disclosed herein cover all modifications, equivalents, and alternatives falling within the spirit and scope of the invention as defined by the appended claims.

DETAILED DESCRIPTION

While aspects of the present disclosure are susceptible of embodiment in many different forms, there is shown in the drawings and will herein be described in detail some embodiments with the understanding that the present disclosure is to be considered as an exemplification of the principles of the embodiments and is not intended to limit the broad aspect of the inventions to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

The present disclosure pertains, generally, to a scalable, modular, reconfigurable, freestanding furniture system that includes reusable components (e.g., frames, shelves, drawers, desktops, table tops, etc.) for producing a large set of furniture products, such as shelf assemblies, drawer assemblies, tables, and desk assemblies, or any combination thereof (e.g., a shelf and drawer system, or a shelf and table system, or a desk and drawer system, etc.). The modular furniture system can be a freestanding system, i.e., not required to be, although it can be, attached to a wall or any vertical supporting structure to support loading of the system, which can be expanded vertically and/or horizontally, using modular components such as the generally or approximately "C-shaped" frame attachment mechanism described below in more detail. When additional safety against tipping moments is required, the system can be attached to a wall or vertical support structure. Each furniture product built with the reusable components is changeable or expandable to customize according to new/different needs. Thus, components can be added to and/or removed from the furniture product, and the furniture product can be divided or rearranged or reconfigured to produce a different (e.g., larger) furniture product.

In accordance with some embodiments, to facilitate the modularity, reconfigurable, and customizability benefits of the modular furniture system, the components are attached or mounted to each other with removable fasteners, such as machine screws, that provide high structural integrity when fastened, while also enabling disassembly and component reuse. Accordingly, in some aspects, the components are not permanently connected or bonded with adhesives, mechanical welds, or permanent joinery as in a monolithic furniture model.

In accordance with other embodiments, more-permanent fasteners, such as rivets, can be used to enhance structural integrity of the assembly. The use of permanent fasteners allow for customization options where structural rigidity is paramount, similar to removable fasteners, and can be modified by a skilled technician (e.g., a factory installer) when reuse and/or replacement is required.

The disclosed modular furniture system provides several benefits, including customization and reconfiguration, scalability, modularity, component reuse, and component replacement. Initially, a user can configure a precise specification or customization of a desired initial assembly or system configuration. Subsequently, as time passes after the initial configuration and needs change, the customer is able to modify and reuse components from the original system configuration. Furthermore, the user can replace a damaged component without disposing (or replacing) the entire system.

For example, the user initially specifies and acquires a freestanding shelf system with an exact number of shelves, an exact space between the shelves (as defined by in-between frame height), and an overall shelf system height. Additionally or alternately, the user can specify a hybrid assembly of shelves and drawers with the same control over the number of components and useful shelf space between the components. Then, subsequently, the user can add a single shelf component to the freestanding shelf system as needs for shelf-storage space increase in the future. The benefit of component reuse eliminates the need to buy an entirely new monolithic product.

Thus, the disclosed modular furniture system affords maximum versatility, customer choice, and ability to reuse and repair components. The modular furniture system breaks the typical linear lifecycle of furniture, from purchase to disposal, by enabling component reuse and high-value component repair and recycling.

As described in more detail below, the modular furniture system is constructed from a large set of unique furnishings selected from at least three types of primary components, including, for example, shelf panels, modular frames, and/or modular drawers. The components can be constructed from one or more of various types of materials, including metals, woods, composites, plastics, glass, or any material that meets intended structural requirements.

FIGS. 1-74 illustrate various aspects of the present disclosure, and their descriptions can be found in the above Brief Description of the Drawings. The broken lines shown in FIGS. 1-74 are only for illustrative purposes to show visible environmental structure and form no part of the claimed invention. The boundary lines shown in FIGS. 1-74 in dot-dash form do not exist in reality in the respective system or assembly embodying the design and are only for illustrative purposes to show bounds of the claimed design. It is understood that the claimed design extends to the boundary but does not include the boundary.

Figure 75:
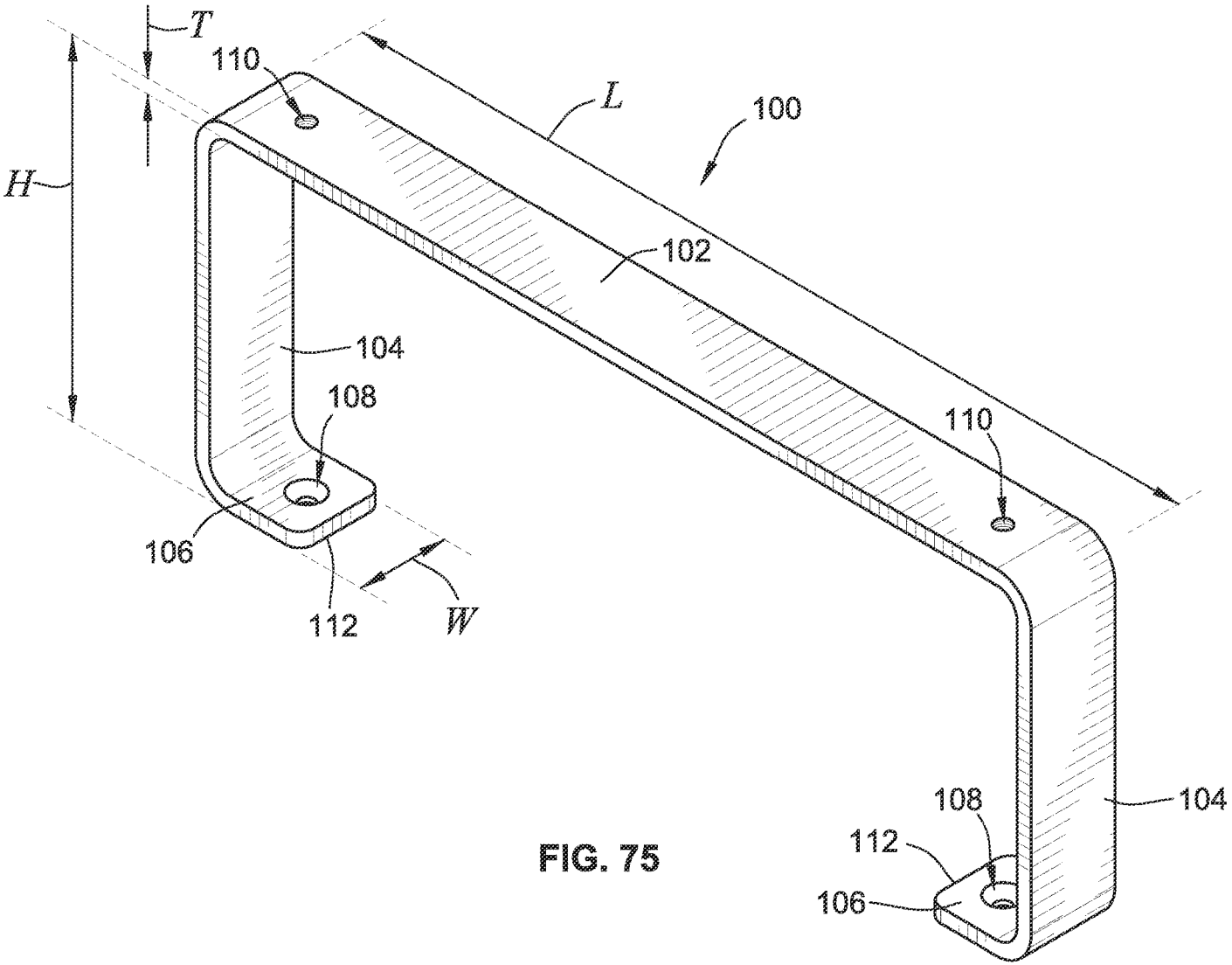
FIG. 75 is a perspective view of a frame for a reconfigurable shelf assembly, in accordance with an aspect of the present disclosure.
Figure 78:
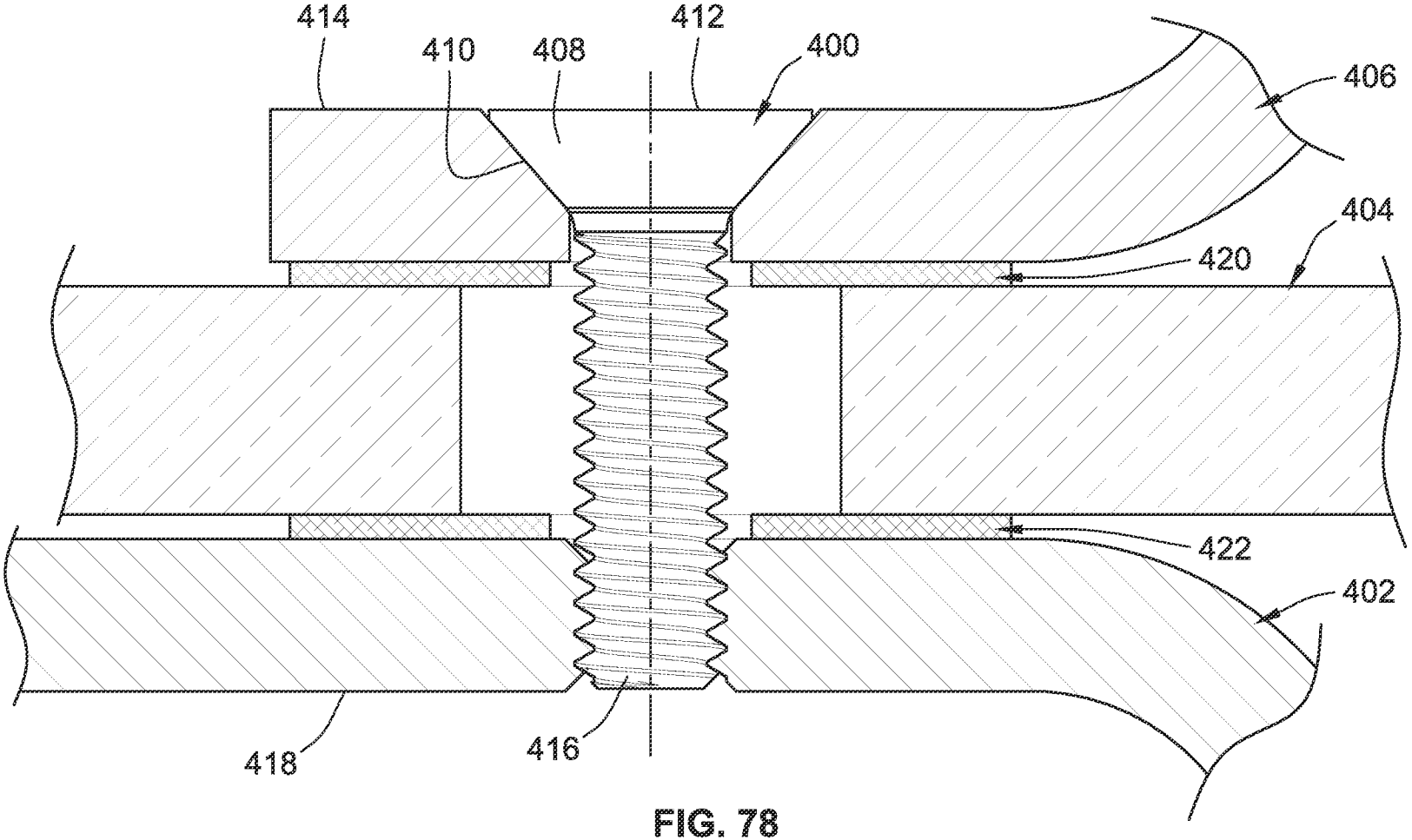
FIG. 78 is a cross-sectional view illustrating a screw mounting assembly, in accordance with a further embodiment.

FIG. 75 illustrates a frame 100 (also referred to as a "C" frame attachment mechanism), which is a primary component in a free standing assembly, such as the freestanding 4-shelf desk shown in FIG. 78, and which is designed to aid in supporting heavy loads and to resist torsional bending or twisting of the overall assembly. The frame 100 has an elongate portion 102 that extends horizontally between two vertical leg portions 104, each of the vertical leg portions 104 terminating at a horizontal portion 106 having a countersank hole 108 therein. The frame 100 further has two tapped or threaded holes 110 near each of the vertical leg portions 104. According to an embodiment, an internal radius between the elongate portion 102 and each of the vertical leg portions 104 is in the range of about 0.75 inches (1.91 centimeters), although in other implementations, any other radius can be used, including 0 inches, which corresponds to a right-angle between the elongate portion 102 and each of the leg portions 104.

The frame 100 is a unitary structure having a generally elongated C-shape and is used either as a base frame, which forms the beginning of a freestanding assembly, or as a support frame, which integrates additional components in the freestanding assembly. In other words, the same frame 100 is capable of forming a base frame or an intermediate support frame above the base frame, eliminating the need to manufacture different base and support frames. In addition, the frame 100 can be oriented either with the elongate portion 102 on top (as illustrated in FIG. 75) or in an inverted orientation, with the elongate portion 102 on the bottom. Optionally, if the frame 100 is used in the inverted orientation, the tapped holes 110 are made as countersank holes and the countersank holes 108 are made as tapped holes to further increase versatility and modularity of a freestanding assembly.

In accordance with at least some embodiments, the frame 100 is fabricated from a metal to form the corresponding unitary structure, and has a thickness T, a width W, and height H. Optionally, the width W is greater than the thickness T, and the height H is greater than the width W. In some embodiments, the elongate portion 102 has a length L that is longer than the height H. The height H, in particular, can vary to achieve assemblies with shelves of different heights. Additionally, a major surface of each horizontal portion 106, as defined by the width W, is substantially parallel with the elongate portion 102.

The horizontal portions 106 can have rounded corner edges at an end edge 112 thereof to help reduce, or eliminate, damage to property or injury to people. For example, the rounded corner edges are beneficial at least because they tend to prevent inadvertent breaking of brittle furniture components (e.g., a shelf panel made of glass) such as when the assembly is flexed or twisted or jostled, or to reduce likelihood of inadvertent snagging or scratching of items, such as papers, clothing, etc., when those items are moved past the frame 100. In other implementations, the horizontal portions 106 have right-angle edges at the end edge 112 thereof, such as shown in FIG. 1.

To fabricate the frame 100, an elongated piece of sheet metal having a uniform thickness T, a width W, and an elongated length L is provided (where L>W>T), such as by using a laser cutting technique. The holes 108, 110 are formed (e.g., drilled or tapped), and then the metal is first bent twice (e.g., using a roll forming or bending technique) to form the vertical leg portions 104 so that they have a height H, and then bent twice again to form each of the horizontal portions 106. Only four bends having the same setback and bend radius need to be formed to make each frame 100.

Figure 76:
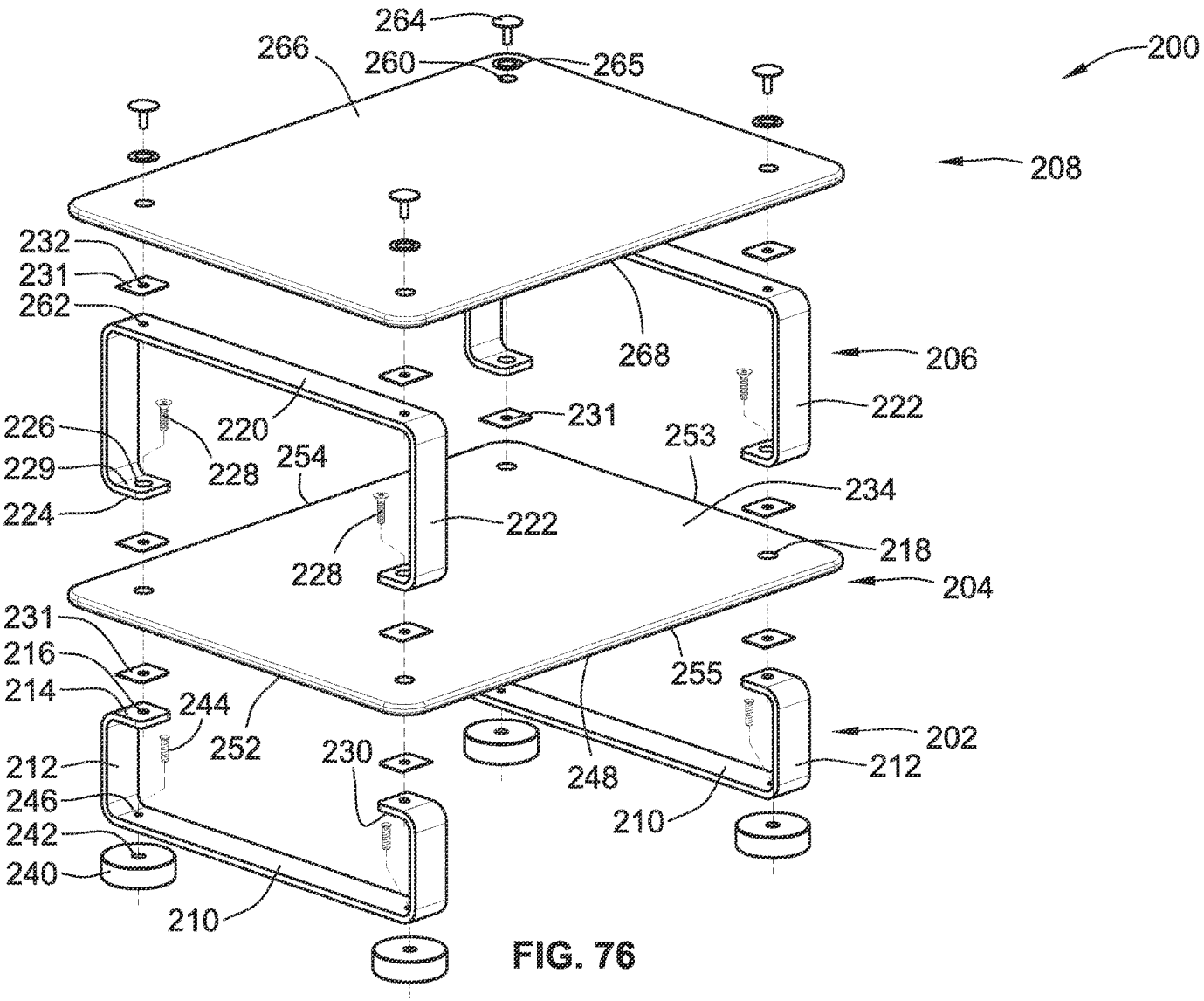
FIG. 76 is a perspective view of a reconfigurable shelf assembly, in accordance with another embodiment.

FIG. 76 illustrates a freestanding two-shelf assembly 200 with a plurality of components, including a pair of base frames 202, a bottom shelf panel 204, a pair of first support frames 206, and a top shelf panel 208. Generally, the components are securely fastened together one on top of the other to form a vertical (relative to earth) column of components (e.g., a two-shelf pedestal). The top of each component presents threaded inserts to mate with clearance holes on the bottom of the component above them. Conversely, the bottom of each component presents clearance holes to mate with the threaded inserts on the top of the component beneath. For modularity purposes, frames 202, 206 are used in sets of two (i.e., in pairs) to provide a combined pattern of four tapped or threaded holes on top and four clearance holes on the bottom (or, vice-versa, four clearance holes on top and four tapped or threaded holes on the bottom).

The pair of base frames 202 are similar, if not identical, to the frame 100 described above in reference to FIG. 75. However, the base frames 202 are mounted in an inverted manner relative to the illustration of the frame 100. Each base frame 202 has an elongate rail portion 210 that extends horizontally between vertical leg portions 212, with each of the vertical leg portions 212 terminating at a horizontal top portion 214 having a tapped or threaded hole 216 therein.

The bottom shelf panel 204 has a plurality of holes 218 through its surface and is positioned over the pair of base frames 202, The position of the bottom shelf panel 204 relative to the pair of base frames 202 is such that each of the plurality of holes 218 aligns with a corresponding one the tapped or threaded holes 216 of the base frames 202. Optionally, the bottom shelf panel 204 is composed of a glass material and has only clearance holes (no threaded holes). Thus, by way of example, the holes 218 are solely clearance holes.

The first pair of support frames 206 are also similar, if not identical, to the frame 100 described above in reference to FIG. 75. Each support frame 206 has an elongate support section 220 extending horizontally between vertical leg portions 222. Each of the vertical leg portions 222 terminates at a horizontal bottom portion 224 having a countersunk hole 226 therein. Each of the first pair of support frames 206 is oriented in mirror-image relationship about the bottom shelf panel 204 relative to each of the pair of base frames 202. Optionally, each of the pair of base frames 202 is identical to each other and to each of the first pair of support frames 206.

The assembly 200 also includes a plurality of screws 228, each of which has a countersunk head and passes through respective ones of the countersunk holes 226 of the first pair of support frames 206 and through respective ones of the plurality of holes 218 of the bottom shelf panel 204. The screws 228 threadably engage respective ones of the tapped or threaded holes of the pair of base frames 202 to form thereby the freestanding two-shelf assembly 200. The countersunk head of each screw 228 is flush with a top surface 229 of the horizontal bottom portion 224 and an end of the screw 228 can be flush with a bottom surface 230 of the horizontal top portion 214. As each screw 228 is tightened, the adjacent frames and shelf panel are pulled tightly together, closing any gap therebetween and creating a robust mechanical interface that creates space between shelves while providing structural support and form for the assembly. In some aspects, the shelf panel can have a thickness sufficient to create a dado or groove in which the bottom portion 224 sits so that a top exposed surface of the bottom portion 224 is flush with the top surface of the shelf panel. When the countersunk head of the screw 228 is fully tightened into the corresponding threaded hole, the entire top surface of the shelf panel is planar.

The assembly 200 can optionally further include a plurality of pads 231 having a hole 232 therein. Corresponding ones of the plurality of pads 231 can be positioned between the horizontal bottom portion 224 of the support frames 206 and a top surface 234 of the bottom shelf panel 204 such that a corresponding screw 228 also passes through the hole 232 of the pad 231. The pads 231 prevent direct metal-on-glass contact, thereby helping to avoid cracking, scratching, or otherwise damaging the shelf panels in implementations in which they are composed of a glass.

The assembly 200 further includes a plurality of cylindrical feet 240, each having a central tapped foot-mount hole 242. Each foot 240 is secured to a respective base frame 202 by threading a threaded stud 244 into the tapped foot-mount hole 242. The threaded stud 244 is machine-pressed through a clearance hole 246 located in the elongate rail portion 210 and extends downward therefrom. The feet 240 assist in leveling the freestanding assembly 200, if necessary, and in extending the fulcrum or tipping point of the freestanding assembly 200 away from the center of mass (thereby, reducing a propensity of the freestanding assembly 200 to tip over). The form factor of the feet 240 need not be cylindrical, but can take any other form, including conical, tapered, square, rectangular, peg-like, and the like.

The bottom shelf panel 204 further includes a bottom surface 248, with the top and bottom surfaces 234, 248 being defined by a front side 252, a back side 253, a left side 254, and a right side 255. The bottom shelf panel is, optionally, made symmetrical such that it is reversible. For example, the top and bottom surfaces 234, 248 are identical to facilitate top-to-bottom reversibility, the front and back sides 252, 253 are identical to facilitate front-to-back reversibility, and/or the left and right sides 254, 255 are identical to facilitate left-to-right reversibility.

The top shelf panel 208 has a plurality of holes 260 through its surface and positioned over the first pair of support frames 206. Each of the first pair of support frames 206 has two tapped or threaded holes 262 near each of the vertical leg portion 222. The top shelf panel 208 is positioned over the first pair of support frames 206 such that each of the plurality of holes 260 aligns with a corresponding one of the tapped or threaded holes 262 of the first pair of support frames 206.

A plurality of threaded top caps 264 are inserted, respectively, through the holes 260 into the holes 262 to secure the top shelf panel 208 to the support frames 206. To eliminate, or reduce, scratches potentially caused during assembly and/or disassembly, transparent, round scratch resistant pads 265 are positioned between each cap 264 and a top surface 266 of the top shelf panel 208. Similarly, a pad 231, which is also optionally transparent and scratch resistant, is positioned between a bottom surface 268 of the top shelf panel 208 and the respective support frame 206.

Figure 77:
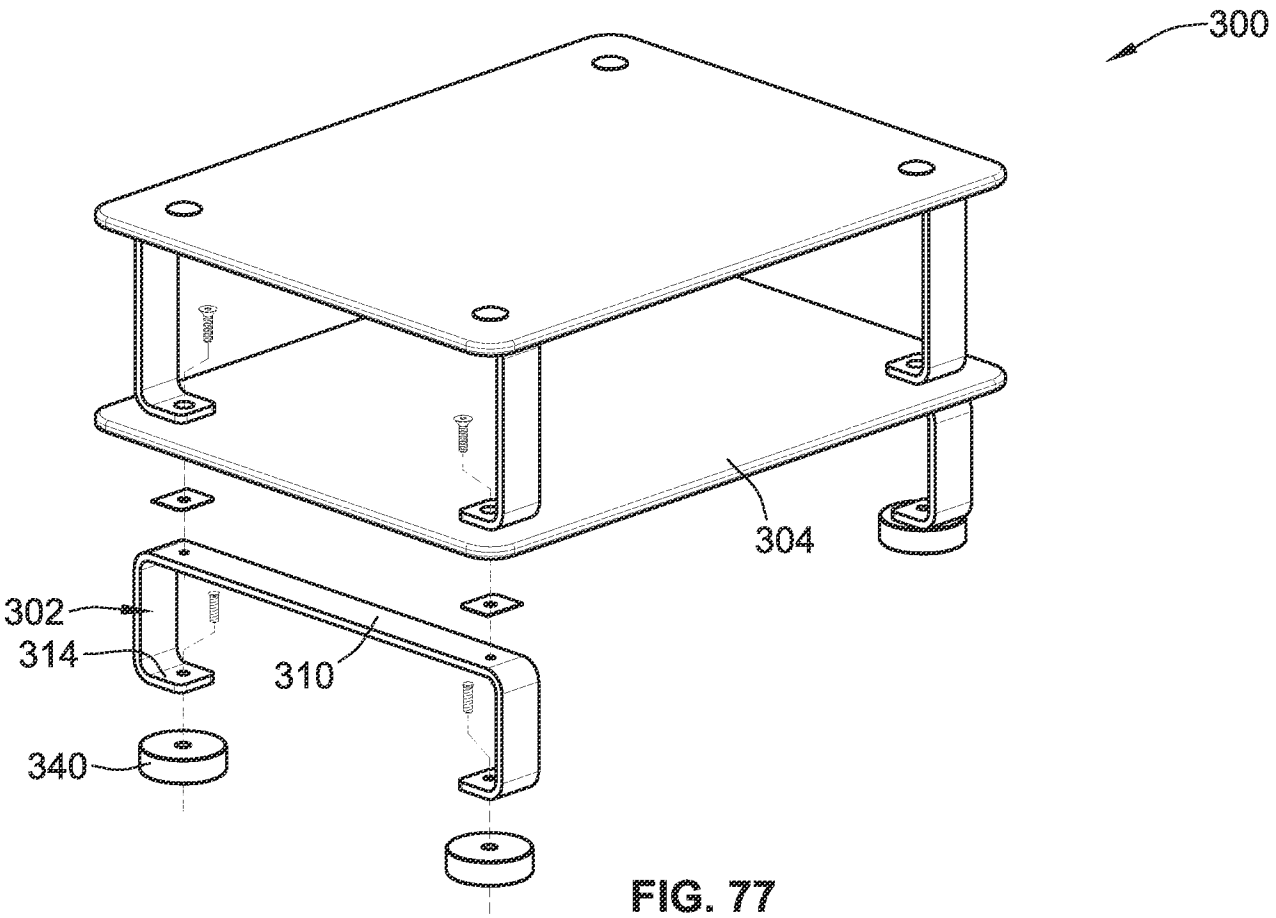
FIG. 77 is a perspective of the reconfigurable shelf assembly shown in FIG. 76 with inverted base frames.

FIG. 77 illustrates a freestanding two-shelf assembly 300 in which a pair of base frames 302 are inverted as a mirror-image relative to the base frames 202 of the two-shelf assembly 200 illustrated in FIG. 76. In this embodiment, an elongate rail portion 310 is positioned adjacent to a bottom shelf panel 304, and horizontal portions 314 have become "bottom" portions (instead of being "top" portions like the horizontal top portions 214) to which feet 340 are respectively mounted.

Figure 79:
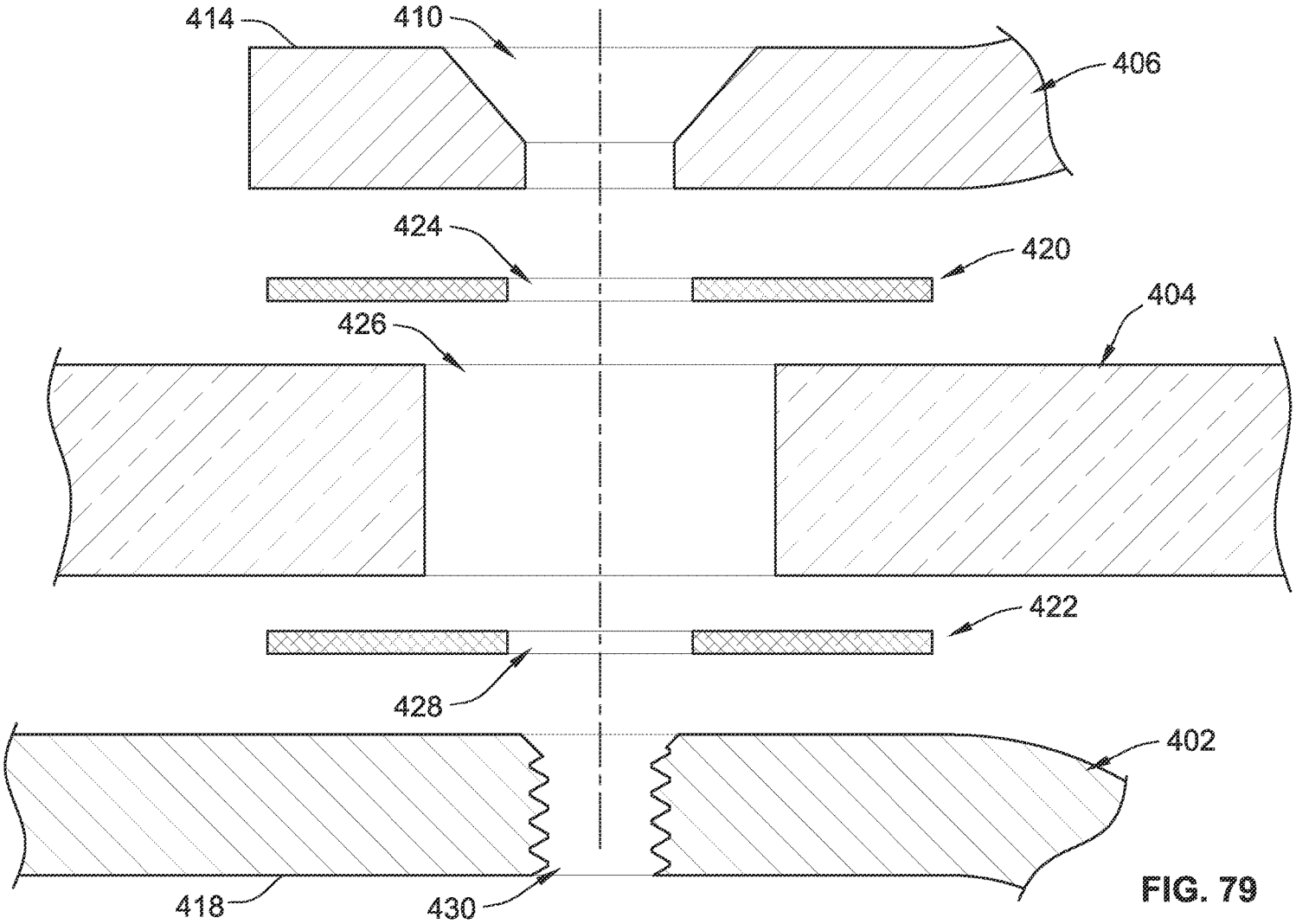
FIG. 79 is an exploded view of the screw mounting assembly shown in FIG. 78.

FIGS. 78 and 79 illustrate a mounting interface in which a screw 400 temporarily secures a base frame 402 to a shelf panel 404 and a support frame 406. The screw 400 has a countersunk head 408 that, when secured in place, fits within a countersunk hole 410 of the support frame 406 such that a top end 412 of the countersunk head 408 has a top surface that is flush with a top surface 414 of the support frame 406. Similarly, a screw end 416 has a bottom surface that is flush with a bottom surface 418 of the base frame 402.

Scratch-resistant pads 420, 422 are positioned between each component interface, i.e., a first pad 420 is positioned between the support frame 406 and the shelf panel 404 and a second pad 422 is positioned between the shelf panel 404 and the base frame 402. As such, the screw 400 is inserted through the countersank hole 410, and passes in sequence through a clearance hole 424 of the first pad 420, a clearance hole 426 of the shelf panel 404, a clearance hole 428 of the second 422, and is threadably engaged within a threaded or tapped hole 430 of the base frame 402.

FIGS. 80-87 illustrate various modular freestanding assemblies assembled with components such as the ones described above. The modular components of a freestanding assembly described in accordance with the present disclosure enable a scalable freestanding assembly for maximum versatility (which is direct contrast to prior systems in which shelf systems rely on a fixed frame in which the overall height cannot be altered). Thus, by way of example, additional support frames can be securely integrated into a freestanding assembly by adding another tier of support frames and/or other components (e.g., shelf panels of various sizes) on top of an existing uppermost shelf panel. The assembly is scalable not only in a vertical direction but also horizontally in any direction.

Figure 80:
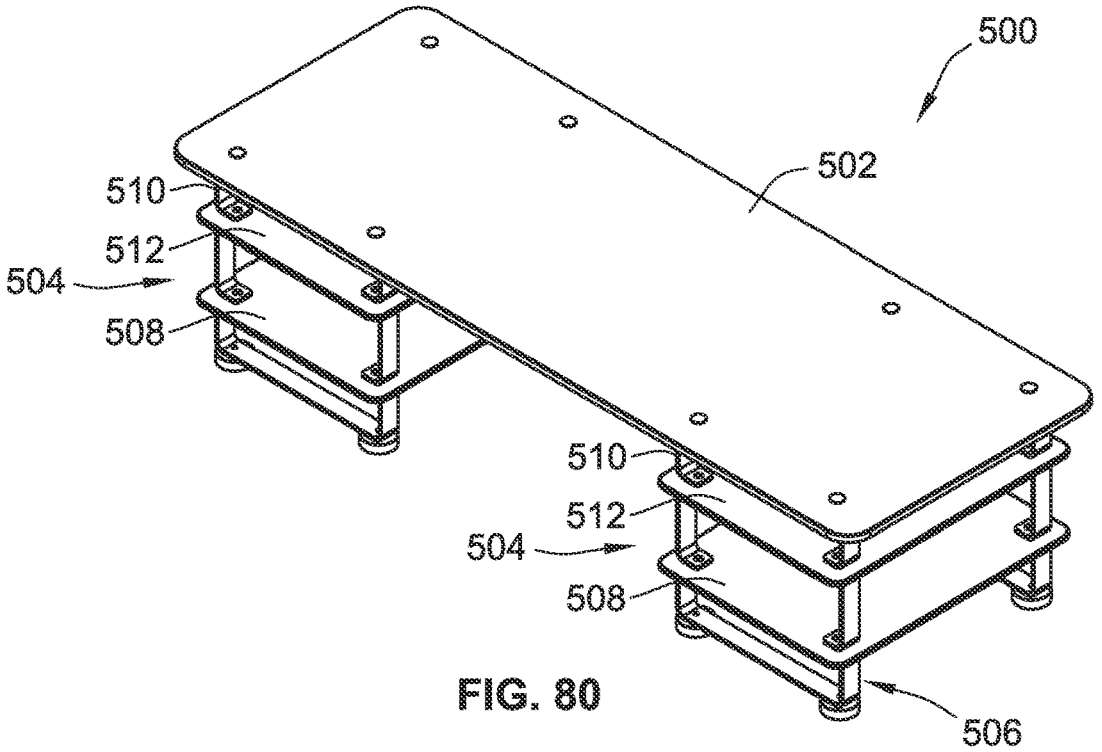
FIG. 80 is a top perspective view of a four-shelf desk, in accordance with yet another embodiment.
Figure 81:
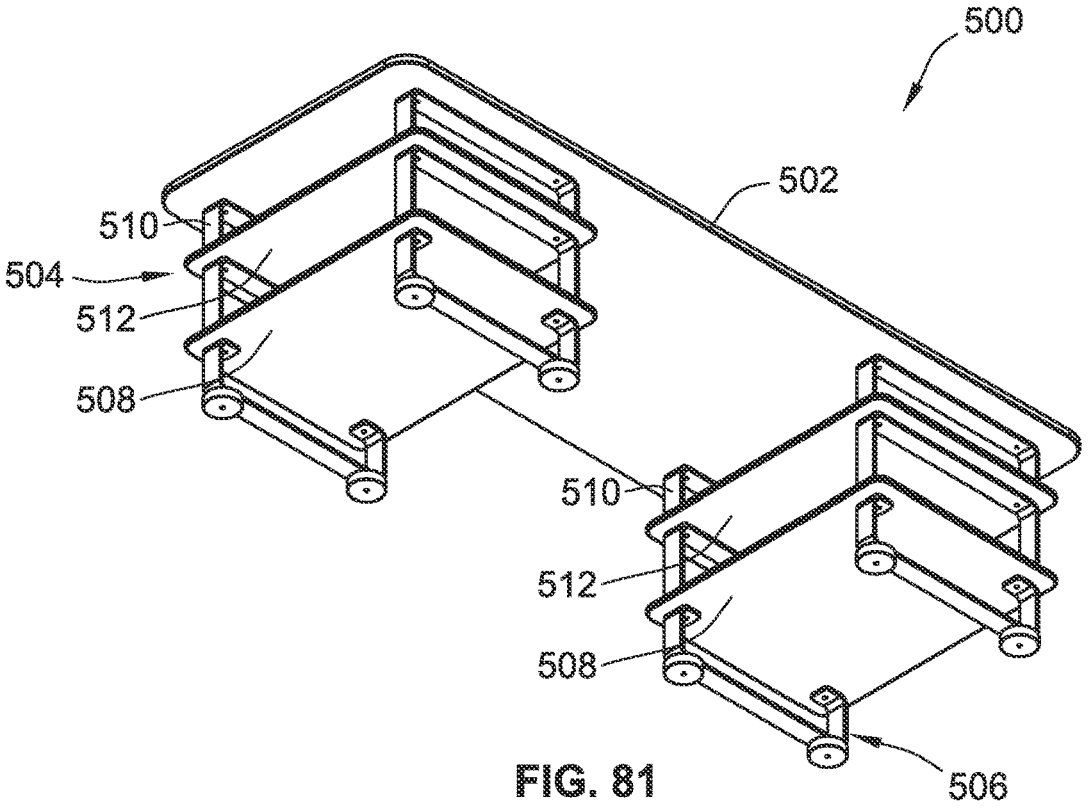
FIG. 81 is a bottom perspective view of the four-shelf desk shown in FIG. 80.

In one example, FIGS. 80 and 81 illustrate a four-shelf desk 500 with a desk panel 502 and two shelf columns 504, 506, each having two shelf panels 508. Thus, by way of further example, the freestanding two-shelf assembly 200 shown in FIG. 76 can be expanded into the four-shelf desk 500 shown in FIGS. 80 and 81 by mounting four additional support frames 510 between the desk panel 502 and top shelf panels 512.

Figure 82:
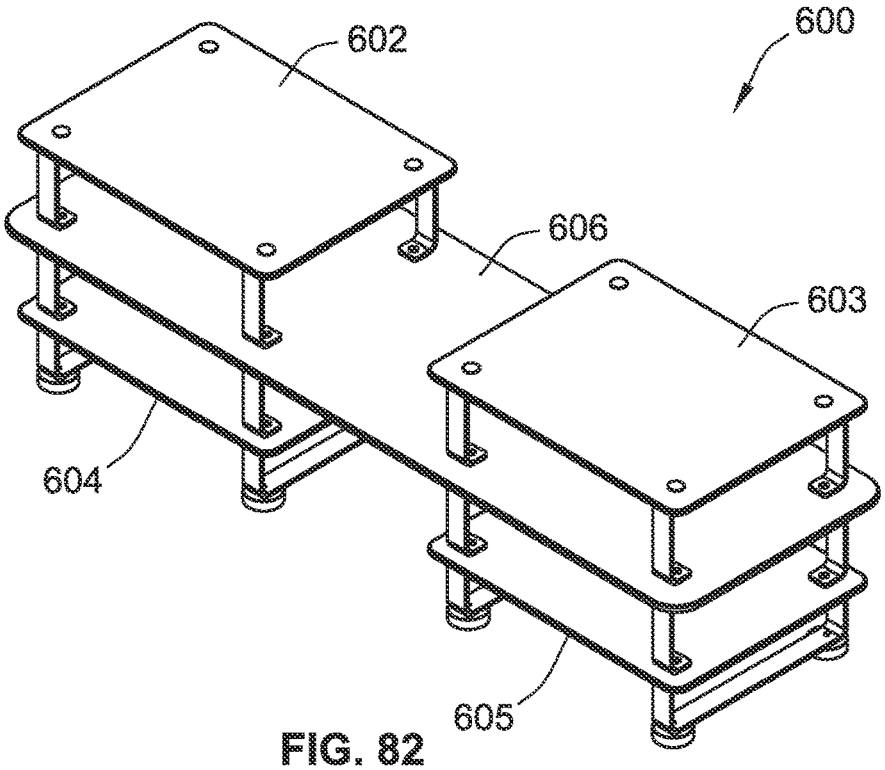
FIG. 82 is a top perspective view of a table with four small shelves and one medium shelf, in accordance with a still further embodiment.
Figure 83:
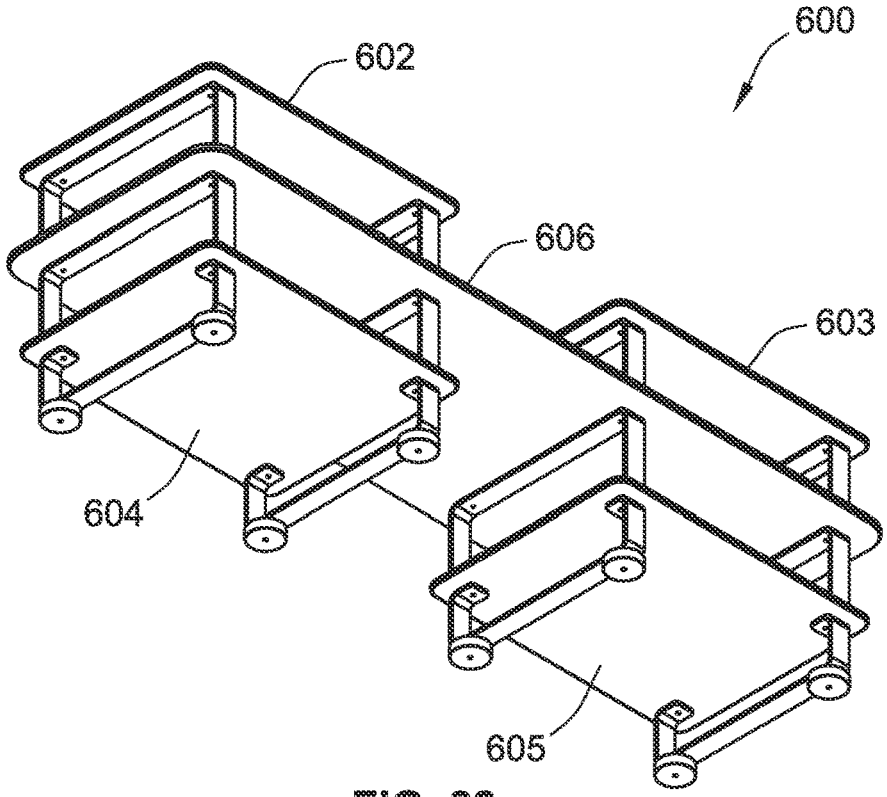
FIG. 83 is a bottom perspective view of the table shown in FIG. 82.

In another example, FIGS. 82 and 83 illustrate a table 600 with four small shelf panels 602-605 and one medium shelf panel 606. By way of example, the table 600 is readily and modularly achievable by adding the medium shelf panel 606 in-between the panels 204, 208 of the assembly 200 shown in FIG. 76, and further adding additional small shelf panels 603, 605, along with the appropriate number of other components, e.g., frames, screws, etc.

Figure 84:
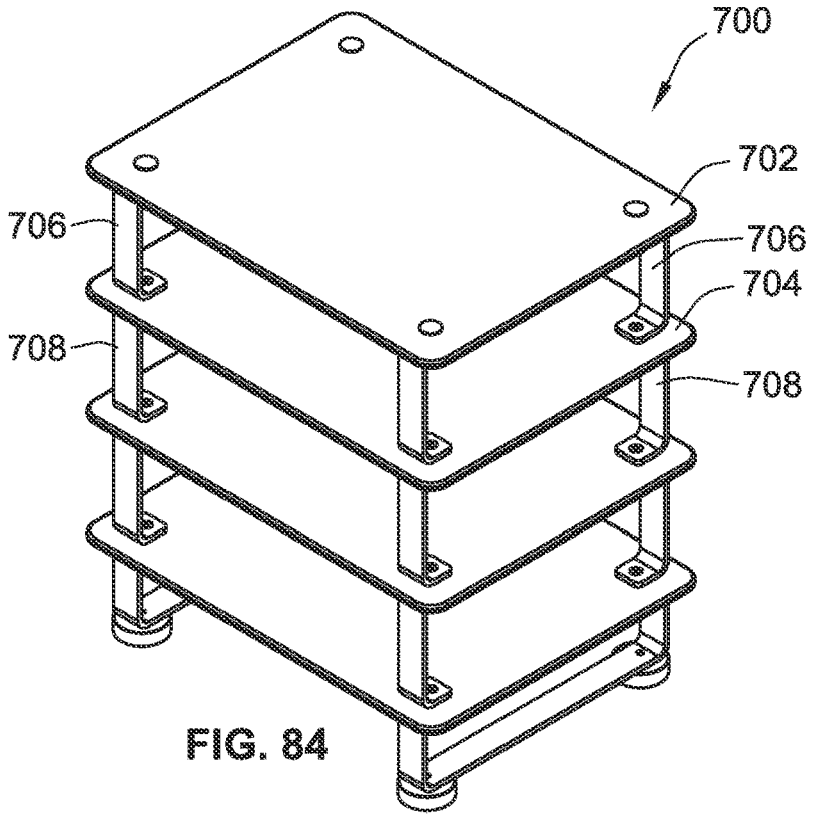
FIG. 84 is a top perspective view of a four-shelf pedestal, in accordance with another embodiment.
Figure 85:
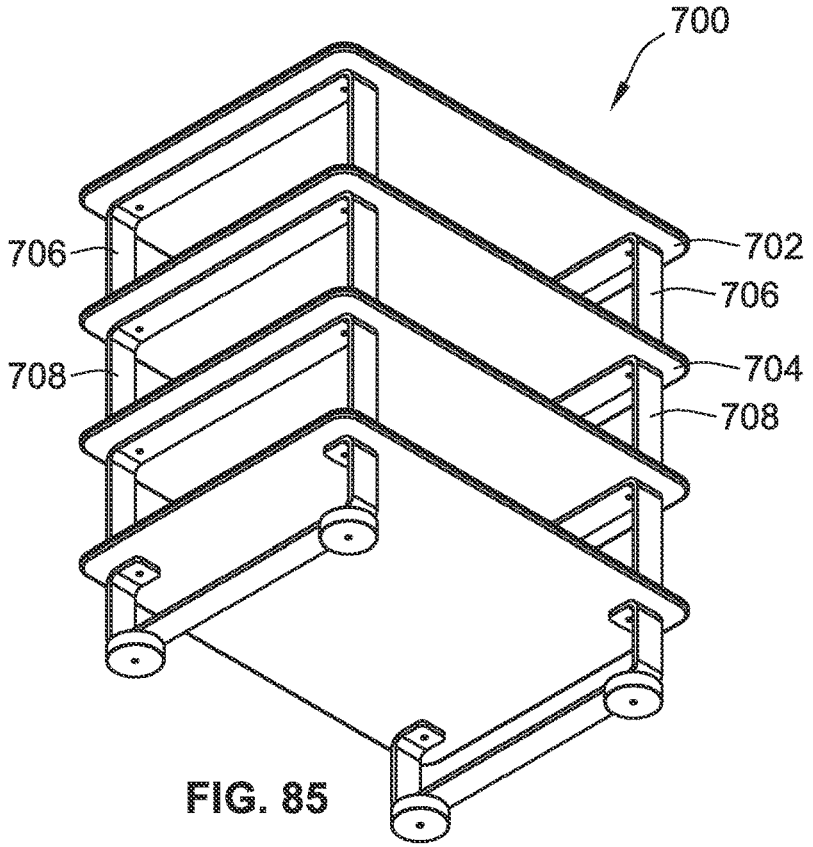
FIG. 85 is a bottom perspective view of the four-shelf pedestal shown in FIG. 83.
Figure 86:
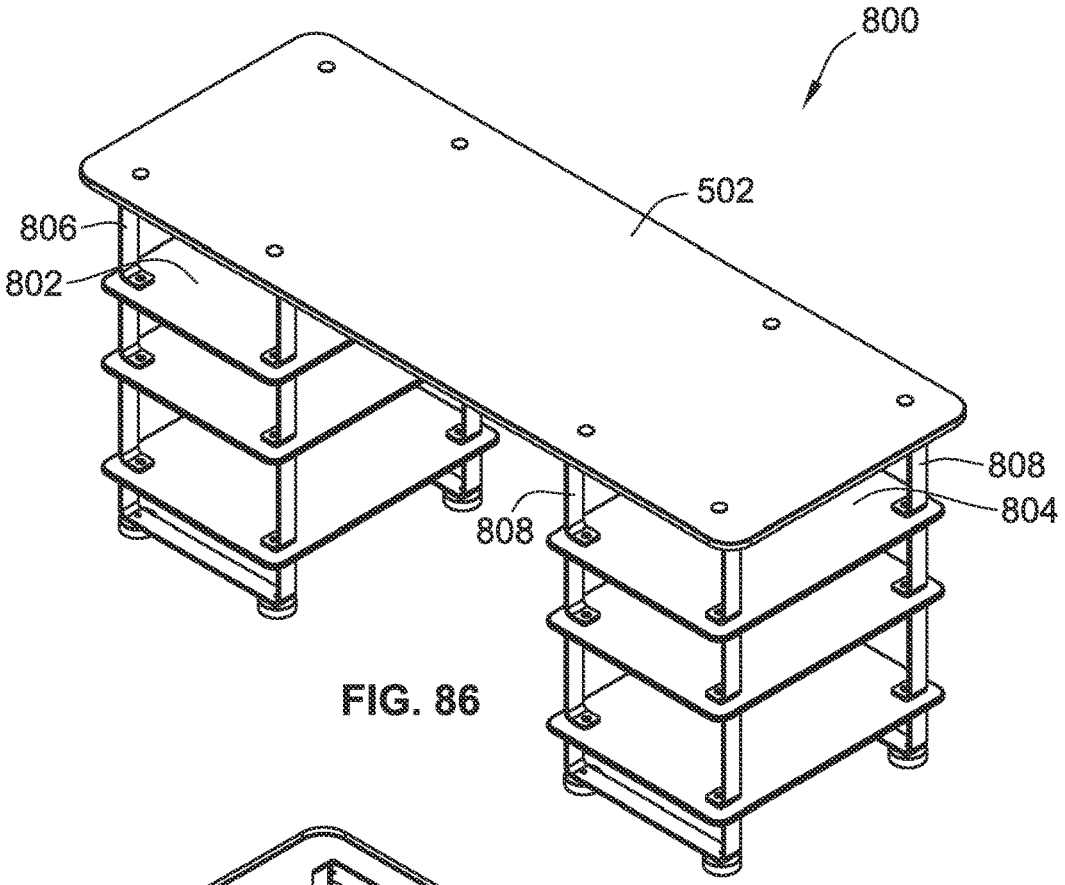
FIG. 86 is a top perspective view of a six-shelf desk, in accordance with a further embodiment.
Figure 87:
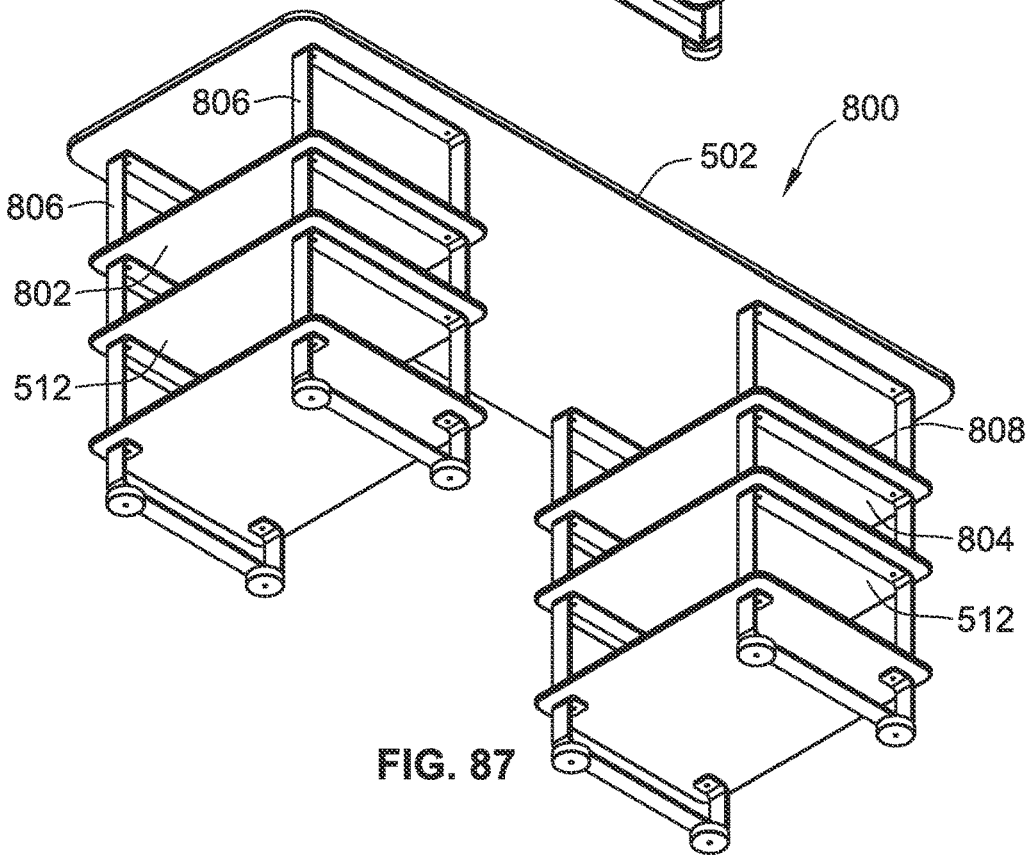
FIG. 87 is a bottom perspective view of the six-shelf desk shown in FIG. 86.

In yet another example, FIGS. 84 and 85 illustrate a four-shelf pedestal 700, which is readily achievable by adding two shelf panels 702, 704, two pairs of support frames 706, 708, and appropriate fasteners, to the assembly 200 shown in FIG. 76. In a further example, FIGS. 86 and 87 illustrate a six-shelf desk 800, which can be readily achievable by adding two shelf panels 802, 804, two pairs of support frames 806, 808, and appropriate fasteners, between the desk panel 502 and the top shelf panels 512 of the four-shelf desk 500 shown in FIGS. 80 and 81.

Figure 90:
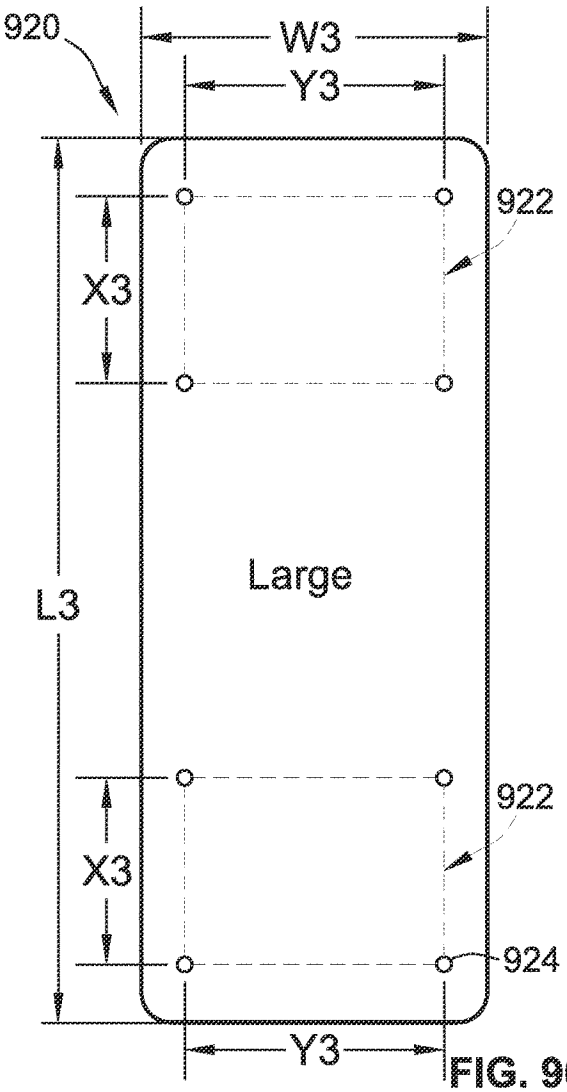
FIG. 90 is a top view of a large shelf panel, in accordance with another embodiment.
Figure 89:
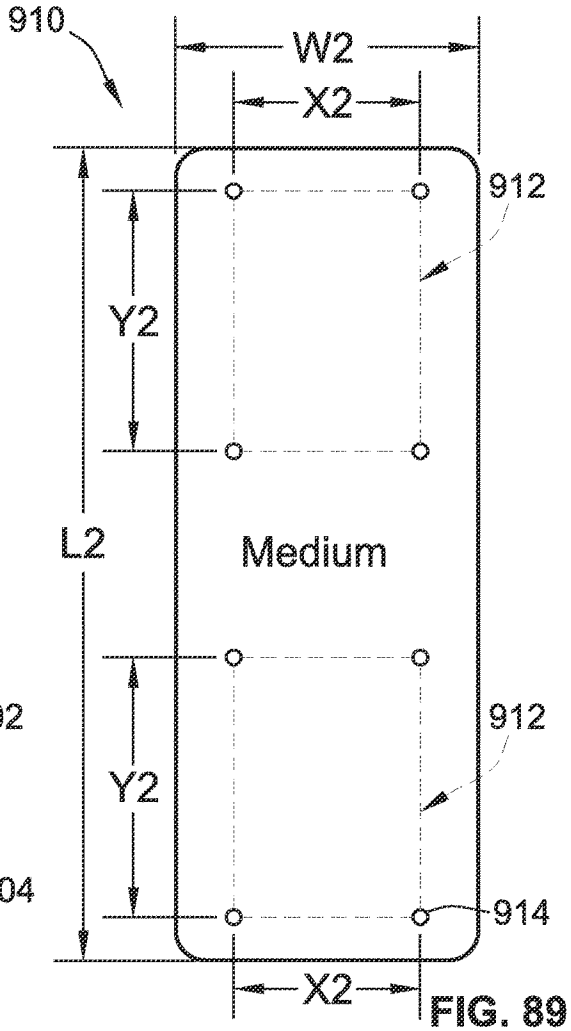
FIG. 89 is a top view of a medium shelf panel, in accordance with a still further embodiment.
Figure 88:
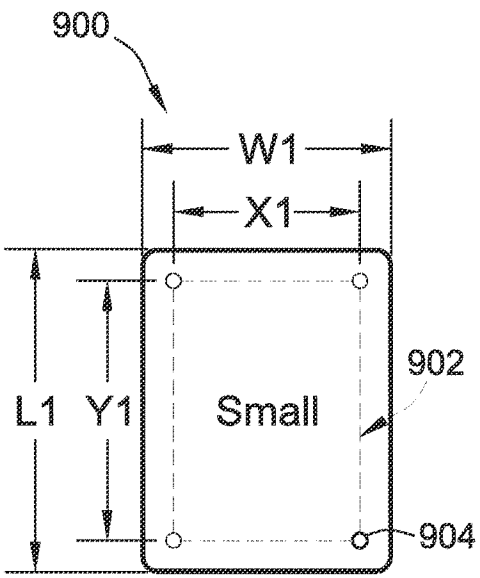
FIG. 88 is a top view of a small shelf panel, in accordance with yet another embodiment.

FIGS. 88-90 illustrate different-sized shelf panels that have matching hole patterns for assembly purposes. In reference to FIG. 88, a small shelf panel 900 has a length L1 and a width W1, and has a single arrangement 902 of four holes 904 arranged in a rectangular pattern defined by a first vertical dimension Y1 and a second horizontal dimension X1. According to one example, the length L1 is 21.6 inches (55 centimeters) and the width W1 is 16.7 inches (42 centimeters). In reference to FIG. 89, a medium shelf panel 910 has a length L2 and a width W2, and has two arrangements 912 of four holes 914, each, arranged in a rectangular pattern defined by a first vertical dimension Y2 and a second horizontal dimension X2. According to one example, the length L2 is 58.0 inches (147 centimeters) and the width W2 is 18.4 inches (47 centimeters). In reference to FIG. 90, a large shelf panel 920 has a length L3 and a width W3, and has two arrangements 922 of four holes 924, each, arranged in a rectangular pattern defined by a first horizontal dimension Y3 and a second vertical dimension X3. According to one example, the length L2 is 62 inches (157 centimeters) and the width W2 is 23.2 inches (59 centimeters).

In each of the panels 900, 910, and 920, the first dimensions Y1, Y2, and Y3 are equal to each other, and the second dimensions X1, X2, and X3 are equal to each other. Accordingly, by way of example, the hole arrangement 902 of the small shelf panel 900 matches each hole arrangement 912 of the medium shelf panel 910 (with the first dimensions Y1 and Y2 maintained in a vertical orientation), and each hole arrangement 922 of the large shelf panel 920 (with the first dimension Y1 now rotated in a horizontal orientation to match the horizontal orientation of the first dimension Y3).

Figure 91:
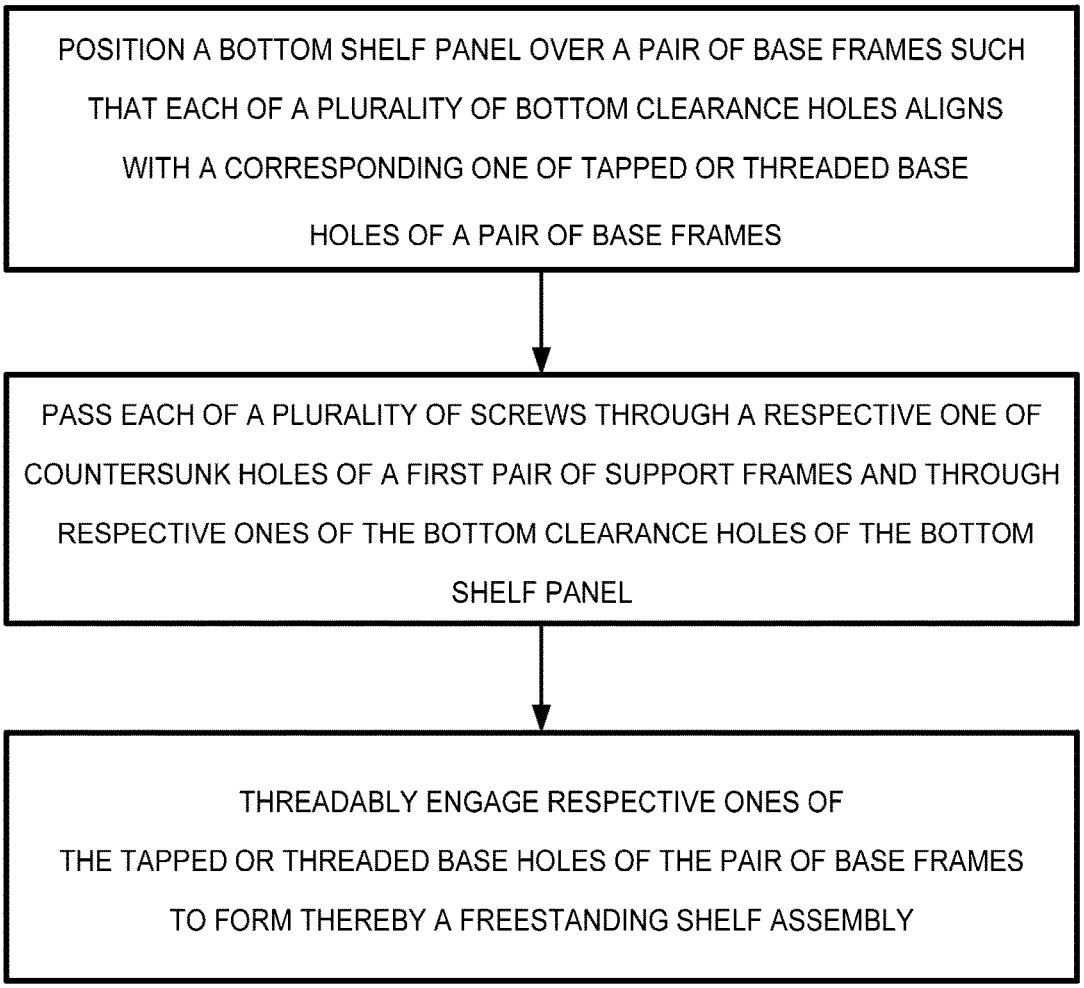
FIG. 91 is a flowchart for assembling a freestanding shelf assembly in accordance with at least some aspects of the disclosed concepts.

FIG. 91, described by way of example above, represents a method for assembling a freestanding shelf assembly.

The assemblies described herein use only a few components to assemble a myriad of configuration combinations using multiple sets of identical components. For example, to assembly a simple two-shelf (stacked) assembly that is freestanding, only two pairs of frames is required, and four pairs of fasteners. To add another stacked shelf, only another pair of frames and two pairs of fasteners is required.

Each of these embodiments and obvious variations thereof is contemplated as falling within the spirit and scope of the claimed invention, which is set forth in the following claims. Moreover, the present concepts expressly include any and all combinations and subcombinations of the preceding elements and aspects.

What is claimed is:

1. A freestanding shelf assembly, comprising:

a pair of base frames, each having an elongate rail portion extending horizontally between vertical leg portions, each of the leg portions terminating at a horizontal top portion having a tapped or threaded hole therein;

a bottom shelf panel having a plurality of holes through its surface and positioned over the pair of base frames such that each of the plurality of holes aligns with a corresponding one of the tapped or threaded holes of the base frames;

a first pair of support frames, each having an elongate support portion extending horizontally between vertical leg portions, each of the leg portions terminating at a horizontal bottom portion having a clearance hole therein; and a plurality of screws, each of which has a head, passes through respective ones of the holes of the first pair of support frames and through respective ones of the plurality of holes of the bottom shelf panel, and threadably engages respective ones of the tapped or threaded holes of the pair of base frames, to form thereby the freestanding shelf assembly;

wherein each of the pair of base frames is a unitary structure having a generally elongated C-shape, and wherein each of the first pair of support frames is a unitary structure having a generally elongated C-shape oriented in mirror-image relationship about the bottom shelf panel relative to each of the pair of base frames.

2. The shelf assembly of claim 1, wherein each of the pair of base frames and each of the first pair of support frames is fabricated from a metal to form the corresponding unitary structure.

3. The shelf assembly of claim 1, wherein each of the pair of base frames and each of the first pair of support frames has a thickness, a width, and a height, and wherein the width is greater than the thickness, and height is greater than the width.

4. The shelf assembly of claim 1, wherein the elongate rail portion has a length that is longer than the height of the base frames, and wherein the elongate support portion has a length that is longer than the height of the support frames.

5. The shelf assembly of claim 1, wherein each of the horizontal bottom portions has rounded corner edges at an end edge thereof.

6. The shelf assembly of claim 1, wherein the bottom shelf panel is composed of a glass material, the assembly further comprising a plurality of pads having a hole therein, corresponding ones of the plurality of pads being positioned between the horizontal bottom portion and a top surface of the bottom shelf panel such that the screw also passes through the hole of the pad.

7. The shelf assembly of claim 1, wherein each of the holes of the horizontal bottom portions is a countersunk hole, and each of the heads of the plurality of screws is a countersunk head, and wherein the countersunk head is flush with a top surface of the horizontal bottom portion and an end of the screw is flush with a bottom surface of the horizontal top portion.

8. The shelf assembly of claim 1, wherein a major surface of the horizontal top portion is substantially parallel with the elongate rail portion, and wherein a major surface of the horizontal bottom portion is substantially parallel with the elongate rail portion and with the elongate support portion.

9. A freestanding shelf assembly, comprising:

a pair of base frames, each having an elongate rail portion extending horizontally between vertical base leg portions and having two tapped or threaded base holes near each of the vertical base leg portions, each of the vertical base leg portions terminating at a horizontal bottom base portion;

a bottom shelf panel having a plurality of bottom holes through its surface and positioned over the pair of base frames such that each of the plurality of bottom holes aligns with a corresponding one of the tapped or threaded base holes of the base frames;

a first pair of support frames, each having an elongate support portion extending horizontally between vertical support leg portions, each of the vertical support leg portions terminating at a horizontal bottom support portion having a hole therein; and a plurality of screws, each of which has a head, passes through respective ones of the holes of the first pair of support frames and through respective ones of the plurality of bottom holes of the bottom shelf panel, and threadably engages respective ones of the tapped or threaded base holes of the pair of base frames, to form thereby the freestanding shelf assembly;

wherein each of the pair of base frames is a unitary structure having a generally elongated C-shape, and wherein each of the first pair of support frames is a unitary structure having a generally elongated C-shape oriented in mirror-image relationship about the bottom shelf panel relative to each of the pair of base frames.

10. The shelf assembly of claim 9, wherein each of the plurality of bottom holes of the bottom shelf panel is a clearance, unthreaded hole.

11. The shelf assembly of claim 9, wherein the bottom shelf panel has a top surface and a bottom surface, each surface being defined by a front side, a back side, a left side, and a right side, the top and bottom surfaces being identical to facilitate top-to-bottom reversibility, the front and back sides being identical to facilitate front-to-back reversibility, the left and right sides being identical to facilitate left-to-right reversibility.

12. The shelf assembly of claim 9, wherein each horizontal bottom base portion of the base frames has a clearance hole with a threaded stud machine-pressed therein, the threaded stud extending downward from the horizontal bottom base portion.

13. The shelf assembly of claim 12, further comprising a pair of cylindrical feet mounted to each of the pair of base frames, each of the pair of cylindrical feet having a central tapped hole in which a respective threaded stud is received and threadably engaged.

14. The shelf assembly of claim 9, wherein each of the pair of bases frames is identical to each other and to each of the first pair of support frames.

15. The shelf assembly of claim 9, further comprising a top shelf panel having a plurality of top holes through its surface and positioned over the first pair of support frames, wherein each of the first pair of support frames has two tapped or threaded support holes near each of the vertical support leg portions, the top shelf panel being positioned over the first pair of support frames such that each of the plurality of top holes aligns with a corresponding one of the tapped or threaded support holes of the first pair of support frames.

16. The shelf assembly of claim 15, wherein the bottom shelf panel has a bottom length L1 and a bottom width W1 and the top shelf panel has a top length L2 and a top width W2, each of the bottom length L1, bottom width W1, top length L2, and top width W2 being different from each other;

wherein the plurality of bottom holes of the bottom shelf panel is arranged in a rectangular pattern defined by a first bottom dimension Y1 along the bottom length L1 and a second bottom dimension X1 along the bottom width W1;

wherein the plurality of top holes of the top shelf panel is arranged in a rectangular pattern defined by a first top dimension Y2 along the top length L2 and a second top dimension X2 along the top width W2; and wherein the first bottom dimension X1 is equal to the second top dimension Y2 and the second bottom dimension Y1 is equal to the first top dimension X2.

* * * * *